US005873276A

United States Patent [19]

Dawson et al.

[11] Patent Number: 5,873,276

[45] **Date of Patent: *Feb. 23, 1999**

[54] KEYPAD ENTRY ELECTRONIC COMBINATION LOCK WITH SELF-GENERATED COMBINATION

[75] Inventors: Gerald Lee Dawson, Lexington; Daniel Lee Thompson, Paris; James D. Hamilton, Lexington, all of Ky.

[73] Assignee: Mas-Hamilton Group, Lexington, Ky.

[ * ] Notice: The term of this patent shall not extend beyond the expiration date of Pat. No. 5,709,114.

[21] Appl. No.: 704,109

[22] Filed: Aug. 28, 1996

Related U.S. Application Data

[63] Continuation-in-part of Ser. No. 558,843, Nov. 15, 1995, Pat. No. 5,709,114, which is a continuation-in-part of Ser. No. 342,740, Nov. 21, 1994, abandoned.

[51] Int. Cl.[6] ..... E05B 49/00

[52] U.S. Cl. ..... 70/278; 70/284; 340/825.31

[58] Field of Search ..... 70/277–279, 280–284; 340/825.31, 825.32, 825.35

[56] References Cited

U.S. PATENT DOCUMENTS

| | | | |
|---|---|---|---|
| 4,209,782 | 6/1980 | Donath et al. | 70/278 X |
| 4,509,093 | 4/1985 | Stell Berger | 340/825.31 X |
| 4,736,419 | 4/1988 | Roe | 235/382.5 X |
| 4,760,393 | 7/1988 | Mauch | 340/825.31 |
| 4,870,411 | 9/1989 | Lewiner et al. | 70/278 X |
| 4,901,545 | 2/1990 | Bacon et al. | 70/278 |
| 4,912,460 | 3/1990 | Chu | 340/825.31 |
| 4,970,504 | 11/1990 | Chen | 70/278 X |
| 4,972,182 | 11/1990 | Novik et al. | 70/278 X |
| 4,992,785 | 2/1991 | Lewiner et al. | 70/278 X |
| 5,083,122 | 1/1992 | Clark | 70/278 X |
| 5,136,870 | 8/1992 | Gartner et al. | 70/278 X |
| 5,164,718 | 11/1992 | Cedergren | 70/278 X |
| 5,184,491 | 2/1993 | Schittenhelm | 70/278 |
| 5,347,267 | 9/1994 | Murray | 70/278 X |
| 5,387,903 | 2/1995 | Cutter et al. | 70/278 X |
| 5,410,301 | 4/1995 | Dawson et al. | 340/825.31 |
| 5,416,471 | 5/1995 | Treharne et al. | 70/278 X |
| 5,422,634 | 6/1995 | Owbo | 70/278 X |
| 5,594,430 | 1/1997 | Cutter et al. | 70/278 X |

*Primary Examiner*—Suzanne Dino Barrett
*Attorney, Agent, or Firm*—Laurence R. Letson

[57] ABSTRACT

A combination lock and particularly an electronic combination lock used on a container that is typically housed within an enclosure having a door which further has a lock and a security switch indicating that the enclosure door has been opened may, be provided with a device to shunt a security signal around the switch associated with the enclosure door to shut off, override, or cancel the security switch signal. The lock may be provided with a shunt relay which effectively connects a signal from a voltage source to a monitor or alarm when the combination lock is opened, thereby signaling the monitor that the enclosure door was opened by an individual having the authorized combination for the combination lock. This indicates that the person opening the enclosure lock has a legitimate authorization to access the locked container within the enclosure and that the opening of the enclosure door may be reasonably ignored. Upon the locking of the combination lock and the closing of the enclosure door a brief alarm signal indicates that the combination lock has been locked and the enclosure closed.

11 Claims, 33 Drawing Sheets

START CHECK SILENT
114
IS SILENT ALARM FLAG SET ?
140
YES
NO
RETURN
142
DISPLAY 'ALS' (ALARM SET)
144
TURN OFF SILENT ALARM RELAY
146
CLEAR SILENT ALARM FLAG
148
EE-WRITE SILENT ALARM FLAG
150
DIAL ROTATED 1/2 REV. ?
152
YES
NO
WDTO
110

136
START
PAIR IS IN
164
1ST
DIGIT-PAIR
?
YES
NO
172
1ST OF PAIR
= #
?
YES
NO
174
PROCESS
SPECIAL MENU
OPTIONS
166
2ND
DIGIT-PAIR
?
YES
NO
172
1ST OF PAIR
= #
?
YES
NO
176
PROCESS
SPECIAL MENU 2
OPTIONS
168
3RD
DIGIT-PAIR
?
YES
NO
178
IS
CHANGE KEY
FLAG SET
?
YES
NO
180
PROCESS
CHANGE KEY IN
170
RETURN
182
IS
SUPER-SHELVE
FLAG SET
?
YES
NO
186
PROCESS
SUPER-SHELVE
2ND PASS
184
PROCESS
COMBO-IS-IN
170
RETURN
112
GO TO
'WDTO'

126
START
CHK OPEN AUDITS
188
ARE ANY
OPEN FLAGS SET
?
YES
NO
192
ASK FOR 'IPI
TM-READ TO
BUFFER
PID S/N CAN TYPE

194
GET KEY DATA
PID S/N, CAN/KEY TYPE,
SEC-ID, TIME,
USER ID, CUST. NO.
& CO/BRANCH ID
CONTINUE
SPECIAL MENU #4
190
RETURN
196
IS
KEY-TYPE'S
'OPEN FLAG'
SET
?
NO
YES
198
EE READ
'OPEN' RECORD
202
200
SAME KEY
AS OPENER
?
YES
EE-WRITE
'OPEN/CLOSE'
AUDIT RECORD
NO

204
EE WRITE 'CLOSE-ONLY' AUDIT RECORD
CLEAR 'OPEN RECORD' FLAG
206
208
SAME-KEY FLAG ?
NO
YES
220
TM WRITE 'CLOSE-ONLY' AUDIT RECORD
210
TM READ LAST TM AUDIT RECORD
NO
LAST TM-AUDIT = 'OPEN' ?
YES
212
NO
214
TM'S S/N & SEAL COUNT = EEPROMS ?
YES
216
TM-WRITE 'OPEN/CLOSE' AUDIT RECORD
218
TURN-OFF 'SHUNT' RELAY
110
WDTO
222
BANK KEY ?
NO
YES
226
DISPLAY 'cCS' (c+CLOSE SEAL)
228
HAS DIAL ROTATED 1/2 REV. ?
NO
YES
224
GOTO 'EOP-TOP'

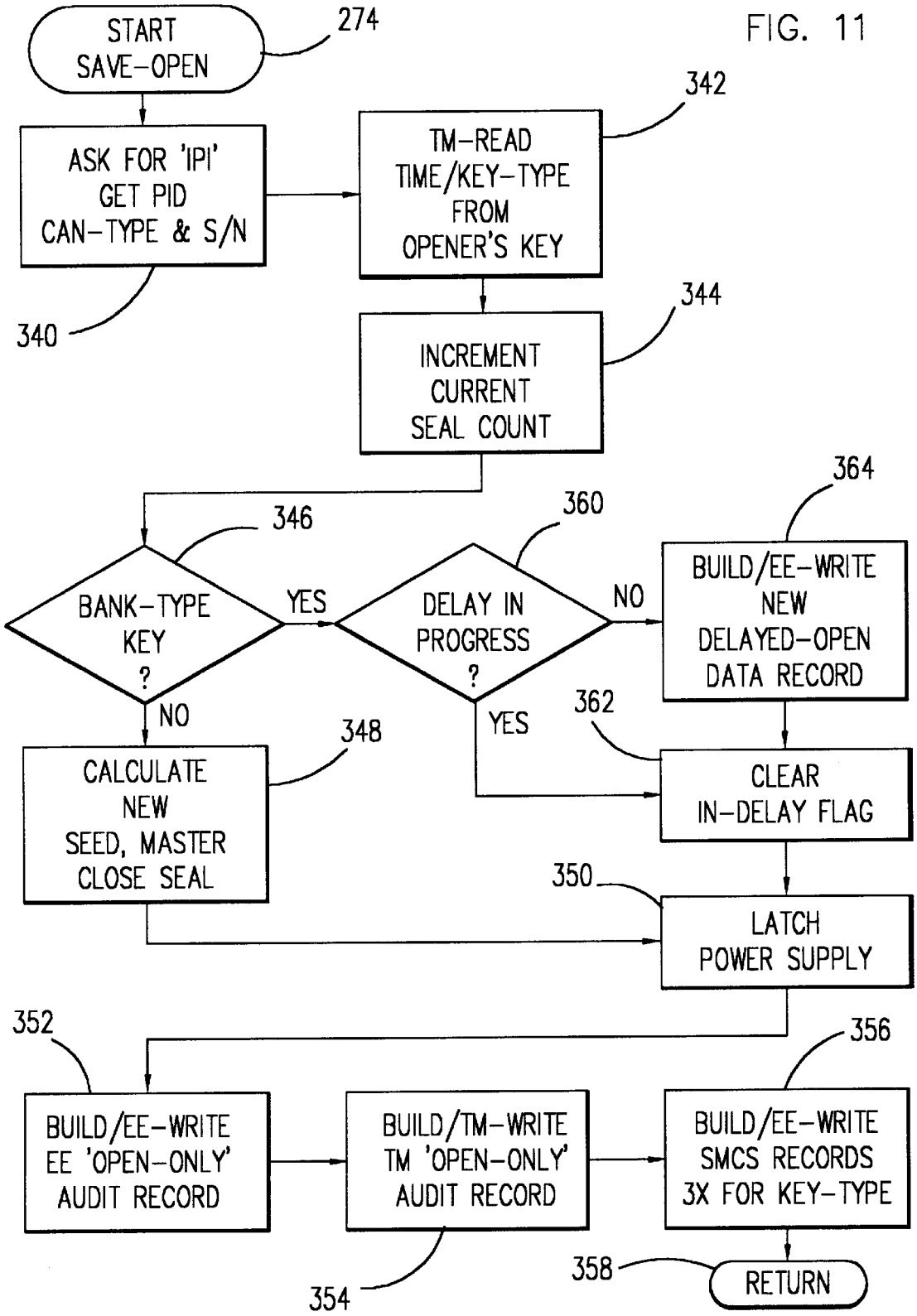
FIG. 11
START SAVE-OPEN
274
ASK FOR 'IPI' GET PID CAN-TYPE & S/N
340
TM-READ TIME/KEY-TYPE FROM OPENER'S KEY
342
INCREMENT CURRENT SEAL COUNT
344
BANK-TYPE KEY ?
346
YES
NO
DELAY IN PROGRESS ?
360
NO
YES
BUILD/EE-WRITE NEW DELAYED-OPEN DATA RECORD
364
CALCULATE NEW SEED, MASTER CLOSE SEAL
348
CLEAR IN-DELAY FLAG
362
LATCH POWER SUPPLY
350
BUILD/EE-WRITE EE 'OPEN-ONLY' AUDIT RECORD
352
BUILD/TM-WRITE TM 'OPEN-ONLY' AUDIT RECORD
354
BUILD/EE-WRITE SMCS RECORDS 3X FOR KEY-TYPE
356
RETURN
358

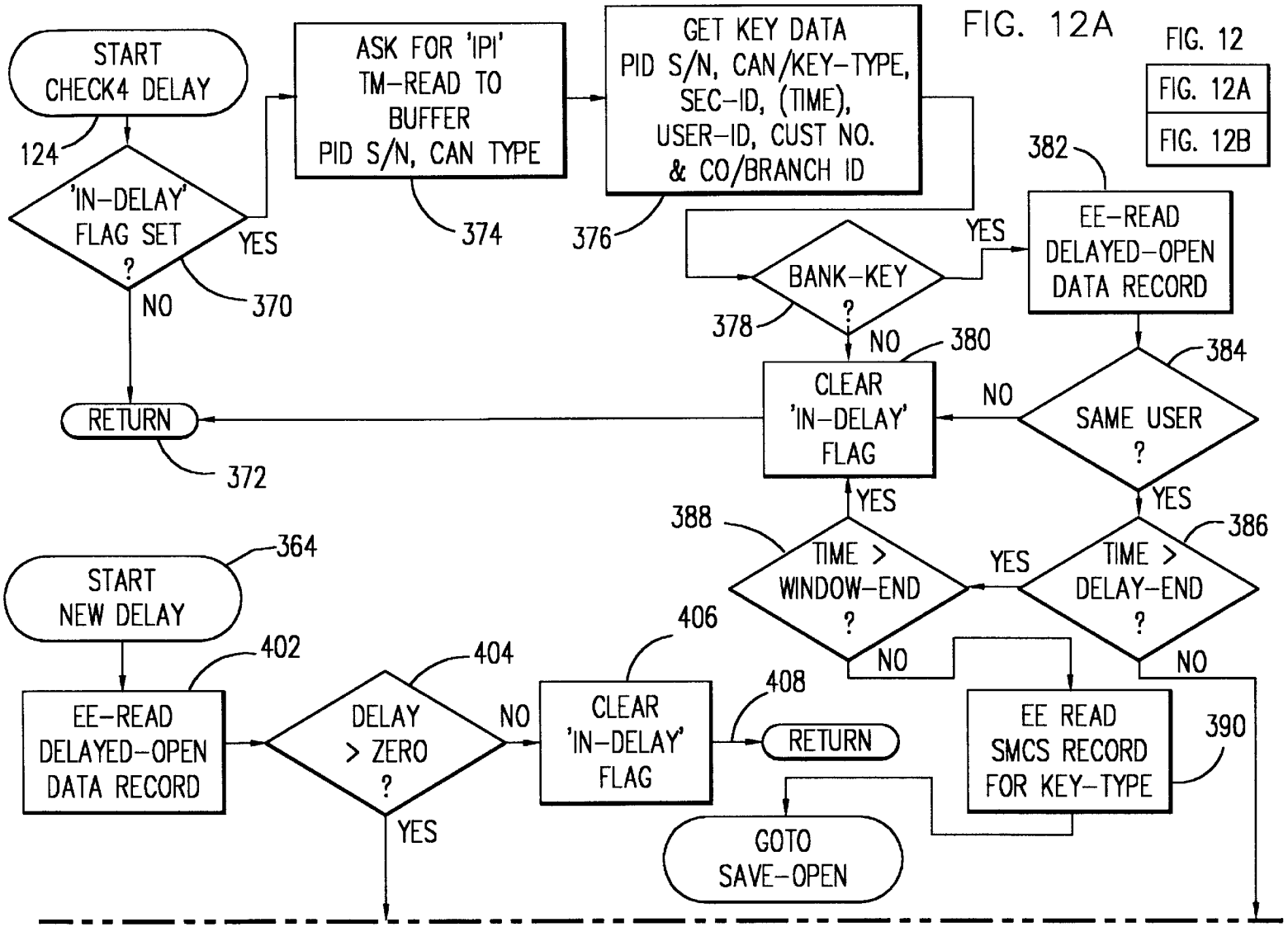
FIG. 12
FIG. 12A
FIG. 12B
FIG. 12A
START CHECK4 DELAY
124
'IN-DELAY' FLAG SET ?
YES
NO
370
ASK FOR 'IPI' TM-READ TO BUFFER PID S/N, CAN TYPE
374
GET KEY DATA PID S/N, CAN/KEY-TYPE, SEC-ID, (TIME), USER-ID, CUST NO. & CO/BRANCH ID
376
BANK-KEY ?
YES
NO
378
EE-READ DELAYED-OPEN DATA RECORD
382
SAME USER ?
384
NO
YES
CLEAR 'IN-DELAY' FLAG
380
RETURN
372
TIME > WINDOW-END ?
YES
NO
388
TIME > DELAY-END ?
386
YES
NO
EE READ SMCS RECORD FOR KEY-TYPE
390
GOTO SAVE-OPEN
RETURN
408
CLEAR 'IN-DELAY' FLAG
406
DELAY > ZERO ?
404
NO
YES
START NEW DELAY
364
EE-READ DELAYED-OPEN DATA RECORD
402

180
START
CHANGE KEY IN
430
ASK FOR 'ISA'
TM-READ TO
BUFFER
CAN-TYPE & S/N
432
GET KEY DATA
CAN-TYPE,
PID S/N,
KEY TYPE, TIME
434
RESOLVE
CAN/KEY-TYPES
& LOCK MODE
436
KEY-TYPE
= INITIALIZE MODE
?
YES
NO
440
DISPLAY
'Ini'
448
KEY-TYPE
= SHELVE MODE
?
YES
NO
452
DISPLAY
'SHL'
454
KEY-TYPE
= ADD BANK USER
?
YES
NO
458
DISPLAY
'ADD'
460
KEY-TYPE
= DEL BANK USER
?
YES
NO
462
DISPLAY
'dEL'
462
GOTO
'LIGHTNING'

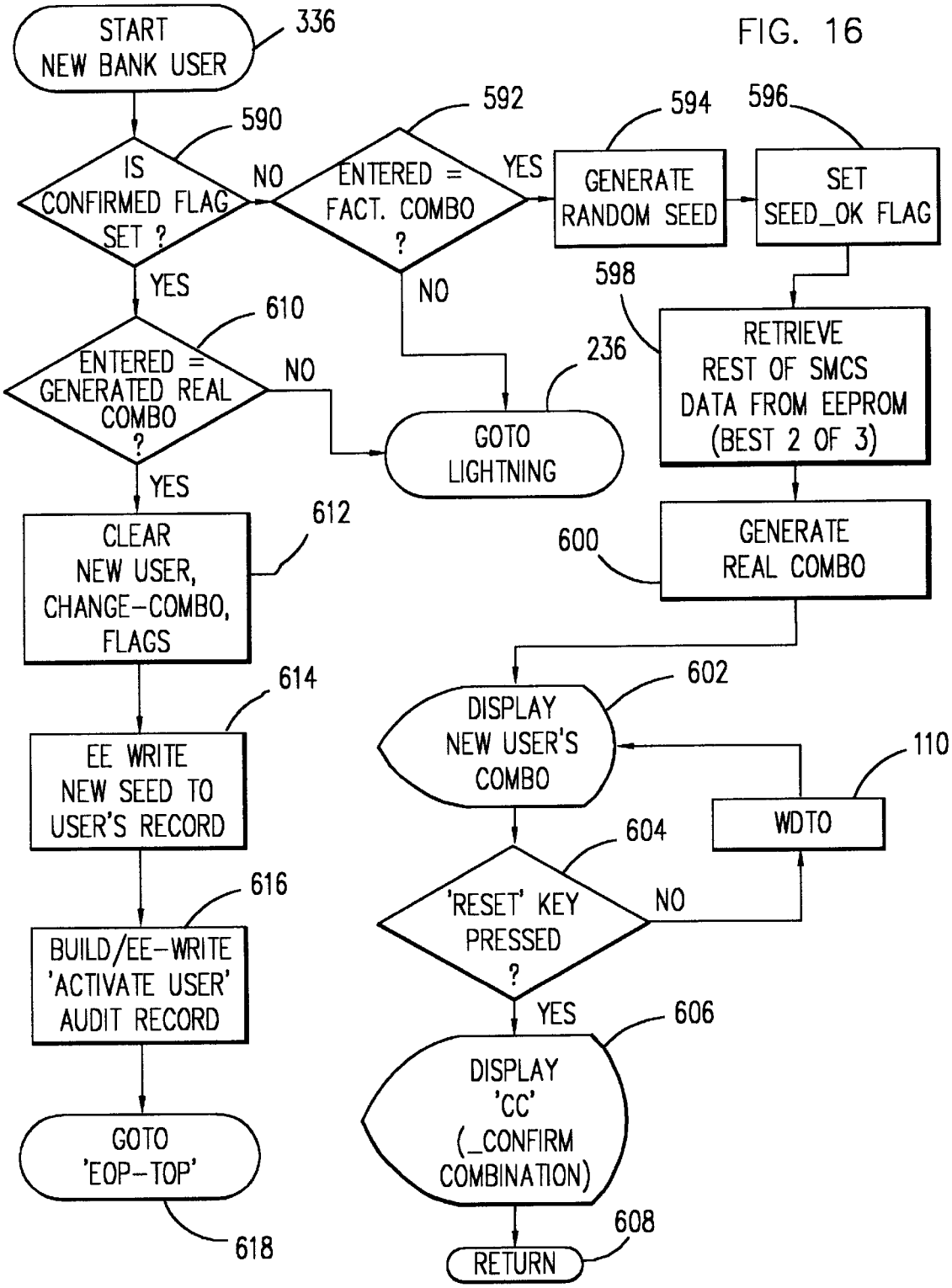
FIG. 16
START NEW BANK USER
336
IS CONFIRMED FLAG SET ?
590
NO
YES
ENTERED = FACT. COMBO ?
592
YES
NO
GENERATE RANDOM SEED
594
SET SEED_OK FLAG
596
RETRIEVE REST OF SMCS DATA FROM EEPROM (BEST 2 OF 3)
598
GENERATE REAL COMBO
600
ENTERED = GENERATED REAL COMBO ?
610
NO
YES
GOTO LIGHTNING
236
CLEAR NEW USER, CHANGE-COMBO, FLAGS
612
EE WRITE NEW SEED TO USER'S RECORD
614
BUILD/EE-WRITE 'ACTIVATE USER' AUDIT RECORD
616
GOTO 'EOP-TOP'
618
DISPLAY NEW USER'S COMBO
602
'RESET' KEY PRESSED ?
604
NO
YES
WDTO
110
DISPLAY 'CC' (_CONFIRM COMBINATION)
606
RETURN
608

| FIG. 17A | FIG. 17B |
|---|---|

236
GOTO 'LIGHTNING'
644
NO
636
A LOCK INIT'ED FLAG SET ?
NO
LAST LOCK SET ?
YES
YES
640
658
BUFFERED = LOCK S/N ?
NO
RETURN
YES
642
THIS TRANSACTION COMPLETE ?
NO
YES
654
652
BUILD/EE-WRITE 'SHELVE' AUDIT RECORD
SET A LOCK INIT'ED FLAG

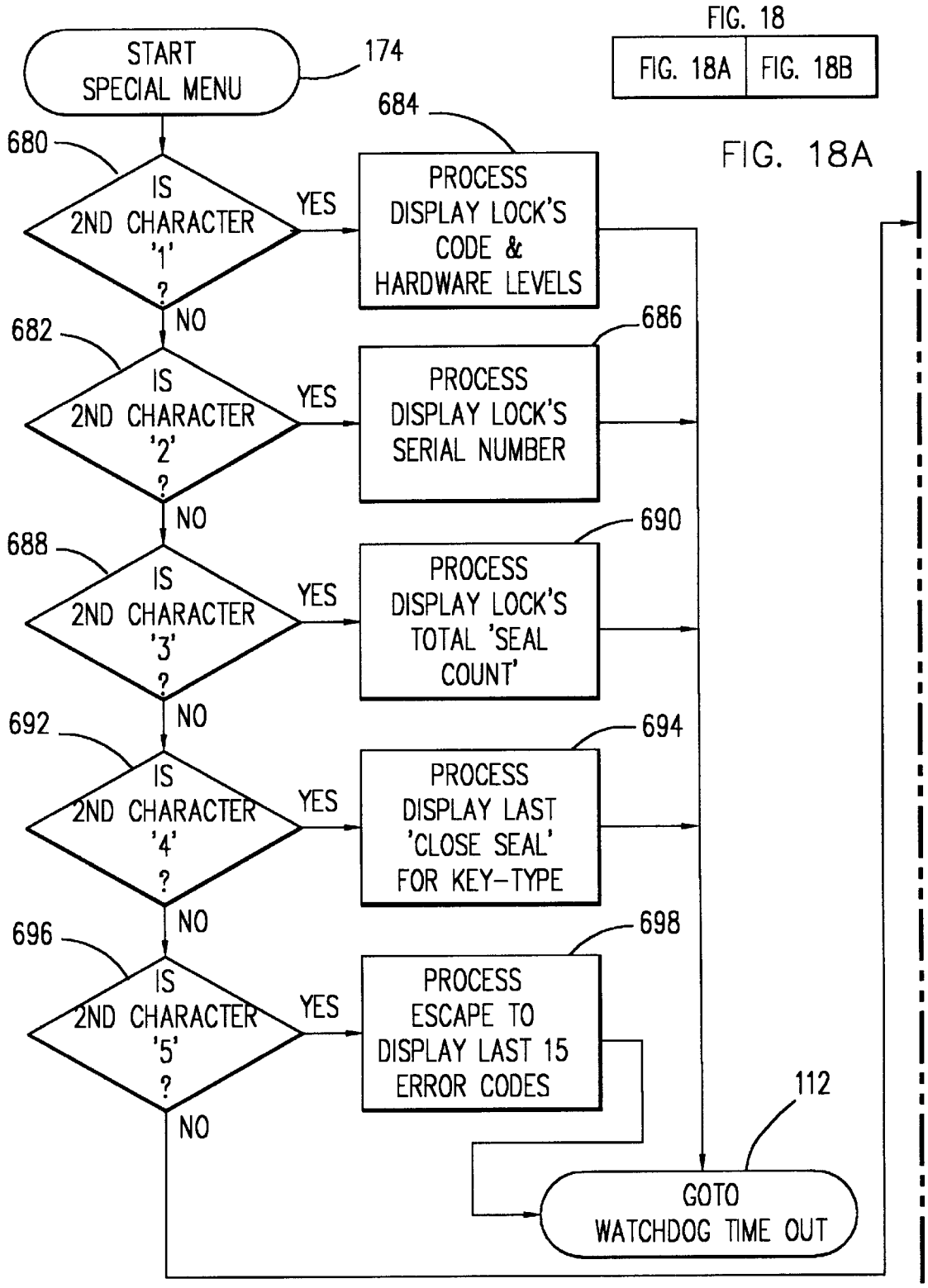
FIG. 18
FIG. 18A
FIG. 18B
FIG. 18A
START SPECIAL MENU
174
680
IS 2ND CHARACTER '1' ?
YES
NO
684
PROCESS DISPLAY LOCK'S CODE & HARDWARE LEVELS
682
IS 2ND CHARACTER '2' ?
YES
NO
686
PROCESS DISPLAY LOCK'S SERIAL NUMBER
688
IS 2ND CHARACTER '3' ?
YES
NO
690
PROCESS DISPLAY LOCK'S TOTAL 'SEAL COUNT'
692
IS 2ND CHARACTER '4' ?
YES
NO
694
PROCESS DISPLAY LAST 'CLOSE SEAL' FOR KEY-TYPE
696
IS 2ND CHARACTER '5' ?
YES
NO
698
PROCESS ESCAPE TO DISPLAY LAST 15 ERROR CODES
112
GOTO WATCHDOG TIME OUT

KEYPAD ENTRY ELECTRONIC COMBINATION LOCK WITH SELF-GENERATED COMBINATION

RELATED APPLICATIONS

This application is a continuation-in-part application of co-pending U.S. patent application Ser. No. 08/558,843 filed Nov. 15, 1995 entitled KEYPAD ENTRY ELECTRONIC COMBINATION LOCK WITH SELF GENERATED COMBINATION by Gerald L. Dawson, Daniel L. Thompson and James D. Hamilton now U.S. Pat. No. 5,709,114, which is a continuation-in-part application of U.S. patent application Ser. No. 08/342,740, filed Nov. 21, 1994, entitled KEYPAD ENTRY ELECTRONIC COMBINATION LOCK WITH SELF GENERATED COMBINATION by Gerald L. Dawson and Daniel L. Thompson, now abandoned.

FIELD OF THE INVENTION

This invention relates to electronic combination locks and more specifically to combination locks which self generate their combinations.

BACKGROUND OF THE INVENTION

Electronic combination locks are known that use data uniquely associated with a particular lock to generate a unique combination to open the lock. An authorized combination is provided to service personnel by a dispatch computer which mimics the processor of the lock control to determine the combination to be accepted whenever the lock control actually generates the combination. For an example of a lock which generates its combination for comparison with a combination similarly generated by a separate computer for dispatching purposes, reference is made to co-pending U.S. patent application Ser. No. 08/139,450 filed Oct. 20, 1993 by Gerald L. Dawson et al, entitled ELECTRONIC COMBINATION LOCK UTILIZING A ONE TIME USE COMBINATION.

The lock combination is a mathematical combination of such numbers or values that are uniquely associated with a particular lock such as the lock serial number, the last opening combination, a master combination, and the seal count indicating the number of times the lock has been opened.

It is advantageous both to identify the operator entering the lock and further to identify and log the date time of entry as well as the date and time of closing.

Locks of the type which self-generate power through operation of a lock component, such as a dial or lever, generally use capacitors to store the electrical energy necessary for operation of the lock but cannot store sufficient energy to power a clock at all times to accurately date and time log each entry because the clock must run continuously and, therefore, consumes electrical power. An example of a lock that generates its own operating power is co-pending U.S. patent application Ser. No. 08/268,193, filed Jun. 29, 1994, now U.S. Pat. No. 5,451,934, by Gerald L. Dawson et al. and entitled ELECTRONIC COMBINATION LOCK WITH TIME DELAY FOR OPENING.

The security of a lock is only as secure as the personnel operating the lock. If a lock is left unlocked so that the operator may return at a later time and remove the contents of the container without having to operate the lock, security has been compromised. By incorporating into the lock a feature that provides the operator an indicator the lock has been relocked and that indicator is required to be reported or conveyed to the dispatcher of the combinations for the lock and the indicator is an essential element of data that must be provided to the lock to open it the next time, the security is improved. An example of a lock that provides an indication of the locking thereof is co-pending U.S. patent application Ser. No. 08/198,835, filed Feb. 18, 1994, by James E. Hamilton et al. and is entitled ELECTRONIC COMBINATION LOCK WITH CLOSURE AND LOCKING VERIFICATION.

Automated Teller Machines in many instances are housed in stand alone structures or kiosks. Access to the ATM for purposes of maintenance or service is typically through a door of such housing structure. These doors are many times provided with a sensor or switch that is part of an alarm circuit which is in turn connected to a monitor device or panel at a security monitoring center.

Such an alarm circuit is typically activated by opening the door to the housing structure which interrupts the signal being carried on the circuit. Opening the door activates a normally closed door switch to interrupt the "door closed" signal and activate the alarm. When the monitoring signal voltage is not received by the monitor an alarm is set off to alert the operator of the monitor that some condition exists that warrants attention, i.e., a door is ajar and not secure. The circuit will continue to cause the alarm to continue at the monitor unless overridden by the individual entering the structure. The override control is typically a key pad control through which the individual enters a code that the terminal recognizes as a turn-off signal or an override signal. This signal may be entered within a preset time period which will then be effective to silence the alarm or prevent the alarm from being sounded. Alternative override controls involve the insertion of a key into a lock and operation of the key/lock to provide a signal that an individual with an authorized key has overridden the alarm system.

Typically, a person who is assigned the task of restocking or reloading the cash supply in the dispensing mechanism picking up deposits in the collection tray of an Automated Teller Machine (ATM) will need to be in the ATM for only a very short period of time.

Upon opening the structure door and triggering the alarm in a conventional alarm circuit monitoring the door, the service person should disarm the alarm signal by entering a code into a touch pad terminal within the structure.

Upon completion of the task to be performed the service person must re-arm the alarm circuit by entry of a code or a key as required by the particular circuit design.

Because the service person may need to have access to the ATM for only a very short time, and because the alarm does not necessarily sound at the ATM site many service persons will not disarm the alarm circuit upon entry, rather relying upon swift entry and exit.

The result is that the operator of the monitor is alerted by the alarm and does not know for a period of as much as 2–3 minutes whether the alarm is the result of an unauthorized entry or not. The alarm may be false and if the monitor operator waits for 2–3 minutes to contact the law enforcement agency or the security personal of the company, valuable time has been lost. On the other hand, too prompt a response will result in the requesting a dispatch of security or law enforcement personnel for a false alarm.

OBJECTS OF THE INVENTION

It is an object of the invention to provide a lock which self-generates its power, uses a one-time self-generated combination, verifies both the identity of the user and the type of user with a unique electronically readable coded key.

It is a further object of the invention to provide an operational mode whereby each category of users may be required to enter at least two combinations and use two identifying keys.

It is still a further object of the invention to permit the entry of a special combination and the use of a one-time specifically coded electronically readable key to open the lock in the event the dispatching computer and the lock have become unsynchronized and the previously dispatched combination fails to open the lock.

It is an additional object of the invention to provide an override for a silent alarm on an outer building when the lock is properly operated to gain entry.

SUMMARY OF THE INVENTION

The objects of the invention are accomplished by the incorporation of the computer control program detailed herein into the microprocessor of an electronic self-powered combination lock to receive manual input to generate power and to receive data from a uniquely coded electronic key as well as combination provided by operators; this combination is useable only once to open the lock.

A detailed understanding of the invention may best be had from the drawings attached hereto and the Detailed Description of the Invention to follow.

BRIEF DESCRIPTION OF THE DRAWINGS

FIG. 4 is a diagram of the relationship of FIGS. 4A and 4B.

FIG. 9 is a diagram of the relationship of FIGS. 9A, 9B and 9C.

FIGS. 10 and 11 are logic flow diagrams which illustrate selected portions of the logic flow diagram in FIG. 9B.

FIG. 12 is a diagram of the relationship of FIGS. 12A and 12B.

FIGS. 12A and 12B illustrate operation 124 of FIG. 4B.

FIG. 14 is a diagram of the relationship of FIGS. 14A and 14B.

FIG. 15 is a diagram of the relationship of FIGS. 15A and 15B.

FIG. 16 illustrates operation 336 of FIG. 10.

FIG. 18 is a diagram of the relationship of FIGS. 18A and 18B.

FIGS. 18A and 18B illustrate operation 174 of FIG. 7.

FIG. 20 is a diagram of the relationship of FIGS. 20A and 20B.

DETAILED DESCRIPTION OF THE INVENTION

Figure 1:
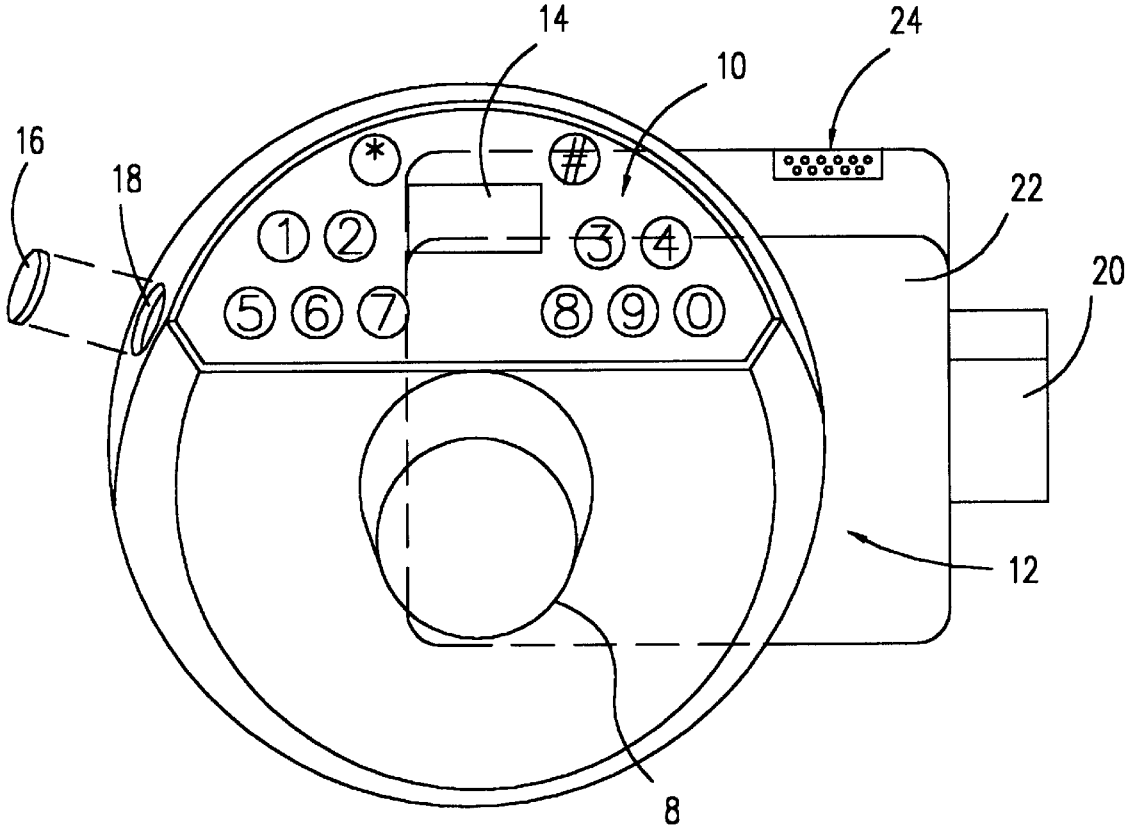
FIG. 1 is an illustration of a lock of the type incorporating the invention.
Figure 3:
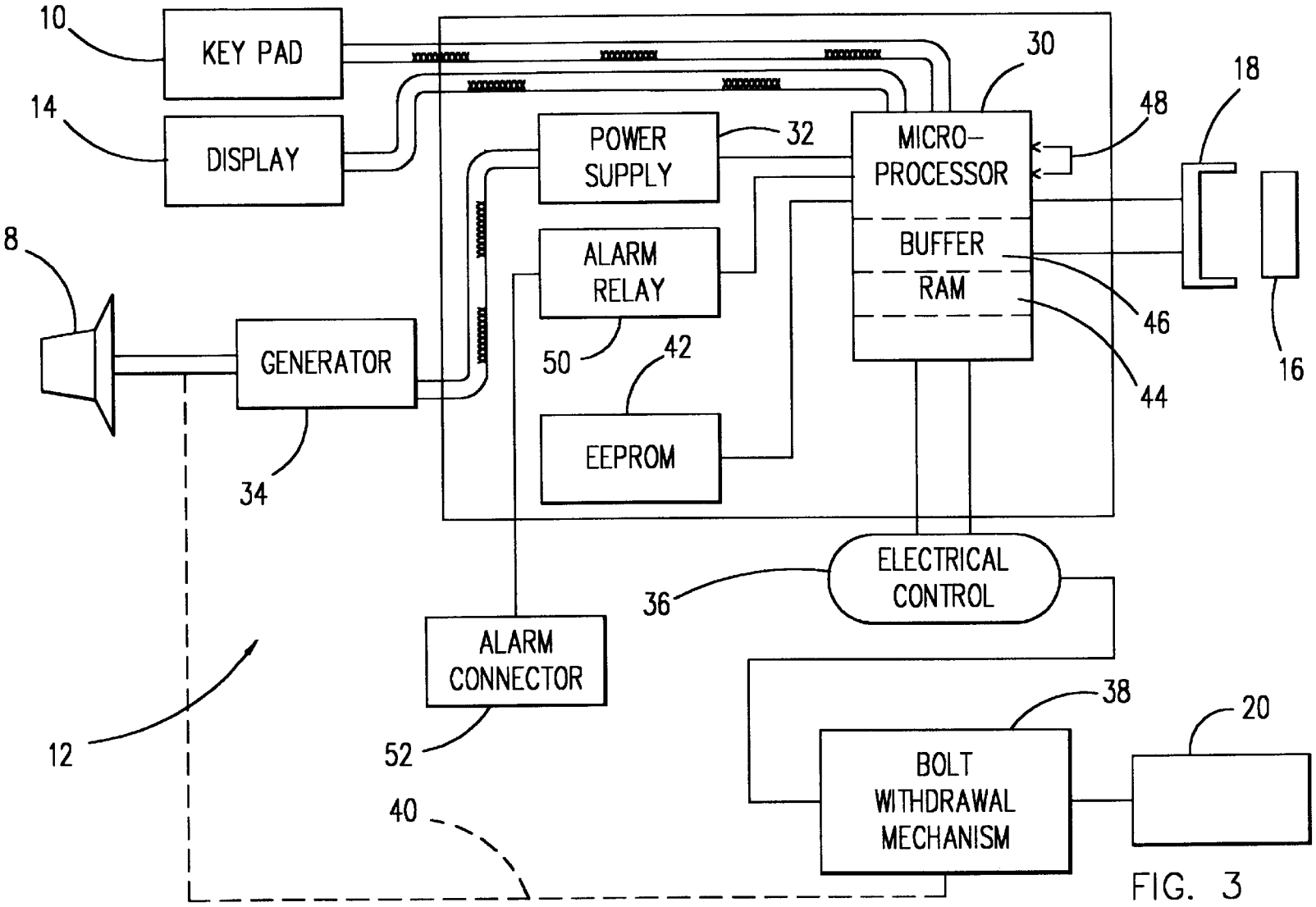
FIG. 3 is a schematic diagram of the lock of FIGS. 1 and 2.

The lock 12, illustrated in FIG. 1, is provided with a power generation apparatus 34 in FIG. 3 and a dial knob 8 attached thereto for generating power for lock operation. Manual operation of the knob or dial 8 rotates a stepper motor shaft (not shown) to generate raw alternating current voltage pulses which are electrically treated to provide the power for storage and for lock operation.

The lock 12 of the subject invention has various operational attributes which are made possible by the inclusion of an electronic key 16 in the control (not shown). The key 16 is a canister which contains a clock circuit, a battery, and a memory which may be addressed for reading and writing in order to retrieve and store data.

Whenever the lock 12 is powered with the capacitor (not shown) charged, all commands to operate the lock 12, including the necessary information for lock 12 initialization and combination entry, are provided to the lock control by depressing key buttons "0–9" on the touch keypad 10 on lock 12.

In a first embodiment, the lock 12, prior to being used, is initialized in a manner much the same as the Mas-Hamilton Group X-07 lock, whereby the lock 12 in an unlocked state is powered with the change key 48 inserted into the lock 12. The display 14 will display an EC to request entry of the factory combination; and thereafter, the display 14 will show ES to indicate that the entry of the serial number of the lock 12 is required. The display 14 then will show EC to indicate the entry of the customer number is required.

After entry of the customer number, the lock 12 will display the customer number three times for verification and then display PO to instruct the operator to pull the change key 48 out of the lock 12.

Thereafter, the display 14 will request the customer number for confirmation by displaying CC; and if entered correctly, the lock logic control will end the initialization with a display of EO for end operation on display 14. any time after initialization, the lock combination may be entered. The lock combination entry will cause the display of IPI to instruct the operator to "insert personal identifier," which is electronic key 16 into the key socket 18. Electronic key 16 is as described above.

The lock logic control reads the memory of the key 16 to determine the serial or identifier number of the key 16 which is permanently and unchangeably contained within the key memory. Thereafter if the authorized combination is correct, the display shows OPr, to indicate the lock 12 is openable by turning the dial or knob 8 to the right (clockwise).

To close the lock 12, the lock knob 8 is turned left (counterclockwise) to extend the bolt 20 and also to continue to generate power if the lock 12 has gone dead while standing open. The display 14 will show IPI for "Insert Personal Identifier" and at the time the key 16 is inserted, then will display the close seal number. The close seal number may be used to verify that the lock 12 in fact was closed and locked.

The lock 12 can be provided with dual paths of operation to permit both single or dual combination use. The keys 16 may be assigned to particular individuals and will be coded to indicate whether the key 16 is a first line maintenance (FLM) key, a route key, or a bank key. During initialization, an opportunity to select the mode of operation may be presented prior to the entry of the customer number. A display of SL, indicating "select" is displayed and a mode number then may be entered: 1 for single combination operation; 2 for dual combination mode operation; 3 for route mode operation; etc. Because both FLM personnel and route personnel may require entry to the automated teller machine (ATM), the apparatus most commonly considered for use of this type of lock, separate paths of operational control exist within the lock 12.

If initialized for dual combination operations, the operation of the lock 12 requires not only both entries of one combination and one personal identifier but must be then followed by entries of the second combination and second personal identifier before the lock 12 will be enabled to open.

The route mode of operation essentially is identical to the FLM mode except for its own unique set of data to operate and to generate the combinations. Distinctive encoding identifies each level of authorization and the other variable data.

Each authorized combination is generated in the lock 12 by mathematically combining the raw combination, the key identifier or serial number of the key 16, the personal identifier, and the lock serial number along with the seal count of the lock 12. The raw combination is determined with the use of the key 16 by a dispatch computer which uses the same factors used by the lock 12 which, accordingly, relate uniquely to that individual lock 12. The seal count is the count of the number of times that the lock 12 has been opened or the seal has been broken.

This unique authorized combination then is provided by a dispatcher to the person who will be operating the lock 12 in order to enter the enclosure which typically contains an automated teller machine (ATM).

Thus, several keys 16 may be used either individually or in pairs to access the lock 12; note, however, each key 16 will have different combinations. Always remaining in the possession of the operator, the individual key 16 provides at least three of the elements of the data required for use: a key identifier/personal identifier, a company identifier, authorized level of use, i.e., FLM, route, bank or supervisor; and the raw authorized combination for use in the bank mode, all of which are encrypted except for the key identifier.

In the bank mode of operation, the lock 12 may be opened by entry of the actual combination which is created by combining the raw combination with both a company identification number and a key identification/personal identification number. Multiple different raw combinations may be effective to open the lock 12, each usable with its own electronic key 16.

Due to the distinctive encoding of bank key authorization of the electronic key 16, the lock 12 recognizes the electronic key 16 as a bank key and uses a separate control path applicable to bank key operations through the control of the microprocessor 30 of the lock 12. For bank key operations, the actual bank combination remains fixed for the lock 12 until such time as the combination is manually changed.

Electronic keys 16 may be provided with an expiration time (specified number of hours after encoding) to prevent use except within a preset time window as in the case of bank or alternate route keys. Alternate route keys 16 cause the lock 12 to operate in an alternate route mode which is essentially the same as the bank mode except that actual combinations are fixed. Upon expiration of the key 16, the key 16 must be re-encoded in order to function further in lock 12.

The lock 12 additionally is provided with software which stores the date and time, personal identifier, and close seal number of both openings and closings in the nonvolatile memory of the lock 12 as well as in the memory of the key 16. The information stored in the key 16 audit trail memory is used to update the dispatch computer in order to keep the computer in synchronization with the lock 12.

Further, in the first embodiment of the lock, the lock casing 22 (located on the inside of the security enclosure) is provided with an RS-232 data communications port 24. This allows printout of the audit trail memory to form a hard copy which lists dates, times, personal identifiers, and close seal numbers for each opening and closing of the lock 12 to authorized personnel. The second embodiment of the lock does not have an RS-232 data communications port, but rather relies on the key socket 18 and key 16 for the collection of the audit data, as will be described below.

Figure 2:
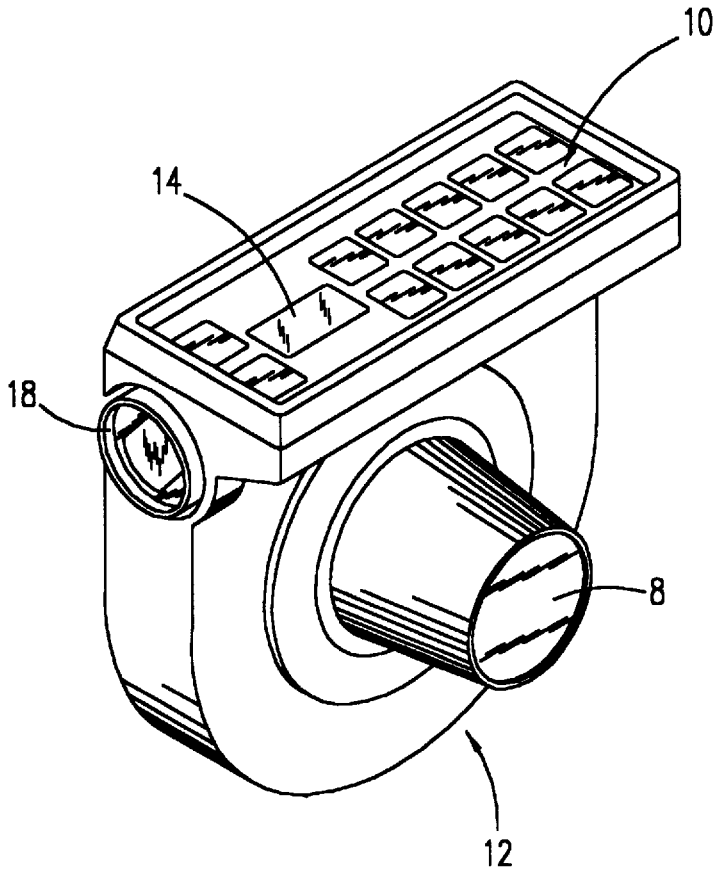
FIG. 2 is an illustration of another embodiment of the lock illustrated in FIG. 1.

FIG. 2 shows an alternative design for the front housing of the lock 12 and is preferred for the second embodiment but is, in other respects, substantially identical to the lock 12 illustrated in FIG. 1.

FIG. 3 illustrates diagrammatically the electromechanical and electronic portions of the lock 12. Keypad 10 is connected to the microprocessor 30 to input data to the lock 12. The microprocessor 30 is powered, as are other electrical components by a dial 8 driven generator 34 connected through a power supply 32. The microprocessor 30 is provided with data storage in the form of an EEPROM 42 and on board RAM memory 44.

The microprocessor 30 is further connected to an electronic key socket 18 for reading and writing data from and to key 16.

The microprocessor 30 controls the lock release through an electrical control 36 such as solenoid, stepper motor or similar device, which then enables the bolt withdrawal mechanism 38 to pull bolt 20. The dial 8 is capable of transferring manual input to the bolt withdrawal mechanism 38 as depicted by dashed line 40.

FIG. 2 shows an alternative embodiment of the lock 12 housing wherein reference numerals of like value correspond to the reference numerals in FIG. 1.

FIG. 3 is a block diagram of the lock 12 and its major functional components. Keypad 10 is electrically connected to the microprocessor 30 to provide inputs of combinations and lock commands. Microprocessor 30 includes a buffer 46 and RAM 44 and is connected to EEPROM 42. Dial 8 is manually rotatable to drive generator 34 and thereby provide electrical power to the power supply 32 which in turn provides power to the microprocessor 30. Display 14 is also connected to the microprocessor 30 to provide visual representations of some of the microprocessor 30 output.

Electronic key socket 18 is connected to the microprocessor 30 to receive and transmit data from the electronic key or Touch Memory 16.

A program to control the microprocessor of the lock system may be written by a programmer of ordinary skill in the art, taking the functions desired and incorporating them into the control program using a language compatible with the installed microprocessor. The microprocessor of the lock is preferably an Intel 8051 or equivalent, and the requirements for writing in the language necessary for the Intel 8051 are readily available from Intel Corporation, Santa Clara, Calif., and well known to programmers skilled in the art. Microprocessors of other manufacturers may be used.

So long as the other configuration requirements of a microprocessor are sufficient to satisfy the design requirements of the lock, the selection of an alternative microprocessor may be made by one skilled in the art.

A detailed discussion of the logic flow which controls the microprocessor 30 follows with references to FIGS. 4 through 22.

The overall operation of the lock 12 will be described with reference to FIGS. 4A and 4B which illustrate the main line flow of the logic control of the lock 12 from the time that the lock 12 is receiving sufficient power from the generator 34 and power supply 32 until the lock 12 has proceeded through the initialization process and the system checks. The operator is then prompted either to enter his combination or select a Special Menu choice. The keypad entries are processed by background interrupt driven routines within the lock's code.

Figure 4A:
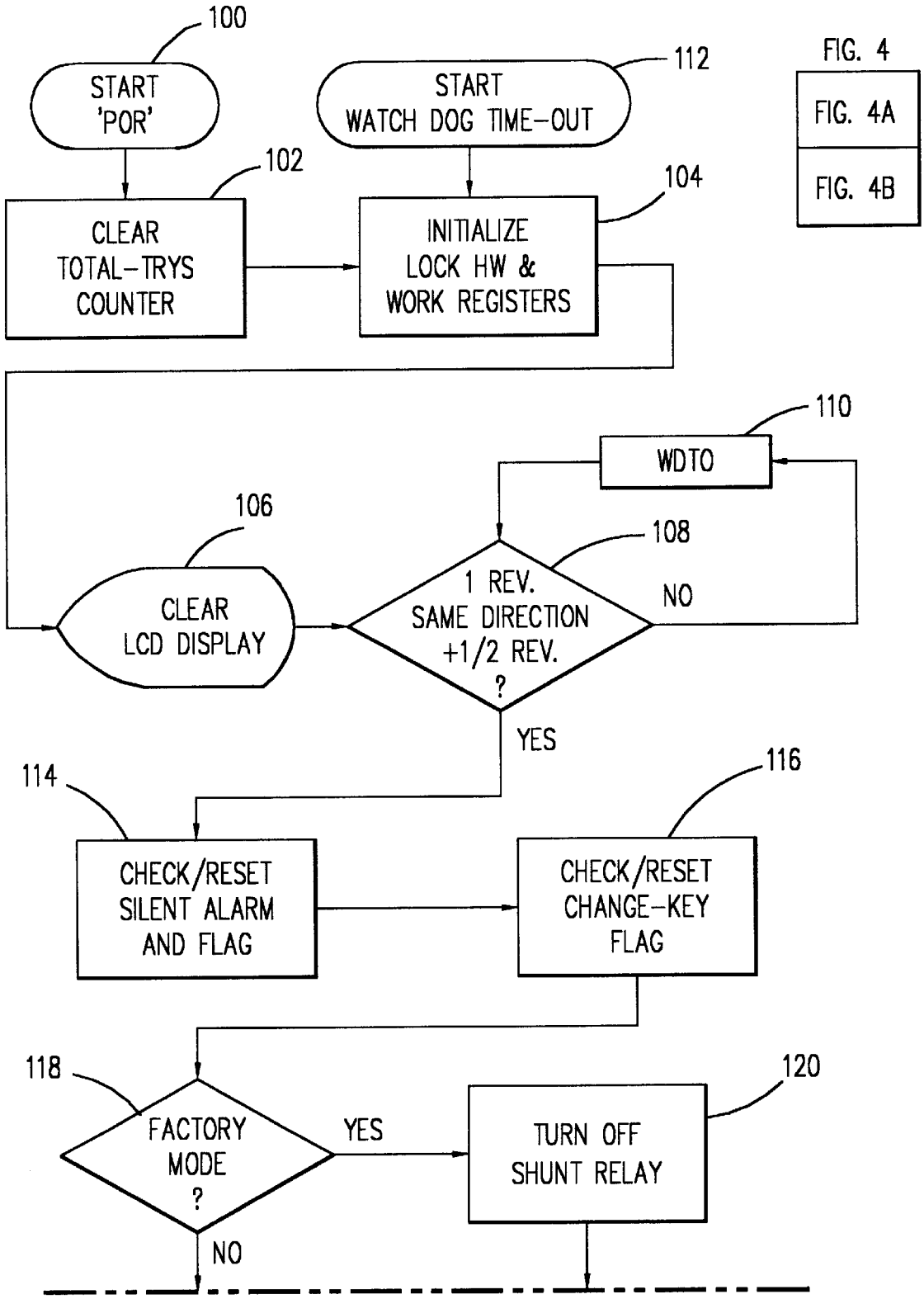
FIGS. 4A and 4B are portions of the logic control flow diagrams for the lock of FIGS. 1 and 2.
Figure 4B:
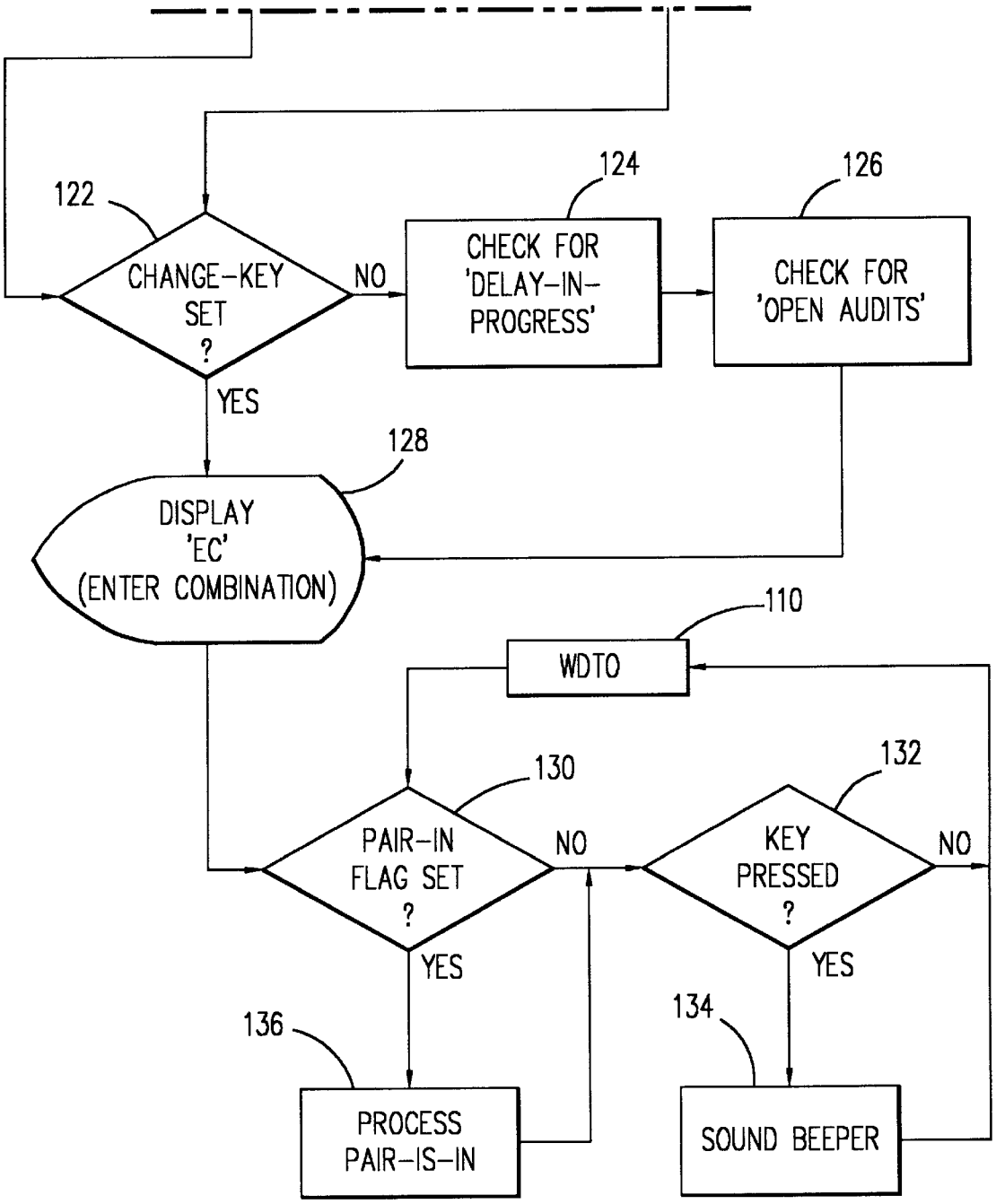

To understand the processing operations of the microprocessor 30, reference is made to FIG. 4, comprised of FIGS. 4A and 4B, illustrating the logic flow of the computer operation. Processing starts at START, operation 100, when the dial 8 of the lock 12 is rotated sufficiently to power up the lock 12, to test and set up the microprocessor 30 for operation, and the microprocessor 30 performs its standard Power On Reset (POR) sequence of operations. Thereafter, a counter designated Total-Trys Counter is cleared in operation 102 and is used to keep track within one power up session of the number of total errors in operating the lock 12 to gain entry.

Following operation 102 to clear the Total-Trys Counter, the lock hardware and working registers of the microprocessor 30 are initialized in operation 104 and the LCD display 14 of the lock 12 is cleared in operation 106. Thereafter, the microprocessor 30 will test for the condition of one revolution of the dial 8 in the same direction plus one-half revolution in either direction at operation 108. In the event that this condition is not met, the NO path will lead to a Watch Dog TimeOut (WDTO) operation. A WDTO operation 110 merely times out a period of unchanging conditions, a time delay of preferably about 40 seconds, during which time the operator has the opportunity to turn the dial 8 of the lock 12 one revolution in one direction and a one-half revolution in either direction. In the event that the dial 8 is not turned, then the WDTO will expire after 40 seconds and will cause the operation of microprocessor 30 to return to the START function at operation 112. After operation 112, the lock 12 is re-initialized at operation 104; effectively, the lock 12 restarts from its initial conditions, once again prepared to receive operator input.

Returning to operation 108, in the event that the one and one-half revolutions previously referred to is detected, then at operation 114, the silent alarm flag is checked; and if it has been set, from the previous session, the silent alarm message "ALS" is provided to the operator on the LCD 14 of the lock 12, and the silent alarm and its relay are cleared or reset. Thereafter in operation 116, the change key port is checked to see if the change key is present and the change key flag is either set or not set depending on other conditions, as discussed with respect to FIG. 5 below.

After operation 116, the lock 12 is tested to determine whether it is in Factory Mode at decision block 118; a YES determination will cause the shunt relay 50 to turn off in operation 120. In some environments the lock 12 may be installed on a vault or container that is housed within a small building or kiosk to provide it shelter from the elements. One very prominent example of such an installation occurs if the lock is installed on a vault containing an Automated Teller Machine (ATM) and the ATM is installed within a kiosk or a dedicated small room, referred to hereafter as an outer building. The outer building has a door which is locked, and the door may be provided with a device which completes a circuit or sends a signal whenever the door is open. This type of signal is a silent alarm sent to a monitoring station and alerts the watchman that the exterior door to the outer building has been opened. Many of the alarm systems of this type are provided with a device, such as a key lock or a keypad, that the user must use to disable the alarm.

Especially with respect to the ATM installations, typical field practice is to ignore the silent alarm system upon entering the outer building if the time within the outer building is expected to be short. An alarm is triggered and the watchman must wait a period of time to see if the door is promptly closed and thereby shut off the alarm.

This waiting or ignoring of the alarm creates a serious security breach and also lulls the watchman into a position to possibly ignore any signal should there be an intruder.

The shunt relay 50 or alarm relay 50 in FIG. 3 is connected to microprocessor 30 and to the alarm connector 52. Alarm connector 52 is a conventional connector to which the alarm circuit of the monitoring station may be connected. The microprocessor 30 controls the shunt relay 50 in response to the entry of a valid combination and effectively disconnects the portion of the alarm circuit connected to the door. Thus the shunt relay 50 will replace the override devices presently installed and eliminate the need for a user to disable the silent alarm upon entry. This eliminates false alarms because the silent alarm is shunted or shut off upon the entry of a valid combination and the insertion of a valid key 16, thereby opening the lock 12 and turning on the shunt relay 50.

When the user finishes and locks the lock 12, the shunt relay 50 will be turned off and the alarm will sound at the monitoring station until the door to the outer building is closed. Thus any extended silent alarm will alert the watchman that an intruder has entered the outer building but has not been able to enter the vault; and the watchman then may assume the intruder is not an authorized user and then may contact the law enforcement authorities with a request for site investigation.

Figure 23:
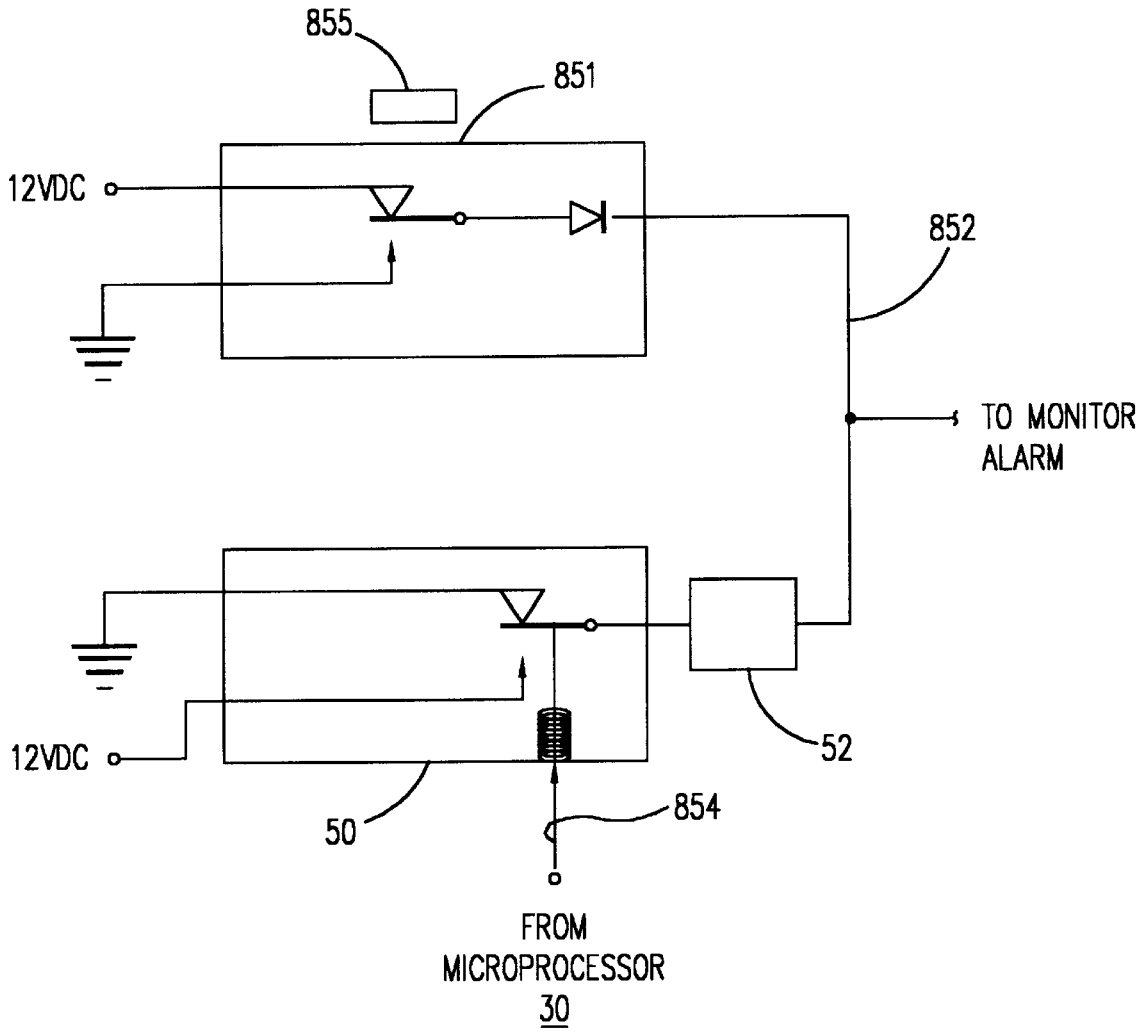
FIG. 23 illustrates a circuit for implementing the use of the shunt relay of the electronic combination lock.

Reference is now made to FIG. 23. The circuit illustrated comprises a balanced magnetic switch 851. Only a magnet 855, such as mounted on the access door of an enclosure, of a proper magnetic strength will activate and transfer the switch to ground conductor 852 and indicate the opening of the access door. Only a balanced and properly sized magnetic field will affect the switch to return to the condition where the 12 volt potential is connected to conductor 852. Closure of the door will magnetically switch the switch 851 to the 12 volt security signal and thus indicate closure to the monitor.

The lock of the present invention includes a computer output signal controlled relay 50 that acts to provide a signal to the monitor indicating that the combination lock has been opened. The opening of the lock 12 on the ATM, through activation of the shunt relay, shunts the monitoring 12 volt signal around the grounded door switch 851 when the microprocessor 30 has determined an authorized combination has been entered and the lock 12 conditioned for opening. The microprocessor 30 then outputs a signal to the shunt relay 50 to switch the relay to conduct the 12 volt security signal to the monitor, a signal that either replaces the secure signal of door switch 851 or resets the monitor alarm. If the lock 12 and the microprocessor 30 controlling the lock 12 are in an unlocked state, the signal on conductor 854 to the shunt relay 50 will cause the relay 50 to switch to a condition conducting the 12 volt signal supplied to it through the alarm connector or alarm port 52, which is in turn connected to the alarm circuit.

The locking of lock 12 and conditioning microprocessor 30 will cause the microprocessor to signal the shunt relay 50 to open and reconnect to ground returning the control of the monitor signal to the door switch or alarm actuator 850.

When the door is opened and the door switch 850 is opened, the alarm at the monitor is activated. The person opening the door will then attempt to open the ATM. A skilled service man or armored car attendant can open the ATM lock 12 in 15–20 seconds. If the person entering the structure is a person with a legitimate purpose and authorized to enter, the ATM lock will be opened shortly after the outer door is opened triggering the alarm at the monitor station. When the lock 12 is unlocked and the ATM opened the opening of the lock 12 will cause the shunt relay 50 to be picked and closed to complete the shunt path of the security signal around the open door switch 851. The closing of the shunt relay 50 will close the shunt circuit and effectively terminate the alarm at the monitor and the second sounding of the alarm upon locking of the lock and the terminating of the second alarm with the closing of the structure door will signal the beginning and end of a service call by an authorized service or route person. Thus, the short alarm created by the opening and again at the closing of the service call tells the operator at the monitor that the person who opened the outer structure door was an authorized person because they possessed the necessary combination for the ATM lock 12 and that when the service call was completed the ATM lock 12 was relocked and the outer structure door was also closed. The system is not subject to the shortcuts or circumventions of the service personnel that do not want to be bothered with the inconvenience of having to disarm the alarm circuit.

It should be recognized that this feature could be incorporated into a lock that was not of the electronic type by providing the bolt of the lock with a small magnet located in a strategic location such that it could pass over a normally open reed switch and cause the reed switch to close when the bolt was withdrawn to open the lock and the container. Thus the opening of a mechanical combination lock will deactivate the alarm as the electrically controlled relay is controlled to accomplish the same result.

An example of a lock using a bolt retraction detection circuit is disclosed in U.S. Pat. No. 5,410,301, issued to Gerald L. Dawson et al., and commonly assigned with this application. The Dawson et al. patent describes a lock incorporated into a central monitoring system with an alarm signal being generated upon the withdrawal of the bolt lock to indicate to the monitor that the lock is unlocked and is effective to monitor the locked/unlocked status of the lock itself.

After operation 120, the flow routes to decision block 122 to determine whether the change key flag is set or not set.

Returning to the decision block 118, in the event that the Factory Mode is not the mode in which the lock 12 is operating, the logic path will lead directly to the Change Key Set decision block 122, described immediately above, while bypassing the clearing of the shunt relay 50 in operation 120. In operation 122, if the change key flag is not set, then there is a check for a "Delay-In-Progress" in operation 124. This operation will be more completely described with respect to the flow diagram in FIGS. 12A and 12B at a later time.

On the completion of the check for "Delay-In-Progress" in operation 124, a check for Open Audit Records occurs in operation 126, which similarly will be described with regard to the subroutine illustrated and described below with reference to FIGS. 8A and 8B.

After the completion of the check for open audit records in operation 126, the flow will continue to operation 128 where the user is prompted by the display of the letters "EC" to prompt the operator to enter his lock combination. Similarly, if the change key flag is set, then the flow through the "YES" branch from block 122 will be to operation 128 where the operator prompt "EC" as described above is displayed. Thereafter, the flow enters a loop including operations 130 and 132.

This flow will pass through operation 132 where the first operation is to determine whether any key button on the keypad 10 of the lock 12 has been pressed. If there has been no key button pressed, then the "NO" path will direct the flow back through WDTO operation 110 and the flow again will pass through operation 130; and again, the determination in 132 will be accomplished. This looping will continue with the WDTO continuing its operation until either the WDTO period of preferably 40 seconds is elapsed or a key button is pressed on the keypad 10. Upon the detection of the key button press, then the flow will branch through the "YES" path to operation 134 where a beeper is sounded to indicate the entry of a key button and the subsequent acceptance of the key button input by the lock 12. Thereafter the flow then will loop back to operation 130 where it will be determined whether a "Pair-In" flag has been set. Since the first key button will not accomplish the setting of the "Pair-In" flag, then the operation will continue to loop through the "NO" path back to operation 132 awaiting the next key button entry. Whenever the next key button entry occurs and assuming that it occurs prior to the expiration of the WDTO in operation 110, then a beeper will sound, again in operation 134; and at that point, the flow will return to operation 130 to recheck the "Pair-In" flag set determination.

Upon the depression of any key, the WDTO period is reset to effectively restart the 40 second timeout. A signal from the keyboard interrupt routine indicates a key button has been pressed and sets a flag to be tested by the main loop referenced above; and in so doing, upon the second key button being pressed, a "Pair-In" flag is set. Accordingly, after the second depression of a key button and the second affirmative determination in block 132, having been set, the "Pair-In" flag will be detected in operation 130 and the flow will branch from the previously described loop to operation 136, to be further described in detail with regard to FIG. 7 below.

Figure 5:
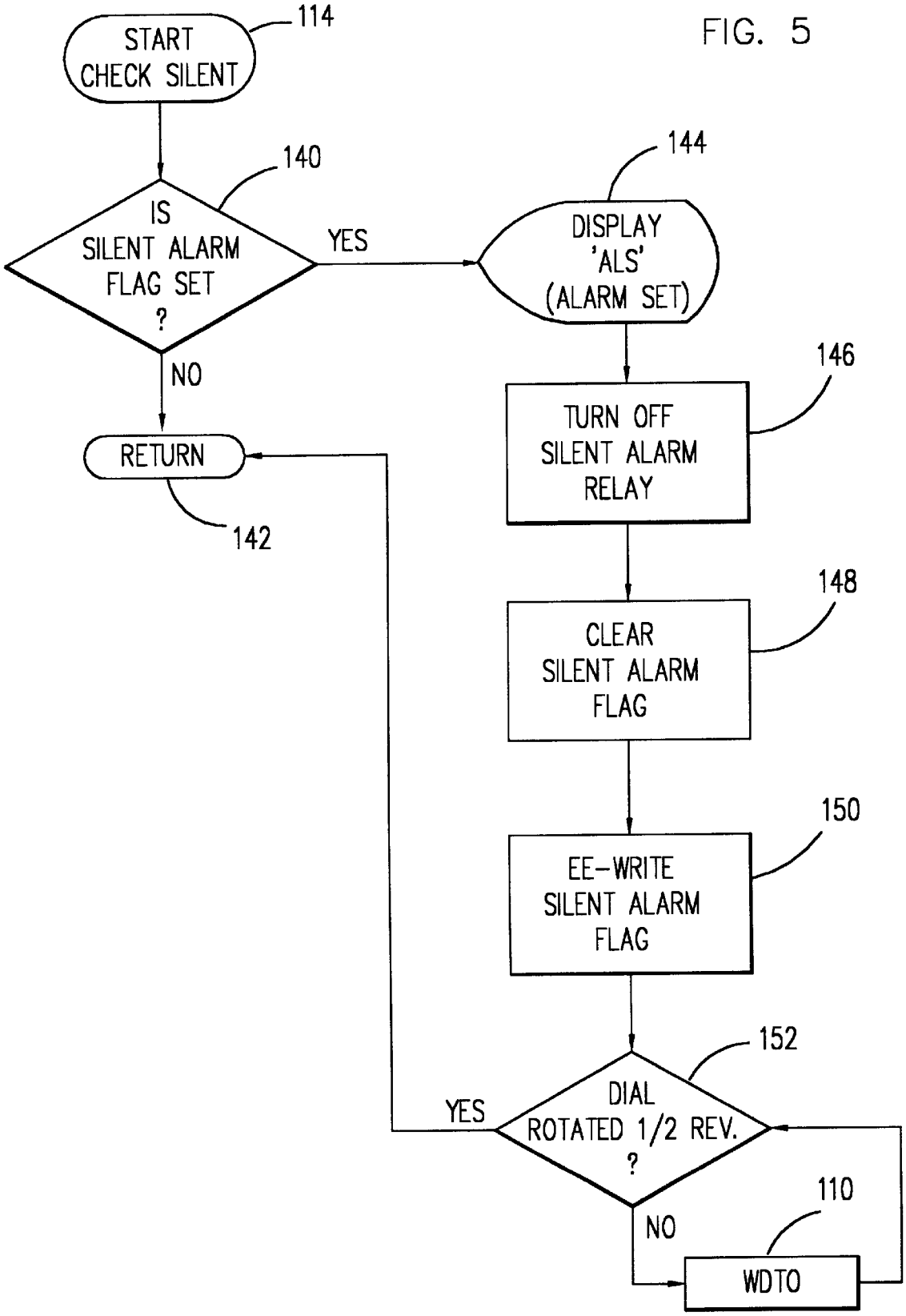
FIGS. 5, 6, 7, 8A, 8B, are logic flow diagrams for portions of the logic and control operations in FIGS. 4A and 4B.

The lock may be advantageously provided with a system to send a silent alarm to a central monitoring post whenever the operator opens the lock using a secret duress combination. The lock 12 will indicate to the next user that the silent duress alarm was sent in the prior session and that condition needs to be reset once the lock is opened with a valid combination so as to not send a false silent alarm. This operation is provided by the logic described with the detailed logic flow diagram of FIG. 5. If the silent alarm flag is not set, then the remaining flow of FIG. 5 is bypassed. respect to operation 114 in FIG. 4*a,* reference is now made to FIG. 5 where the subroutine of operation 114 is represented. Entry is indicated at "Check Silent Alarm" in operation 114 wherein the flow then is directed to operation 140 and additionally the Silent Alarm flag is checked to determine if set. In the event that the Silent Alarm Flag is not set indicating that no silent alarm condition occurred in the previous session of operation of the lock, the flow is to the return at 142, and subsequent return to 114, and then flow to operation 116 in FIG. 4A. In FIG. 5 should the Silent Alarm Flag have been set and detected as such in operation 140, the flow through the affirmative path will cause a display of "ALS" indicating that the silent alarm has been activated; the operator may observe that condition and be aware that the silent alarm had occurred or was tripped in the prior operating session. This operation to display "ALS" is operation 144. Thereafter the Silent Alarm relay is turned off in operation 146 and the Silent Alarm Flag is cleared in operation 148. Thereafter the Silent Alarm Flag Cleared condition then is stored in the EEPROM memory 42 which is nonvolatile and retains its stored contents from operating session to operating session without regard to the amount of time between sessions.

After the storage of the cleared Silent Alarm Flag in operation 150, then the operator is given the opportunity to cancel the display 14 by rotating the dial 8 at least one-half revolution in either direction. If such a dial rotation does not occur, then the WDTO of operation 110 is initiated and either the dial 8 is rotated at least one-half revolution thereafter, causing the flow to pass through the "YES" path to return 142, or the WDTO will expire and then cause the lock program to restart at operation 112 in FIG. 4A.

In order to initialize the various modes of the lock 12, add and delete users and shelve one or more modes of the lock 12, it is necessary both to condition the lock and detect that conditioning by testing for the change key 48 whenever resident in the lock. The detection of the change key and the control of the lock. If the change key 48 is left in the lock 12 and the container closed and locked the lock 12 detects the change key's presence and allows the lock to be reopened to retrieve the change key 48. This capability is described with reference to FIG. 6.

Figure 6:
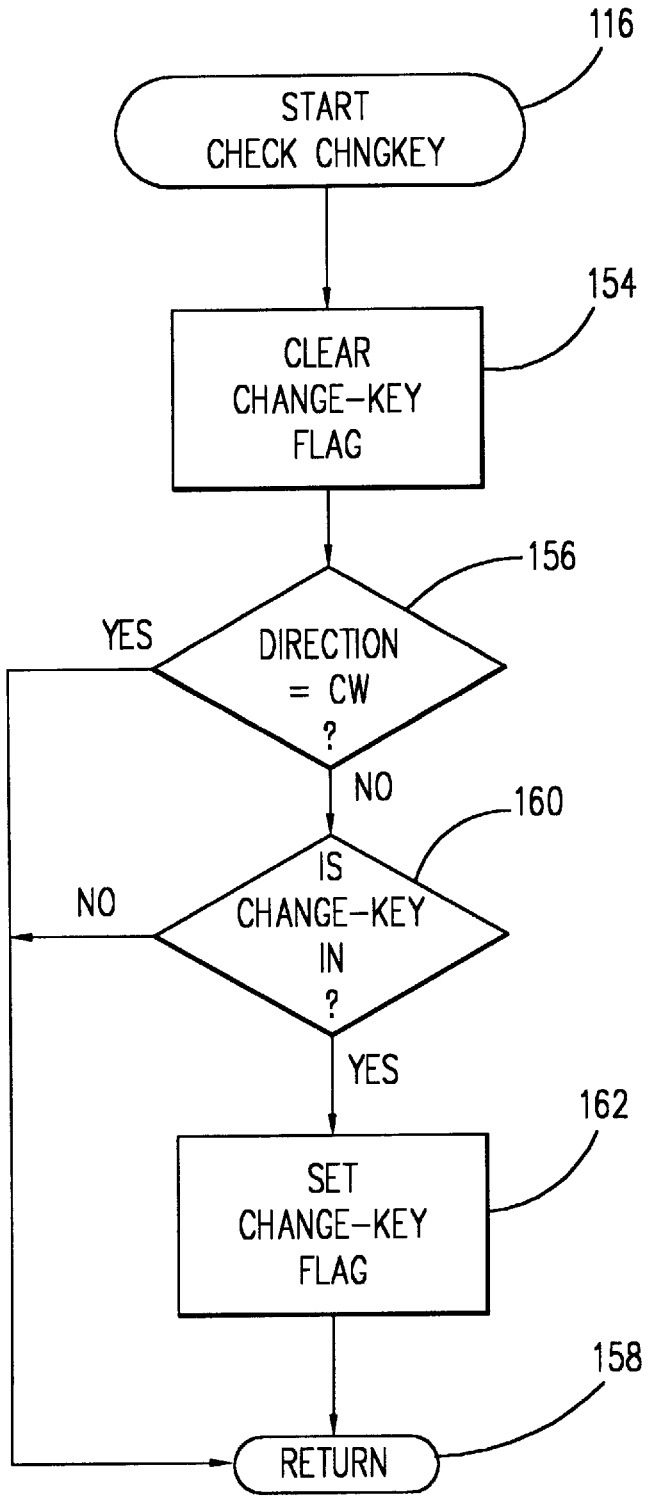

Referring now to FIG. 6, the operation of "Check Change Key" in operation 116 of FIG. 4A is illustrated. Entering at the start, of operation 116, for the "Check Change Key" status, the flow then will be to clear the Change Key Flag in operation 154. Thereafter if the direction of the most recent rotation of the dial 8 is determined to be clockwise in operation 156, the flow through the affirmative path is to return to operation 158. However, if the direction of the dial 8 is counter-clockwise, as determined in operation 156, this permits the presence of the change key 48 in the lock 12 to be ignored as might be required in any condition in which an operator has inadvertently or erroneously locked the lock 12 with the change key 48 inserted; therefore, the change key 48 is resident within the closed and locked container. In the event that this condition exists, the operator should turn the dial 8 in a clockwise direction both to permit bypassing the effect of the change key 48 as installed in the lock 12 and to permit the lock 12 to be opened normally in order to retrieve the change key 48.

Should the direction of the dial 8 be determined counterclockwise, then the flow path is directed to operation 160 where a determination is made whether the change key 48 is installed in the lock 12. In the event that the change key 48 is not installed, the flow is to return 158. Once the change Key 48 is detected as installed, then the flow is to operation 162 where a Change Key Flag is set indicating that a change key operation is in progress and thereafter the flow is to return 158. Return 158 directs the logic flow back to operation 116 in FIG. 4A.

Whenever combinations or special menu selections are entered through the keypad 10, the lock 12 must be able to distinguish between the various types of entries and the significance of the data entered at specific digit locations. The distinguishing functions are illustrated in FIG. 7.

Figure 7:
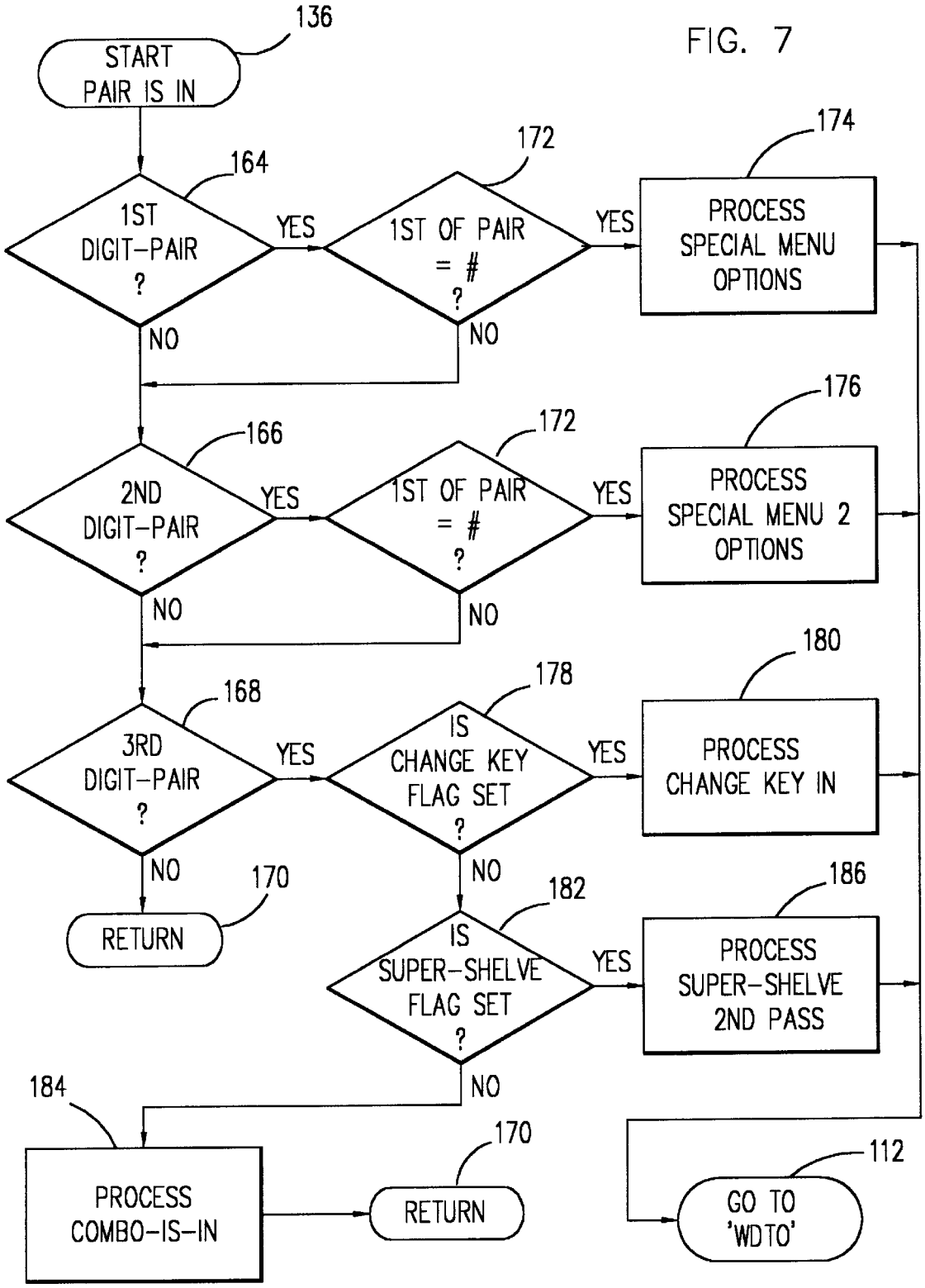

Referring now to FIG. 7, operation 136 in FIG. 4B is illustrated in more detailed form. The "Pair Is In" subroutine is started with entry at 136 and the flow is directed to the determination at operation 164 as to whether the two digits that have been entered into the lock 12 are the first two digits, the first digit pair, entered into the keyboard 10. If it is determined in operation 164 that they are not the first digit pair entered, then the flow will be to operation 166 whereby a similar determination regards whether the data entered is the second digit pair. Similarly if the answer to that interrogatory in operation 166 is negative, then a determination in block 168 is made if it is a third digit pair; and in the event that similarly is answered in the negative, then the flow will be to return 170, which will cause the flow to revert back to operation 136 in FIG. 4B. In the event that the determination in operation 164 is made in the affirmative, then a check is made at operation 172 as to whether the first of the digits is a pound (#) sign. In the event that it is not, then the flow will revert back to operation 166.

However, in the event that the determination is made that the first character is a pound (#) sign and not a number, the flow will be to operation 174 which represents special menu options to be discussed in more detail below.

A similar operation 172 is found in the affirmative flow emanating from decision block 166 where the flow is to operation 176 whereby the entry into operation 176 will require two sequential pairs of data entry, both of which will have the # sign as the first digit and a numeral as the second of each of the pairs. Upon this condition being satisfied, then the Special Menu 2 Options are accessed and the microprocessor 30 will proceed to display for purposes of maintenance and repair, the last fifteen error codes identifying operational errors of the lock 12. Thereafter, the flow emanating from the operation in block 176 will be to the WDTO 112 which then will cause the operation to return to operation 112 in FIG. 4A and to restart the lock operation.

Figure 22:
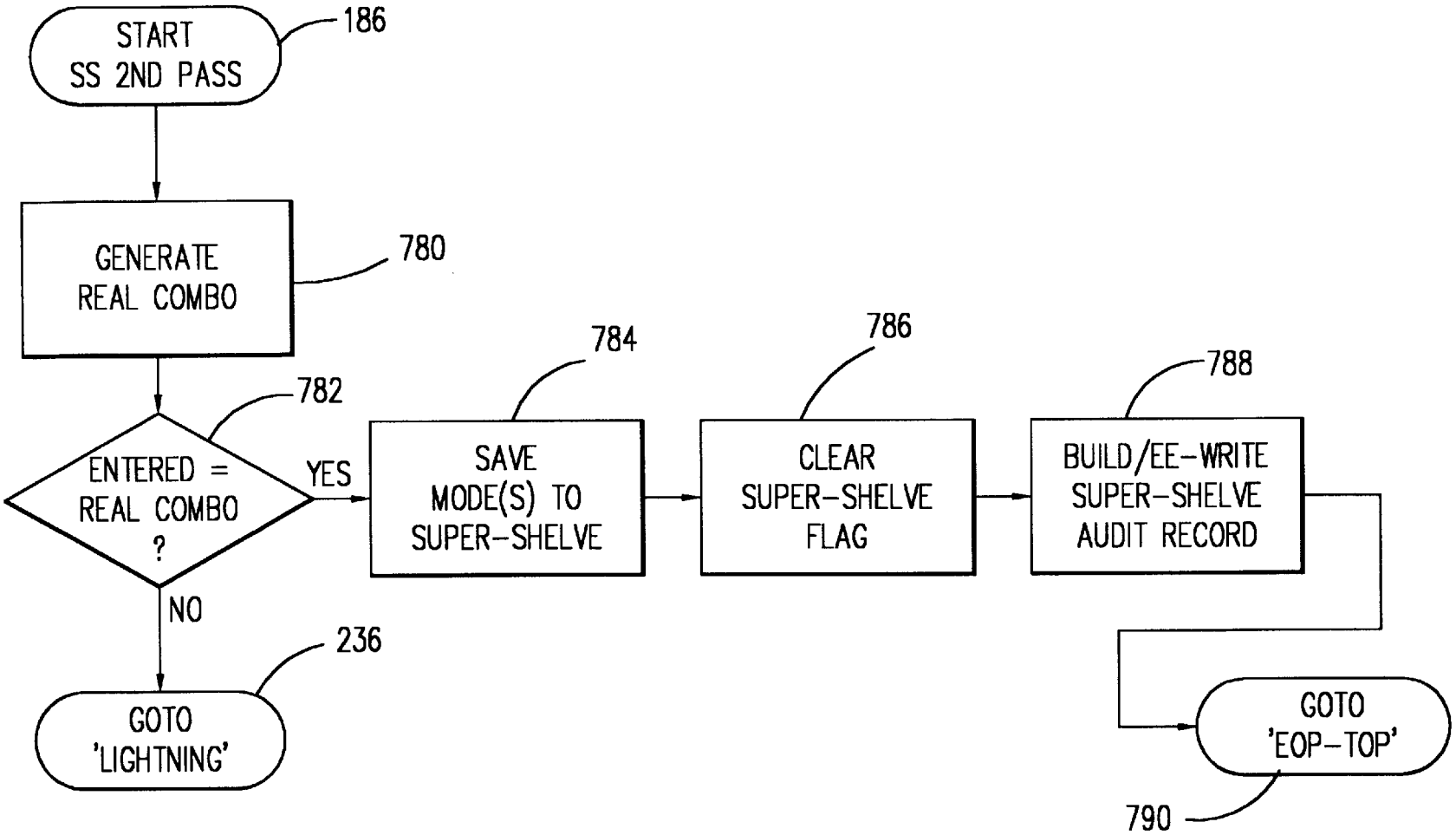
FIG. 22 illustrates operation 186 of FIG. 7.

If the flow is through the negative path from either block 166 or 172, then the determination is made as earlier discussed in operation 168. Should the determination be made in operation 168 in the affirmative that the data pair or digit pair being considered is the third digit pair entered, then the determination is made at operation 178 as to whether the Change Key Flag is set. Should it be in the affirmative, then the change key operation is processed in operation 180 and the flow subsequently goes to the WDTO, operation 112. If the determination made in operation 178 is negative, then the further determination is made as to whether the Super-Shelve flag is set in operation 182. If the Super-Shelve flag is not set, the flow will proceed in operation 184 to the processing of the combination that has been entered and thereafter return to 170. In the event that the Super-Shelve Flag is set, then the flow is to operation 186 and thus accomplish the processing of the super-shelve second pass as illustrated in FIG. 22, described and discussed below.

Each time a lock 12 is opened, an open audit record is stored both in the lock 12 and the electronic key 16. Each time the lock 12 is closed and if the same electronic key 16 is used in closing, the open audit record is converted into an open/close audit record. If the lock 12 is closed and the close seal number is not collected into the electronic key 16 for the open/close audit record, it is necessary to collect the close seal number prior to operating the lock 12 again. The logic flow diagram in FIGS. 8A and 8B is used to describe the operation of this aspect of the lock 12.

Figures 8, 8A, 8B:
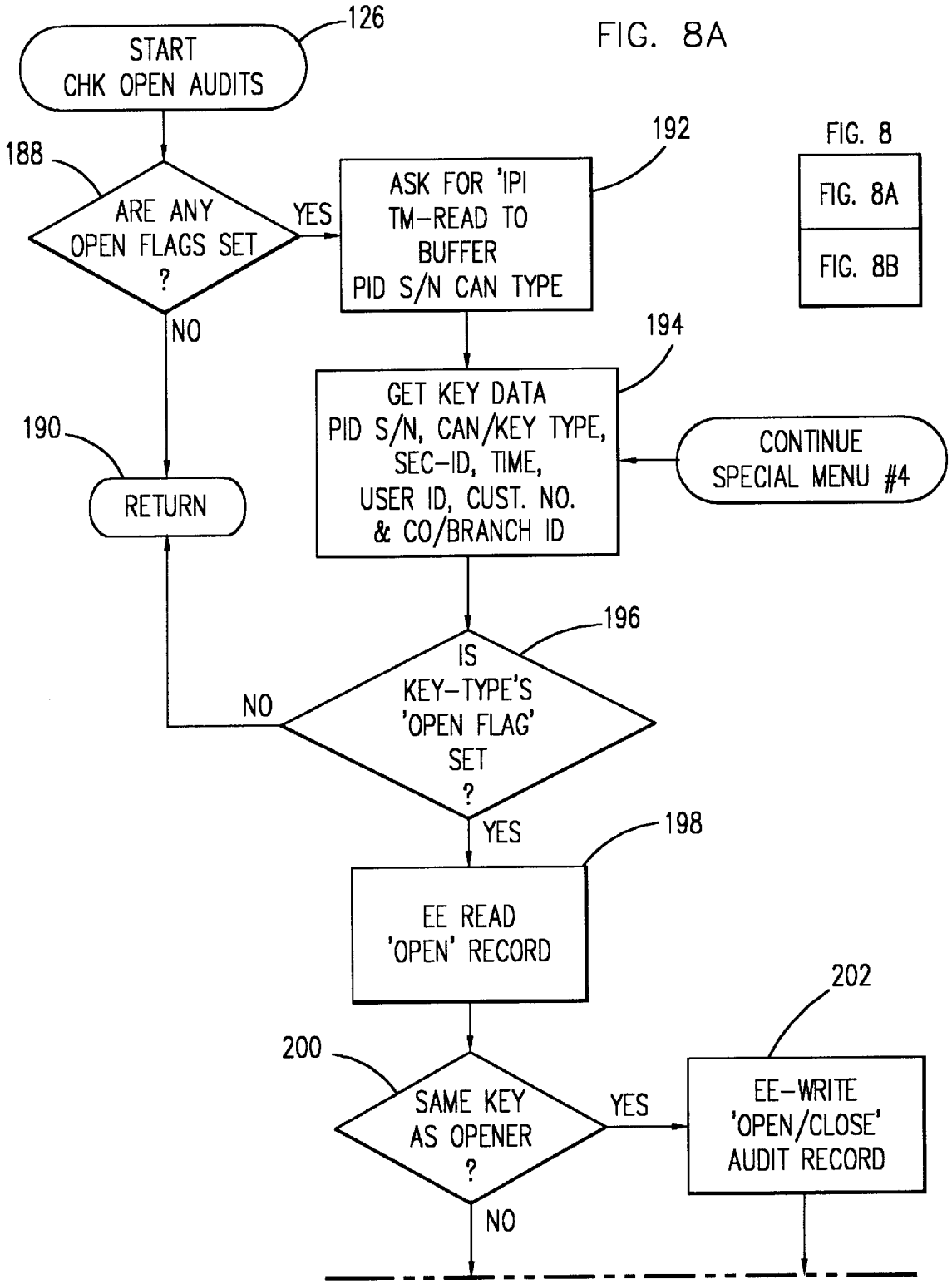
Figure 8B:
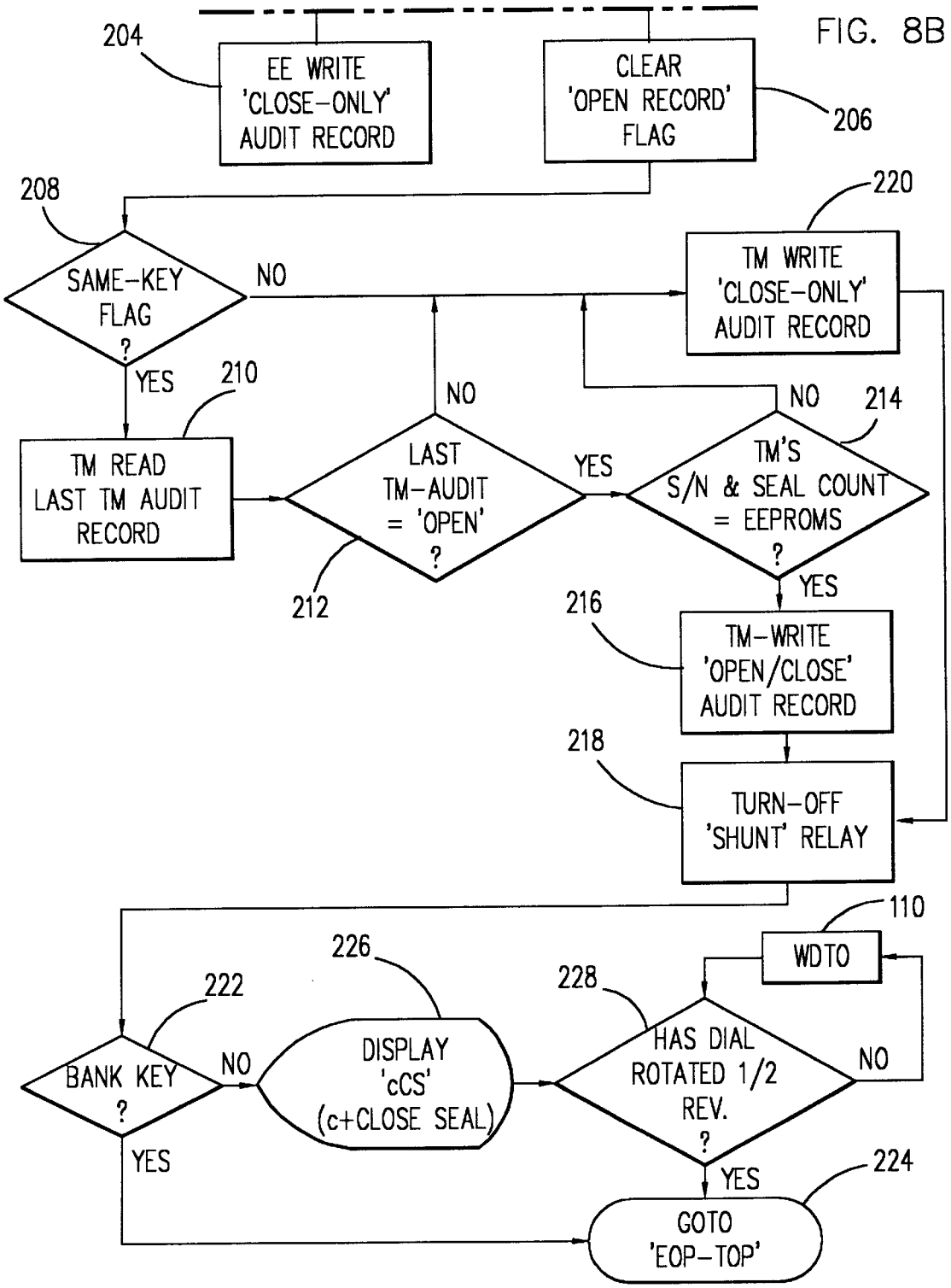

Referring now to FIG. 8A and 8B, the logical flow illustrated therein represents operation 126 check for Open Audit Records in FIG. 4B.

Upon entry into the routine at operation 126, a determination is made if any open flags are set at operation 188 with a negative determination resulting in a return at operation 190 to operation 126 operation 190. Should the existence of any open audit flags be determined in operation 188, the affirmative path is followed to operation 192 wherein the operator is prompted by the display of "IP1" on the lock's display 14 to place his electronic key 16 into the socket 18 to effect the insertion of the personal identifier into the lock 12. The Touch Memory manufactured by Dallas Semiconductor of Dallas, Texas, is one such type of electronic key; nevertheless, it should be understood that other types of memory storage can be utilized including proximity detectable identifier cards/badges or magnetic readable cards, which may be read either through a "swipe type" reader or by other conventional magnetic card apparatus. Although understanding that the alternative memory systems could be used, the discussion with regard to this electronic lock will focus primarily on the Touch Memory type produced by Dallas Semi-conductor. In any event, the data contained in any of the other alternative non-volatile memory devices would be the same.

One advantage found in the Touch Memory of the Dallas Semi-conductor type is the little can or key which contains a serial number unique to that particular device which cannot be erased, altered, or changed in any way, thereby permanently and reliably identifying that specific identification device.

Thereafter in operation 194 the personal identifier's serial number, the can/key type, security ID, the time, the user ID, customer number, and company or branch ID are read from the key 16 to the lock's memory in order to secure data necessary to operate the lock 12.

It should be noted at this point that entry into this routine at operation 194 may be accomplished from special menu #4, as will be discussed later.

In operation 196 the key data is searched and checked to determine whether an open flag is set for that particular electronic key 16 type. In the event that the determination is in the negative, then the flow is to return to operation 190. Should the determination be in the affirmative in operation 196, the matching open record then is read from the EEPROM 42 in operation 198. The determination then is made at operation 200 if this is the same key 16 as that identified in the flagged open record. In the event that the keys 16 are the same, indicating the same operator is re-accessing the lock 12 to access the Close Seal, the flow then is to operation 202; the previous open record will be converted into an Open/Close Record and stored back into the EEPROM 42.

At operation 200, should the present key 16 be determined not to be the same as the opener, then it must be another individual attempting to access the lock 12, and the EEPROM 42 then will be written with a "Close Only" audit record so that the previous transaction will be closed. Moreover, it is indicated that it is being closed by a user of a different identity than the one who opened the lock 12 and created the open record. After operations 204, where the Close Only Audit Record is written, or operation 202 where the open audit is converted to an Open/Close Audit Record, the flow is to the operation 206 where the Open Record Flag is cleared as illustrated in FIG. 8B.

The preceding steps in this subroutine effectively clear up and change the flags and audit records in the EEPROM 42 to reflect the identities of the keys 16 being used to close the lock 12 and the flow proceeds to operation 208 which begins accomplishing the same general operations with respect to the information written into and stored in the user's Touch Memory key 16. In operation 208 the same key flag is tested; and if it is set, then the flow indicating that the same key 16 is used to access the last Touch Memory audit memory in the key 16 in operation 210 and determine in operation 212 if the last Touch Memory audit record is an open record. Should it be, then operation 214 determines whether the serial number and the Seal Count in the Last Touch Memory Open Audit Record are equal to those values stored in Last Open Audit Record of the EEPROM 42 of the lock 12. If those values are equal to their stored counterparts in the lock memory as determined in operation 214, the affirmative path is followed and the touch memory 16 then is rewritten to create an Open/Close Audit record in operation 216. Thereafter the Shunt Relay 50, also referred to as the Alarm Relay 50, is turned off in 218, indicating the retraction of the lock's bolt 20 to be used in conjunction with customer supplied sensors and logic for additional alarm capability.

Returning to operations 212 and 214, in the event that a determination made in one of these operations is made that either the audit record is not open or the Touch Memory Serial Number and Seal Count do not equal the corresponding values in the lock EEPROM, then the negative path is followed to cause the writing of a Close Only audit record in operation 220, which then would indicate that the Lock Audit Record has been closed by a key 16 which was not the opener or did not have identically the same information therein as was stored in the lock memory. Similarly, should the determination of the same key flag in operation 208 result in a negative determination, that flow is directed then to operation 220 for the same purpose.

After the Shunt Relay 50 is turned off in operation 218, the next operation is to determine whether the key 16 is a Bank Key in operation 222. In the event that the key 16 is in fact a Bank Key, the affirmative path is followed to operation 224 where the flow is directed to go to the "EOP-TOP" or End Operation-Top Of the Program and will re-enter at operation 112.

In the event that the key 16 is determined not to be a Bank Key in operation 222, the negative flow path will then go to the display operation where the symbol "c" plus the Close Seal, a two digit number, are displayed with the "c" preceding the two digit number to indicate that the number is a Close Seal Value. The previous operating session is completely closed.

Thereafter, the flow is to operation 228 where the operator may enter a dial 8 rotation of at least one-half revolution after noting the Close Seal value to continue the operation. In the event that dial 8 is not rotated by at least one-half revolution, the flow reverts through the negative path to the WDTO operation 110 which will eventually cause a return to the top of the program and re-enter at operation 112 on expiration of the timeout period. If the half revolution is observed and determined to have occurred in operation 228, then the flow goes to operation 224.

Operation 184 in FIG. 7, the "Combo Is In" routine is the portion of the program that controls the acceptance of the combination entered through the keypad 10 of lock 12. The routine functions after the six digits of a combination have been entered. The electronic controls of the lock 12 are operated to detect whether the lock 12 is in factory mode, single operator mode, dual operator mode, or bank mode; and if in bank mode, whether a delay in opening is operative. If the lock 12 is operating in a dual mode, either of the operators may enter his/her combination and key 16 first, but both required combinations and keys must be entered to ultimately open the lock 12.

Anytime lock 12 is operating in the bank mode and in delayed opening mode, the lock 12 must be opened subsequent to a preset delay and during a preset window period following the delay period. The delay period starts with the correct entry of the combination and key 16 or combinations and keys 16, if in dual mode.

Figure 9A:
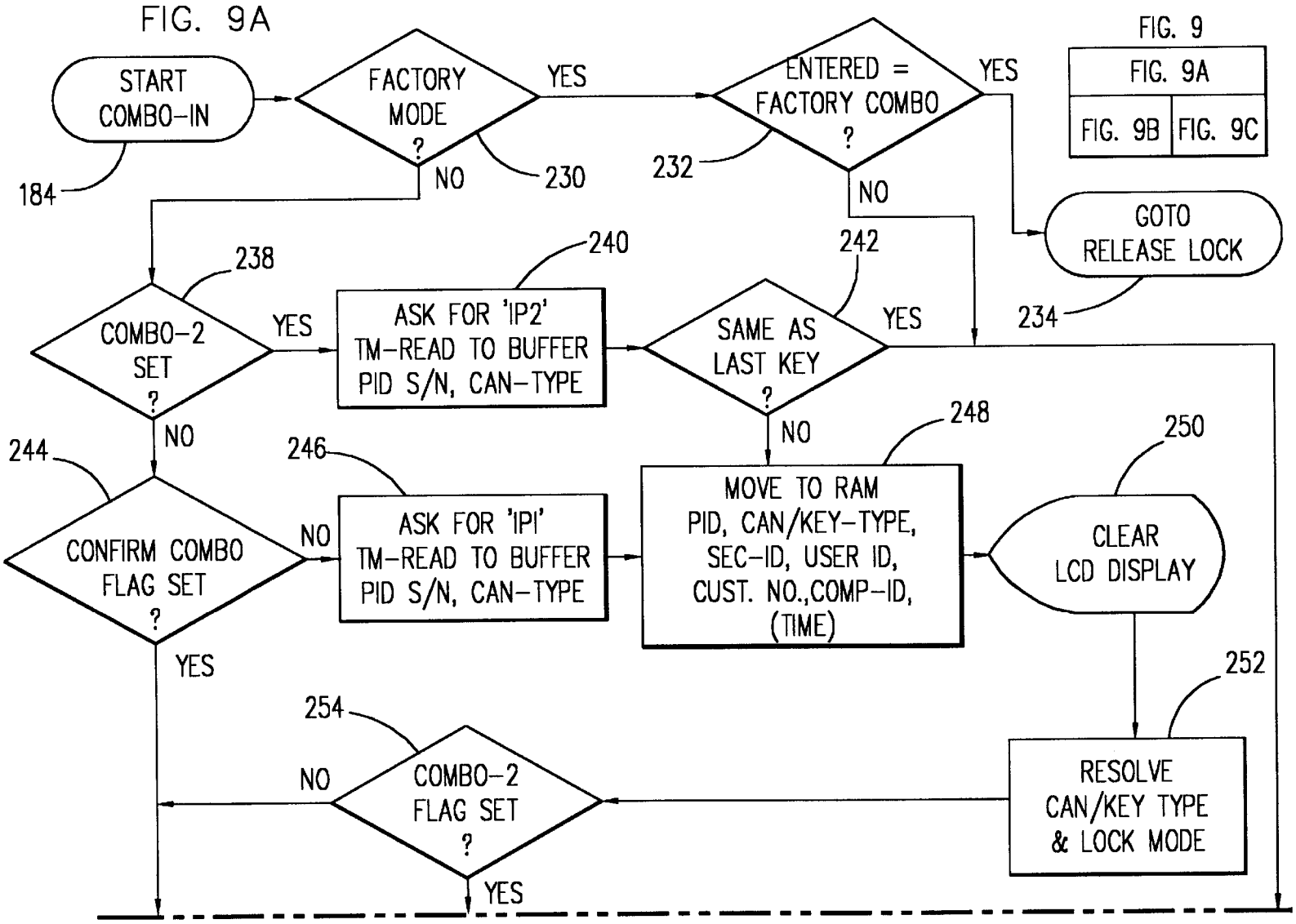
FIGS. 9A, 9B and 9C are logic flow diagrams which illustrate how the keypad inputs are processed by the lock.
Figure 9B:
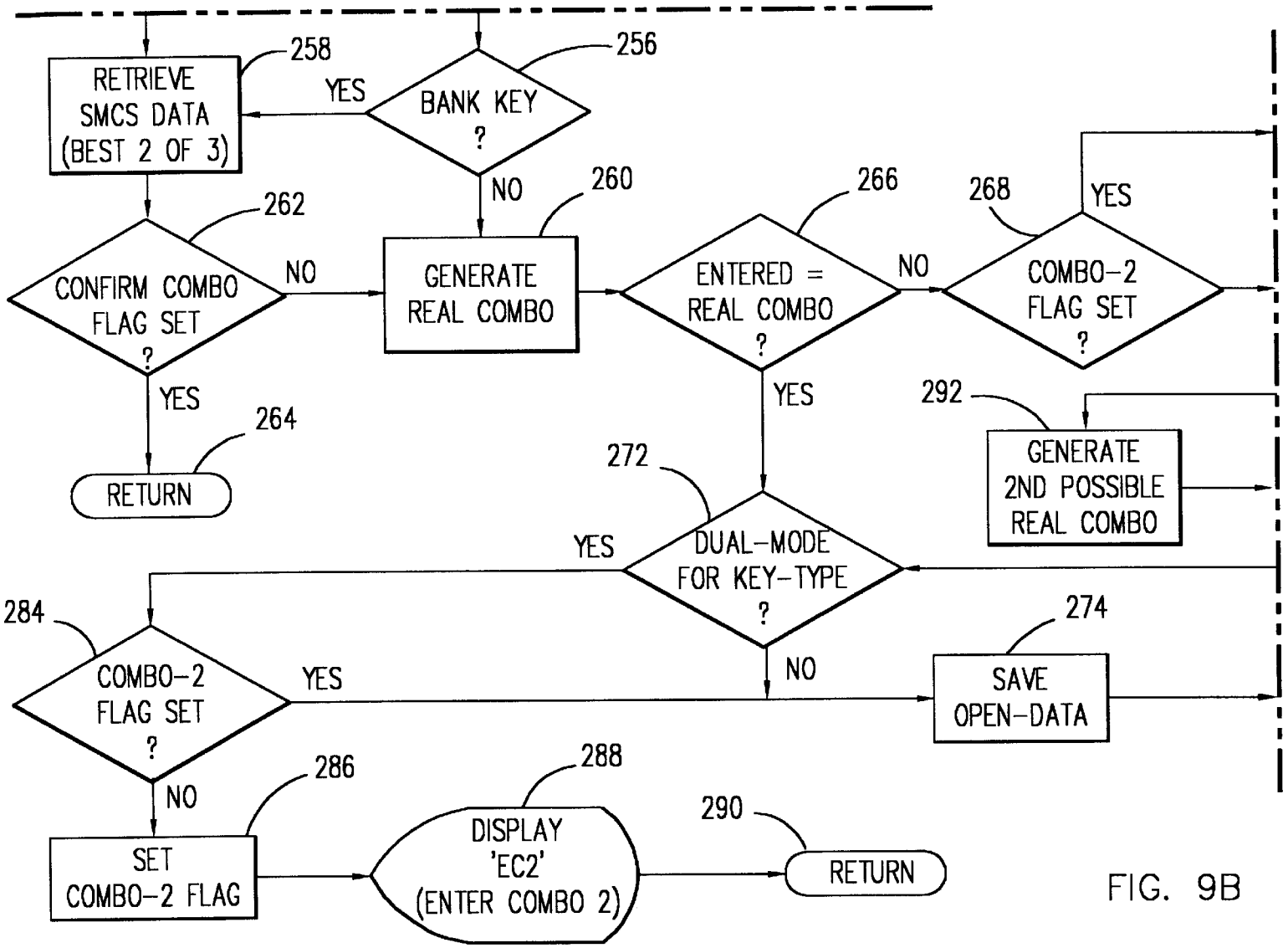
Figure 9C:
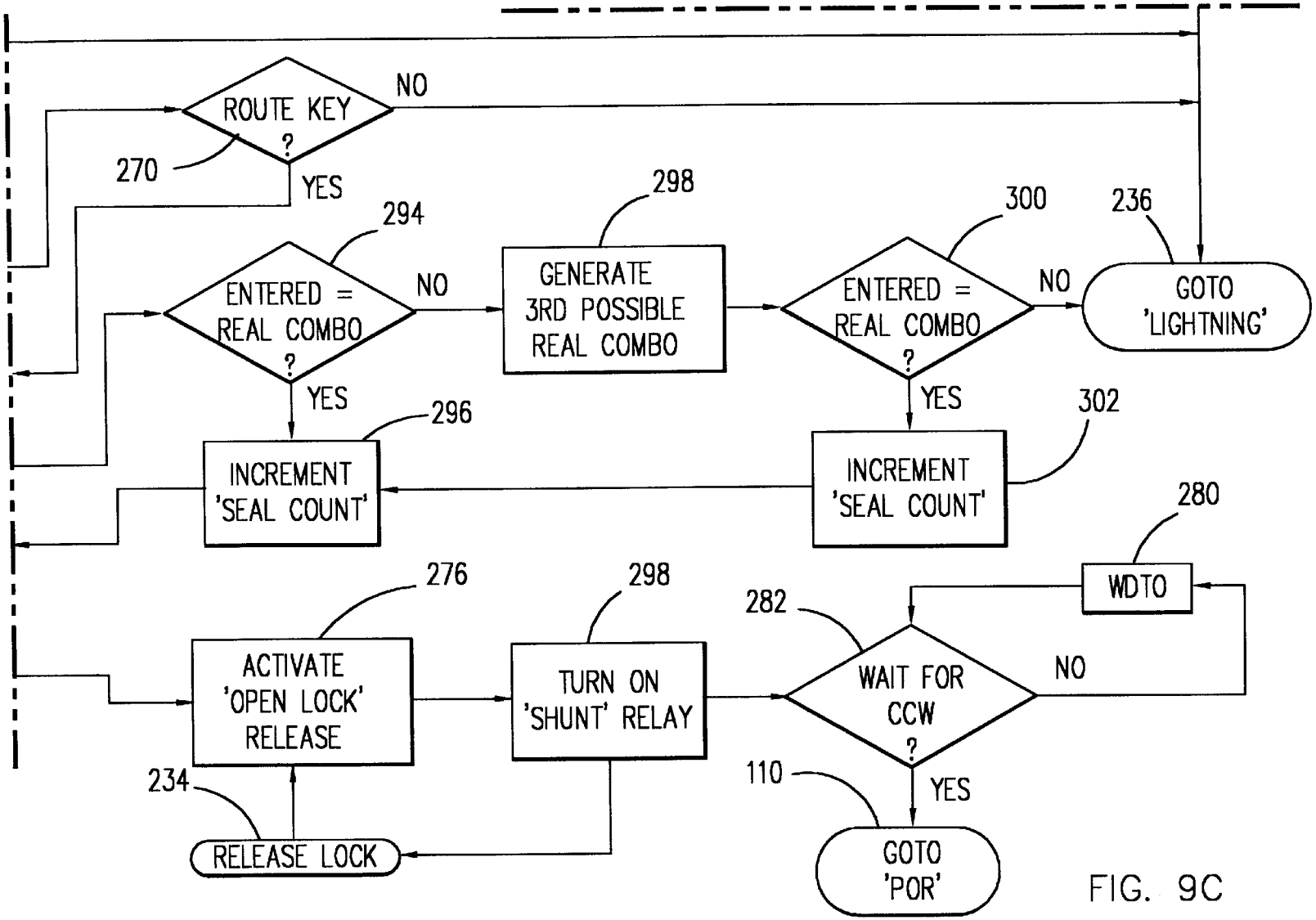

Referring now to operation 184 found in FIG. 7, the processing of the "Combo Is In" subroutine will be further explained with reference to FIGS. 9A, 9B and 9C. FIGS. 9A, 9B and 9C illustrate the subroutine contained in operation 184 and entry is indicated at operation 184 wherein the lock 12 is checked at operation 230 to determine if the lock 12 is presently set and operating in Factory Mode. Factory Mode is the condition in which the lock 12 is shipped to the customer by the factory. It is also a condition provided in which one can practice using the lock 12 without causing the conditions to change, necessitating dispatched combinations or an electronic key 16 to cause the lock 12 to function properly.

Further, the Factory Mode is the lock condition whenever all modes of the lock 12 are shelved. Shelving the lock 12 applies a specially dispatched key 16 in order to return the lock 12 to a condition whereby it can be placed on the shelf or "stored," and/or then reinstalled on another container at a later date without any need to maintain a continuous history of combinations entered into the lock 12; typically, the combination for the lock 12 is returned to a standard predetermined "Factory" Combination.

Once the lock 12 is operated and a combination entered, determination at operation 230 will be in the affirmative and the flow then is directed to operation 232 is compare the entered combination with the factory combination; and if equal, the flow goes to the affirmative path to the Release Lock Operation 234.

Should the Compare/Equal Condition in operation 232 not be satisfied, then the path flow is through the negative branch to operation 236 where a lightning bolt is caused to be displayed on the LCD 14 of the lock 12, indicating an error. Return now to operation 230 to determine that the lock is not in a Factory Mode, i.e., it has been installed and is fully operational in its intended one or more other modes. Then the path will follow the negative route to operation 238 and the determination as to whether or not this is the second combination entered of a dual combination pair. In the event of an affirmative determination, the second operator's personal identifier i.e., the electronic key 16, is requested by the displaying of "IP2" on the LCD display 14 in operation 240. The Touch Memory or other suitable identifying memory device then is read into a buffer 46 of the lock 12 and the Personal Identifier Serial Number and the can type of the key 16 then are read from the key 16 and stored in the buffer 46 to identify both the user and the key 16 being used. In operation 242 thereafter a determination is made as to whether this is the identical key 16 previously used to enter the first combination. In the event that there is an affirmative determination, then the second combination is being entered by someone using a single key 16 for both identification processes and an error condition exists; the flow therefore is to operation 236.

In the event that the operation in 238 is determined to be in the negative, i.e., the lock 12 is not requesting a second combination, then the flow is directed to operation 244 where there is a determination made as to whether the combination entered has been entered as a Confirmation Combination, by testing whether the Confirmation Combination Flag is set. In the event that the determination is in the negative, the combination is thereby determined to be an opening combination and the operator is prompted to identify himself by displaying of "IP1", which stands for "Insert Personal Identifier 1". This also will represent the first combination being entered inasmuch as it has been previously determined not to be the second combination.

The same information is read from the key 16 and stored in the buffer 46 in operation 246 as was read and stored in operation 240.

After operation 246, the key data is stored in the random access memory 44 of the lock 12 in operation 248. At this point it should be noted that should the same key 16 not be used twice as determined at operation 242, then the flow is to operation 248 where the key data read and stored in the buffer 46 in operation 240 is transferred to the random access memory 44 of the lock 12 in operation 248. After operation 248, the LCD display 14 is cleared in operation 250, an indication to the operator that it is permissible to remove the key 16 from the key socket 18 of the lock 12.

Thereafter in operation 252, the can type, key type, and the lock modes are all compared against a table stored in the memory of the lock 12 to determine whether this is an appropriate key 16 for the lock operation as presently configured. In the event that the key 16 type or can type of the lock 12 are inappropriate for the particular configuration of the lock 12, then the operation will go to an error condition within the operation and will cause a lightning bolt and error code display 14.

In the event that resolution occurs successfully, the flow is to the Combination 2 Flag Set determination step in operation 254. In the event that the Combination 2 Flag is set as determined in operation 254, there is a subsequent determination of operation 256 in FIG. 9B as to whether the key 16 being used is a bank key.

Upon a negative determination of the Combination 2 Flag Set or an affirmative determination of the Confirmed Combination Flag Set decision in operation 244, the flow is from the respective operations to operation 258 in FIG. 9B where the Seed Combination, Master Combination, Closed Seal, and Seal Count for the current key type are retrieved from the non-volatile memory of the lock and compared with corresponding values stored in two other locations within the lock 12 memory. Retrieval of the information from plural locations guards against the inadvertent or undesired destruction of the data in one location and permits the lock 12 to function and remain usable as long as two of the three stored locations favorably compare. Referring again to decision 256, with a positive or affirmative determination that it is a Bank Key 16, the information is retrieved in operation 258 in a like manner.

The path from operation 254 through operation 256 to operation 258 insures that for Bank dual mode, the retrieval of the Seed Combination, Master Combination, Closed Seal, and Seal Count Data is retrieved a second time but not for the Route or FLM users, enforcing the requirement of a dual dispatched pair of users.

In the event that the determination in operation 256 is that the key 16 is not a Bank Key, then the flow will pass to operation 260 where the microprocessor 30 will use the Seed Combination, Master Combination, Closed Seal, and Seal Count data retrieved in operation 258 to generate a real combination for the lock 12. Referring to operation 258, after the retrieval of and selection of the data that is identical for at least two of the three storage locations, the determination is made whether this is a confirming combination by checking in operation 262 the Confirmed Combo Flag to determine if set or not. If this is not a confirming operation, i.e., it is an opening operation, then and the flow is to operation 260 wherein the Real Combination is generated. If the entered combination in fact is a confirming combination as indicated by an affirmative determination for operation 262, then the flow is through the affirmative path to return operation 264 and subsequent return to the main loop of the program for additional user input.

Upon the generation of the real combination in operation 260, the Entered Combination is compared to the Real Combination in operation 266 and if a compare/equal condition exists, the flow will be through the affirmative path. Conversely, if the determination is found to be unequal, then the flow will be to operation 268 where the Combination 2 Flag is determined as either Set or Not Set. If the Combination 2 Flag is in a Set condition, then the affirmative determination will result in a flow from operation 268 through the affirmative path to operation 236, indicating an error. This reflects the fact that the combination did not compare and that this is the second pass of dual mode operation. However, if the Combination 2 Flag is Not Set, then the flow will be to operation 270 where a determination is made as to whether the key 16 is a Route key; and if it is not a Route Key, then this is an error condition resulting in the flow to operation 236. In the event that operation 266 results in an affirmative determination indicating that the Entered Combination and the Real Combination do compare, then the path is to operation 272 where a determination is made as to whether the lock 12 is set up in dual mode requiring two combinations and two keys 16 of this particular key type, being Route, first line maintenance, (FLM), or Bank Mode Operation.

If the lock 12 is not in Dual Mode for this particular key type, then the negative flow path will result in a routing to operation 274 wherein all data associated with the opening of the lock 12 is saved. This operation will be explained in more detail later.

After the data has been stored in operation 274, the Open Lock Release subroutine functions in operation 276 to create the conditions to allow the lock 12 to be released for opening. Thereafter the shunt relay 50 is turned ON in operation 278 and the lock 12 awaits a counterclockwise rotation of the dial 8. If no such rotation occurs, then the WDTO is set in operation 280; upon the expiration of that time period, the WDTO will cause the lock 12 to be reset and require re-entry at operation 112 in FIG. 4A.

The counterclockwise rotation of the dial 8, the directional rotation detected in operation 282, will indicate that the lock 12 is being closed and will cause the lock electronic controls to return to the Power On Reset, operation 100, FIG. 4A.

Returning to operation 272, in the event of an affirmative determination that the lock 12 is in a Dual Mode for this particular key type, then the Combination 2 Flag set condition is determined at operation 284. Should the Combination 2 Flag Set status be affirmatively determined, then the flow path is to operation 274 and the flow will continue through the remainder of the flow path to either WDTO 280 and a reset condition or to operation 110.

In the event of a negative determination in operation 284, then the Combination 2 Flag is set. The display 14 then will show "EC2" to prompt the operator to enter the second combination at operation 288. Thereafter the flow is to return to operation 290 which will return the flow to the main loop at operation 184.

At this point, return to operation 270 in FIG. 9C wherein determination of the Route Key 16 has been made. If this key 16, resident in key socket 18, is noted as a Route Key, the affirmative path will be followed first to operation 292 wherein the second possible real combination is generated and subsequently to operation 294 wherein the generated combination and the entered combination are compared. In the event of an affirmative determination of a Compare Equal Condition at operation 294, the Seal Count will be incremented at operation 296 and the flow then will be directed to operation 272 in FIG. 9B where the operation of the logic will continue as previously described with the remainder of the flow path. However, if in operation 294 the Entered and the Generated Combinations are unequal, then the lock will generate the third possible real combination in operation 298 of FIG. 9C, thus permitting up to three people to be dispatched to the same lock 12, on a single dispatch operation. Upon the generation of the third possible combination for the lock, the determination at operation 300 will detect whether the Entered Combination and the third possible Real Combination are equal. Upon a determination that they are unequal, an error condition is detected to exist and the flow is directed to the operation 236 to indicate an error.

However, with a positive or affirmative determination in operation 300, the flow will pass to operation 302 wherein the Seal Count is incremented, and the flow then will pass to operation 296 where the seal count is incremented a second time before the flow is directed to operation 272 in FIG. 9B for completion of operations. The double incrementations of the Seal Count as the flow passes through both operations 302 and 296 are not only necessary to keep both the dispatch computer and the lock in synchronism with regards to the data needed in order to generate future combinations, but also serve to eliminate the accessibility by the previous combinations.

This lock 12 uses several pieces of data unique to each individual lock 12 to generate those combinations to operate the lock 12. The pieces of data are stored in redundant locations to insure continued availability of the data to the microprocessor 30. A more detailed explanation of the routine of operation 258 in FIG. 9B follows with reference to FIG. 10.

Referring back to operation 258 where the Seed Combination, Master Combination, Closed Seal, and Seal Count data are retrieved and checked, this subroutine is expanded and described with respect to drawing 10.

From the entry of the routine at operation 258, the determination is made as to whether the key 16 is a Route Key. If the determination is made in the negative in operation 320, then the flow is to operation 322 where the key 16 is checked to determine whether it is a FLM key. In the event that it is determined not to be a FLM key, then the negative flow path is to operation 324 where the key 16 is checked to determine if it is a Bank key. If the determination is in the negative, an error condition exists because the key 16 must be one of a Route Key, a FLM key, or a Bank key. Therefore, the flow is to operation 236 where a lightning bolt and an error code are displayed on LCD 14 to indicate an error condition.

Should the determination in operation 320 or the operation in 322 be resolved in the affirmative, then the flow is directed to operation 326 where the Seed Combination, Master Combination, Closed Seal, and Seal Count data for the particular key type are retrieved to the lock's RAM 44. In the event that there is a discrepancy between the retrievals of the data from the three storage locations, then the data represented by the best two of the three locations is retrieved. Once the information has been retrieved, compared, and additionally two of the three locations found to favorably compare, then the flow continues with operation 327 wherein a determination is made of the set status of the Change Combination Flag. If the flag is Set, the flow branches to operation 336. If the flag is not Set, the flow is to Return operation 328 whereby the return is directed to operation 258.

Referring back to operation 324 wherein the key 16 is tested to determine whether it is a Bank Key; upon an affirmative determination, the flow then will be directed to an operation where the bank user identified by the Bank Key is subsequently verified by reference to the table of bank users stored within the non-volatile memory of the lock 12, operation 330. Once the Bank User's Record is found in the memory of the lock 12, a determination is made whether the bank user is a new user; upon a negative determination, i.e. he is not a new user, then the flow is directed to operation 334 where the Bank Users Seed Code is retrieved to the RAM 44 of the lock 12. And then the flow continues through operation 326 to the remainder of the flow diagram.

Should the determination be made in operation 332 that the bank user is a new user, then the flow will progress to initialize the new Bank Users record in operation 336. The subroutine of process will be described in more detail with respect to the subroutine illustrated in FIG. 16.

The pieces of data from which each combination is calculated changes for Route and FLM users with each opening of the lock 12; these pieces of data must be recalculated, encrypted and stored into the lock memory along with some of the data being stored in the user key 16. The Save Open routine of operation 274 is explained in more detail with reference to FIG. 11.

In FIG. 11 upon entry into operation 274, the flow will be to operation 340 wherein the prompt will ask the operator to insert his personal identifier by displaying IP1 on the LCD display 14 of the lock. The insertion of the key 16 into the key socket 18 will allow the lock 12 to get or retrieve personal identifier data, i.e. the can type and the serial number of the key 16. Thereafter the Touch Memory or key 16 is read to retrieve the key type and the time maintained by the Touch Memory 16, in operation 342. Thereafter the Current Seal Count is incremented in operation 344 and the key type is checked to determine whether the key 16 is a Bank Type Key in operation 346. If the key 16 is not a Bank Type Key, then in operation 348 the new Seed Combination, the Master Combination, and the Close Seal are recalculated as appropriate to provide the data from which the next user combination will be generated. Thereafter the flow is directed to operation 350 wherein the power supply 32 is latched to prevent the loss of power during data storage.

Thereafter in operation 352, an Open Only Lock Audit Record is compiled and written into the EEPROM 42 and an Open Only Key Audit Record then is compiled and written into the electronic key 16 or Touch Memory in operation 354. The flow then is directed to operation 356 wherein the Seed Combination, Master Combination, Close Seal, and Seal Count records then are written into the three locations for that particular key type. Thereafter the routine returns in operation 358 to operation 274. Referring to operation 346 wherein the key 16 was tested to determine if it was a bank type key; upon an affirmative determination, operation 360 will check to determine whether there is a Delay in Progress. The Bank Mode of operation is the only mode of operation which will accommodate a delay in opening following the entry of a valid combination or combinations and key insertions.

In the event that a delay is in progress at operation 360, the affirmative path then will direct the flow to operation 362 where the End Delay Flag is cleared. Subsequently, the flow is directed to operation 350 where the power supply 32 is latched and the remaining portion of the flow path is traversed as described earlier. In operation 360 in the event that there is no Delay in Progress, then operation 364 will build and write into the EEPROM 42 of the lock 12 a new delayed Open Data Record. Thereafter the flow of operations will be to operation 362 and the following operations previously described.

The building and the writing of a New Delayed Open Data record in operation 364 will be described with more detail later with regard to FIGS. 12A and 12B.

The Bank mode of operation allows a delay in opening to be inserted between the correct entry of a combination and the actual opening of the lock 12 and container. During the delay, there is no lock activity and the operator may attempt to proceed with opening. The microprocessor 30 must check to see if a delay is in process prior to proceeding with the opening of the lock 12. Routine 124 in FIG. 4*b* and further illustrated in FIGS. 12A and 12B explains the checking procedure to ascertain whether a delay is in progress.

Figure 12B:
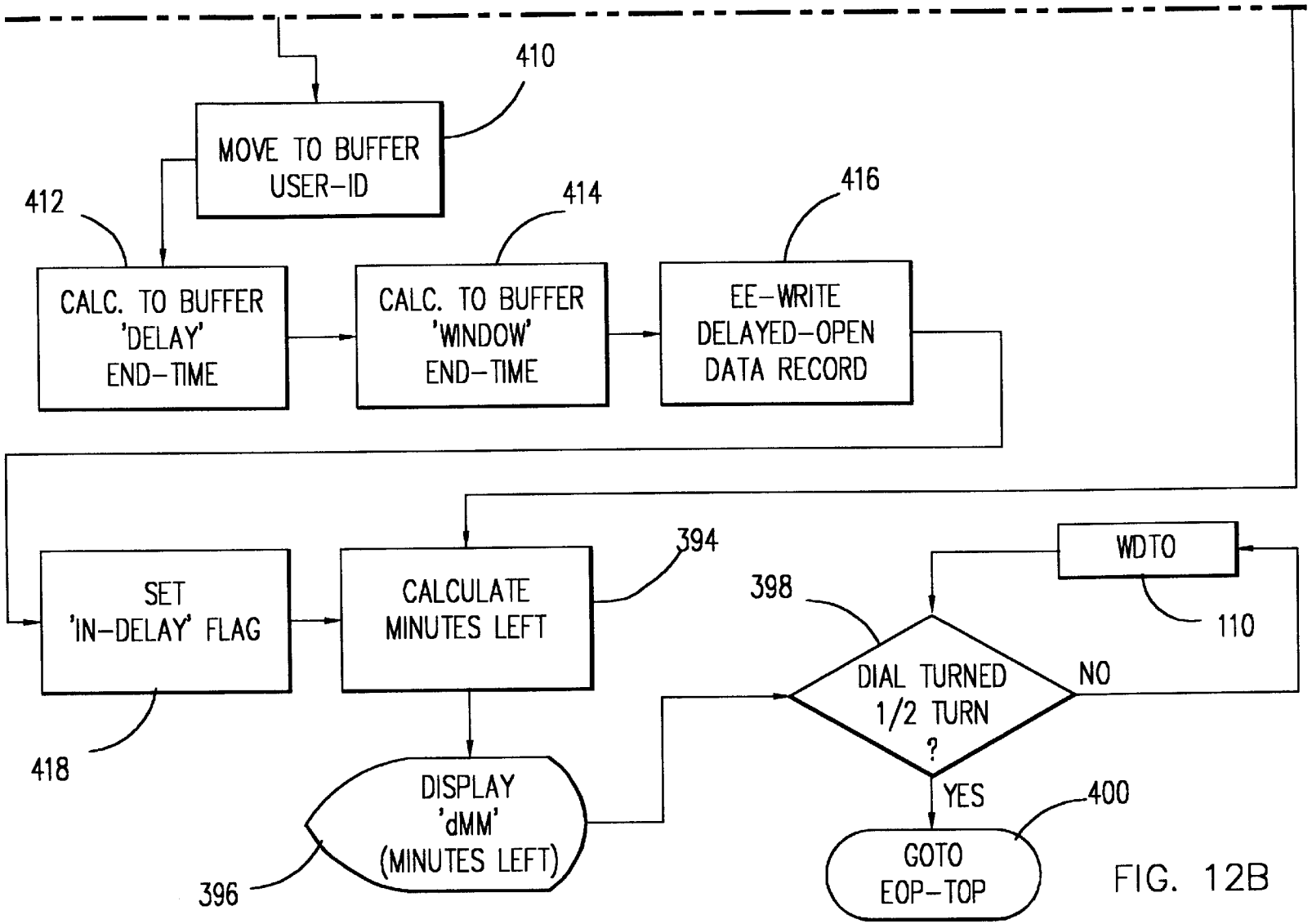

Referring now to FIGS. 12A and 12B, the flow diagram in these figures expands and illustrates operation 124 in FIG. 4B. The lock 12 is capable of delaying opening for a preset period of time after entry of a correct or authorized combination and user key insertion. in the bank mode only, this type of delay is possible. It is necessary at operation 124 in FIG. 4B to check if a delay is in progress. That determination is made at operation 370, FIG. 12A. In the event of a negative determination, the flow is diverted to operation 372 wherein the flow returns to operation 124 in FIG. 4B.

On the other hand, if a determination in operation 370 is in the affirmative, then the operator will be prompted to identify himself by a visual prompt "IP1" displayed on the LCD 14 of the lock 12. The touch memory or the electronic key 16 is read and the data transferred to the buffer 46 to acquire and store the personal identifier's serial number and can type of the key 16, which is inserted into the electronic key socket 18 of the lock 12. This all occurs in operation 374. Thereafter in operation 376, the key 16 again is queried, as is the buffer 46, for information stored during operation 374 to acquire the key data which comprises the personal identifier's serial number, can type, security ID, time, user ID, customer number, and the company or branch ID; all data is stored permanently or transiently in the Electronic Key 16 or Touch Memory Container. Thereafter, a determination is made at operation 378 as to whether the key 16 that has been inserted into the key socket 18 is or is not a Bank Key. Upon a negative determination, the flow path branches to operation 380 wherein clearance of the In Delay Flag occurs, indicating that a delay is not in progress, and then the flow is to return operation 372.

In the event that the type of the key 16 is determined to be a bank key in operation 378, the EEPROM 42 is read to acquire the Delayed Open Data Record in operation 382, and then the flow continues with decision block 384 where a determination is made as to whether the key 16 used to initiate the delayed opening is the same key 16 that was just entered into the key socket 18. If the determination concludes that the same key 16 or the same user is not still in control of the lock 12, then the In Delay Flag is cleared in operation 380 and the flow is directed again to operation 372 for a return to the operation 124, FIG. 4B.

If the key 16 inserted into the lock 12 upon the most recent request is in fact the same user key 16, then the flow is through the affirmative path to operation 386 where a check is made to determine as to whether the time read from the key 16 exceeds the previously calculated delay end time. In the event that the delay end time has been exceeded or, stated differently, that the delay period has expired, the affirmative path is followed to operation 388 to a determination whether the time presently exceeds the end of the previously calculated window end time. If so the delay period must be restarted; in so doing, the flow is through the affirmative path to operation 380 described previously. In the event that the time has not exceeded the Window End Time, then the flow is through the negative path and the EEPROM 42 of the lock 12 is read in operation 390 to determinate the Seed Combination, Master Combination, Close Seal, and Seal Count record for the key type that has been inserted into the socket 18.

Thereafter, the flow is to operation 392 where the logical control flow is directed to the "Save Open" operation 274 found in FIG. 9B; and the flow of control will result ultimately in the opening of the lock 12. In the event that the determination made in operation 386 is that the time has not exceeded the delay end, then the NO flow path is followed and a calculation is made in operation 394 to determine the number of minutes left in the delay period. The flow is thereafter to operation 396 where the minutes left in the delay period are displayed, preceded by a "d" to indicate "delay," on the LCD display 14.

Thereafter the flow is to operation 398 where the lock dial 8 is monitored to determine whether the dial 8 has been rotated a one-half turn in either direction. Should movement of the dial 8 sufficient to satisfy this condition not be detected, then the negative branch will be followed and the WDTO in operation 110 will monitor lock operations until the end of the timeout period. The entire process will be restarted at operation 112 if the timeout period expires without the awaited input. In the event that at any time during the 40 second timeout period the condition in operation 398 is satisfied, the timeout will be terminated and the flow will branch through the affirmative path to operation 400, prompting the operator that the "End of Procedure" has been reached by the LCD 14 displaying "EOP" and then returning the flow to operation 112 as illustrated in FIG. 4A.

Refer back to operation 364 shown in FIG. 11, a new "Delayed Open" data record is created. Operation 364 is expanded and tied into the operations illustrated in FIG. 12A at operation 364, indicating a start of the new delay. Thereafter, at operation 402, the EEPROM 42 is read to retrieve the "Delayed Open" data record and a determination based on that record is made in operation 404 if the initialized delay time is greater than zero.

In the event of a negative determination, the "In Delay" flag is cleared in operation 406; and in operation 408, the flow returns to operation 364. Should there be a determination in operation 404 that the delay is greater than zero based upon the Delayed Open data record retrieved in operation 402, the Users ID is moved in operation 410 to the buffer 46 and then the flow is directed to operation 412, where the end time of the delay is calculated and also subsequently inserted into the buffer 46. In operation 414 the Window End Time is calculated and also stored in the buffer 46. Operation 416 writes the combined information of the user's ID, the Delay End Time that has been calculated, and the calculated Window End Time into the EEPROM 42 as the Delayed Open Data Record. Thereafter the In Delay flag is set and stored in operation 418 to indicate that a delay is in progress; the number of minutes in the delay are calculated in operation 394 with the flow from 394 as previously described.

This lock 12 requires certain inputs for security integrity before it will allow changes in its operation., The Supervisor Audit Key 16 is the only type of key that can be used to change the operation of the lock 12, in conjunction with the change key 48. The change key 48 and Supervisor Audit key 16 are required for operation of a) the Initialize Mode function; b) Shelve Mode function; c) Add Bank User Function; and d) Delete Bank User function.

Figures 13, 13A, 13B:
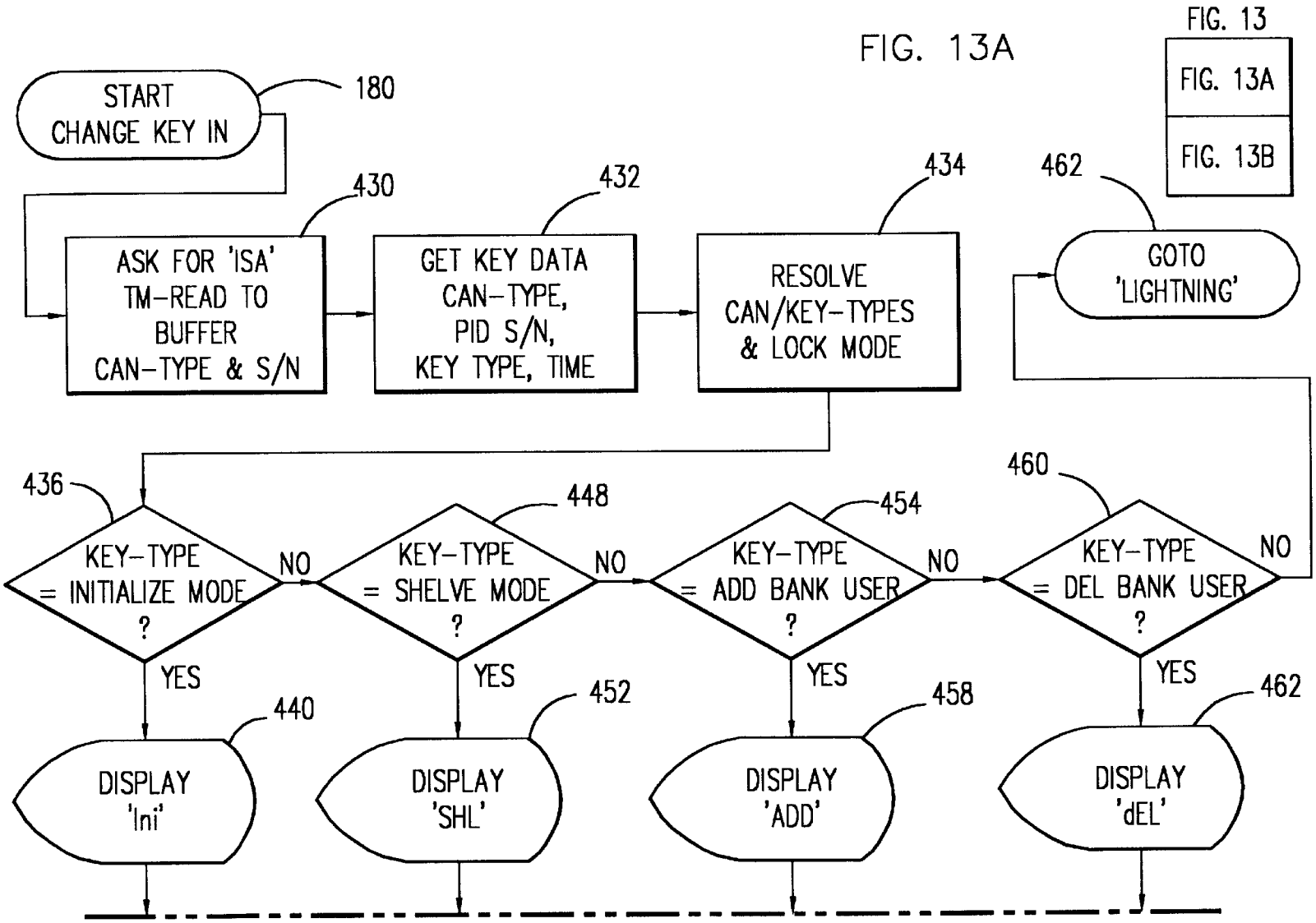
FIG. 13 is a diagram of the relationship of FIGS. 13A and 13B.
FIGS. 13A and 13B illustrate operation 180 of FIG. 7.
Figure 13B:
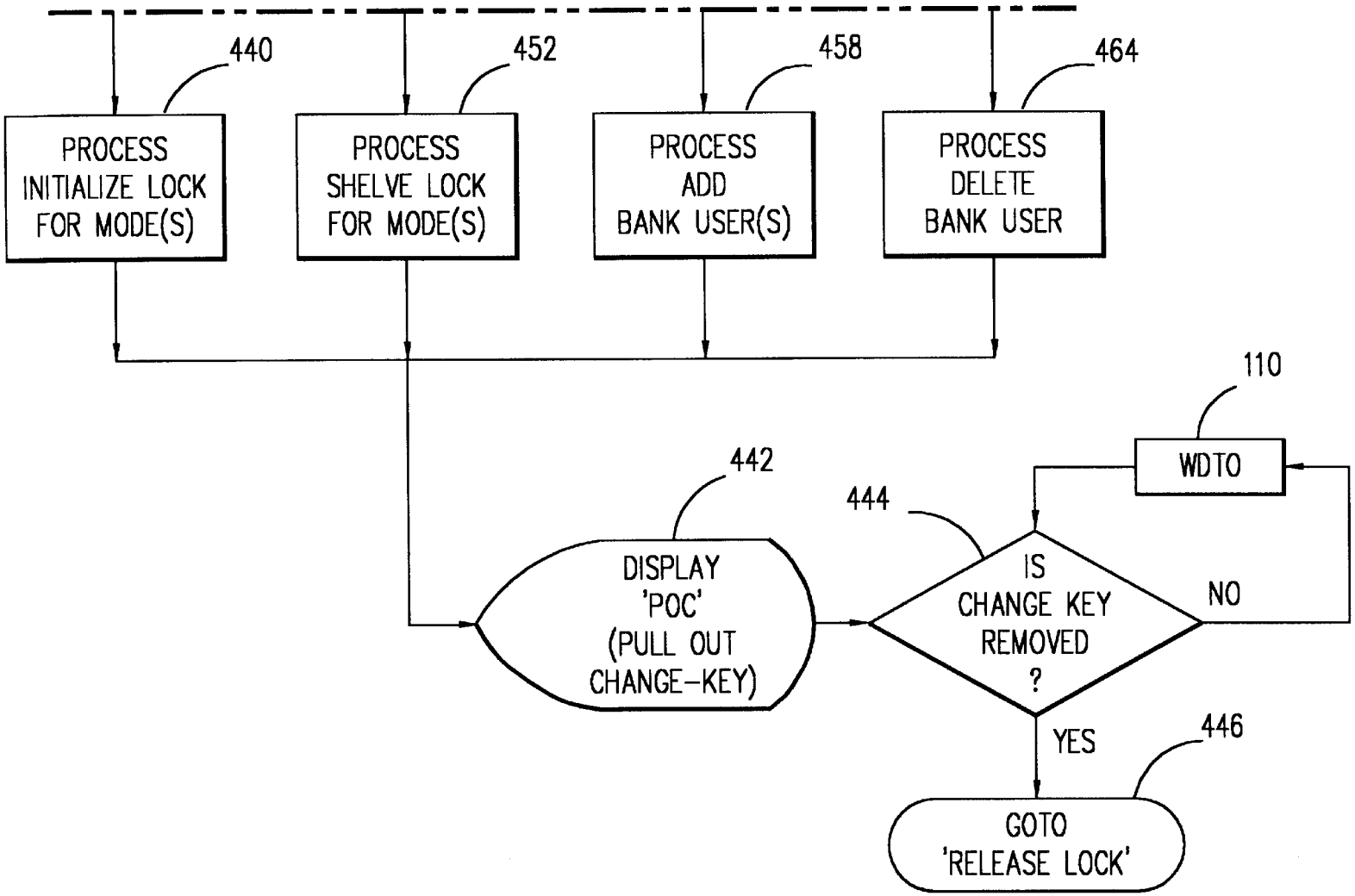

With respect to the flow diagram in FIGS. 13A and 13B, the Change Key Operation should be understood to be where the parameters of the lock 12 are either entered or changed. In order to accomplish the changes contemplated and controlled by the presence or absence of the change key 48, the lock 12 must be opened, the container opened, and the change key 48 inserted into the change key port 49 of the lock 12.

Expanding on operation 180 found in FIG. 7, entry into this subroutine is indicated in FIGS. 13A and 13B designated as Change Key In at operation 180 and, thereafter the lock 12 will ask for or prompt the operator to insert a Supervisor Audit Key, one of the several types of keys 16 that may be used with the lock 12. The Supervisor Audit Key 16 is a key which permits only the holder to operate the lock 12 and/or make changes in its operating parameters. Upon the insertion of the Supervisor Audit Key, as prompted in operation 430, the Electronic Key 16 or Touch Memory is read into the lock buffer 46 and the can type and the serial number of the key are stored.

Thereafter in operation 432, additional information is read from the key 16 to store in the lock's Random Access Memory or RAM 44. The information stored in the RAM 44 includes the can type, personal identifier serial number, the key type and the time stored in the key 16 by the dispatch system. In operation, 434 the can and key types together with the Lock Mode are resolved to determine if the combined information results in legitimate factors for the lock 12, as presently configured.

Thereafter the flow is directed to operation 436 where the key type is tested to determine whether the key 16 is an Initialize Mode Key. Upon an affirmative determination, the display 14 will show a "Ini" to provide visual feedback to the operator that the lock 12 is in an initializing mode in operation 438; and thereafter in operation 440, the process of initializing the lock 12 in one or more modes occurs and will be expanded, as further described below.

Upon the completion of the initialization of the lock 12 in one or more modes, the display 14 will prompt the operator to pull out the change key 48 by displaying "POC" in operation 442; and thereafter in operation 444, the lock 12 will test to detect if the change key 48 is removed. In the event that the change key 48 is not removed, then the WDTO operation 110 will be tested and should the change key 48 not be removed within the timeout period, then the timeout expiration will return the operation of the lock 12 to the START operation 112 in FIG. 4A. If the change key 48 is removed during the predetermined timeout period, then the affirmative path is followed to operation 446 where the flow is directed to operation 234, see FIG. 9A, and the lock 12 is released for opening.

Return now to operation 436. If the key type is not an Initialize Mode key, then the negative flow path will be followed to operation 448 where the key type is tested to determine whether it is a Shelve Mode key 16. If so, then the affirmative path will be followed to operation 450 where the operator is provided visual feedback that the lock 12 is in a Shelve Mode by displaying "SHL" and thereafter processing the Shelve Lock routine in operation 452. Operation 452 will be described in more detail below.

After operation 452 has been completed, the flow is to operation 442 and to subsequent processes previously described.

In the event that the determination in operation 448 is that the key type is not a Shelve Mode key 16, then in operation 454 a determination is made to detect if the key 16 is of the type which will add one or more bank users to the authorized users list. Upon an affirmative determination that the key type is the type which is to be used for adding additional bank users to the authorized bank user list, the display 14 will prompt the operator with "Add" indicating to the operator that the lock 12 is in an "Add" mode in operation 456. Operation 456 is followed by operation 458 where bank users are added to the authorized user list stored within the lock's memory. Thereafter the flow is to operation 442 and subsequent operations as previously described.

Upon the test 454 resulting in a negative determination, operation 460 will test the key 16 to determine if it is a Delete Bank User key 16. In the event that a negative determination is made, that finding combined with the failure to find an appropriate key type in operations 436, 448, 454, or 460 results in an error, and the flow then is to operation 462 which displays an error lightning bolt and the control of the lock returns to operation 112 as shown in FIG. 4A.

Upon a positive or affirmative determination in operation 460, the display 14 will prompt in operation 462 the operator by displaying "dEL" on the LCD display 14 and thereafter in operation 464 will delete one or more bank users from the authorized list. Operation 464 will be described in more detail later.

The flow from operation 464, similar to the flow from operation 440, 452, 458 is directed to operation 442 and subsequent operations as previously described.

At this point a high level overview of the initialization of the lock 12 in this embodiment will prove helpful. A lock 12 can be initialized from the factory mode or from a condition wherein one or more modes of the lock have been initialized previously, and now an additional mode needs to be initialized and rendered operational.

The initialization operations vary slightly depending upon whether the lock 12 is in Bank Mode or already operating in at least one mode. If in Bank Mode with the change key 48 inserted in the lock 12, the dial 8 is rotated to power up the lock 12, resulting in the display 14 exhibiting a "change key symbol" and the letters "EC" on the three digit display of this embodiment of the lock 12.

For those locks 12 that have been previously placed in service in one or more modes of operation, the lock 12 must be first opened by the use of the electronic key 16 and the entry of a dispatched authorized combination. Thereafter, the change key 48 is inserted in the lock 12 and the dial 8 turned left to bring up on LCD 14 the "change key symbol" and the letters "EC" as above. From this point on, the initialization process is essentially identical.

The factory mode of the lock 12 is checked and a "Factory Combination" is entered for the mode being initialized and the initialization key is used. The initialization key contains the data necessary to identify the mode to be initialized and the other data necessary for the lock 12 to generate the combination for the lock to operate and to thus generate the various pieces of data necessary for the next operation of the lock 12 in that mode at some future time.

After the initializing operations have been concluded, the lock 12 must then be closed using the same electronic key 16 that was used to open the lock 12 initially. With the opening and the closing as well as the initialization, audit records are created. Because the Initialization Audit Record will be bracketed in time by the Open Record and the Close Record, which will clearly identify the user and the mode that granted access to the lock 12 for the initialization, accountability is maintained and a user may not initialize a mode of a previously operating lock 12 without another user being involved.

Anytime the lock 12 is to be initialized in Bank Mode, at the displaying of "Change Key Symbol" and "EC", the factory combination must be entered and then the user number must be entered so that the proper user file is created and stored in the Bank Mode User Table.

Figure 14A:
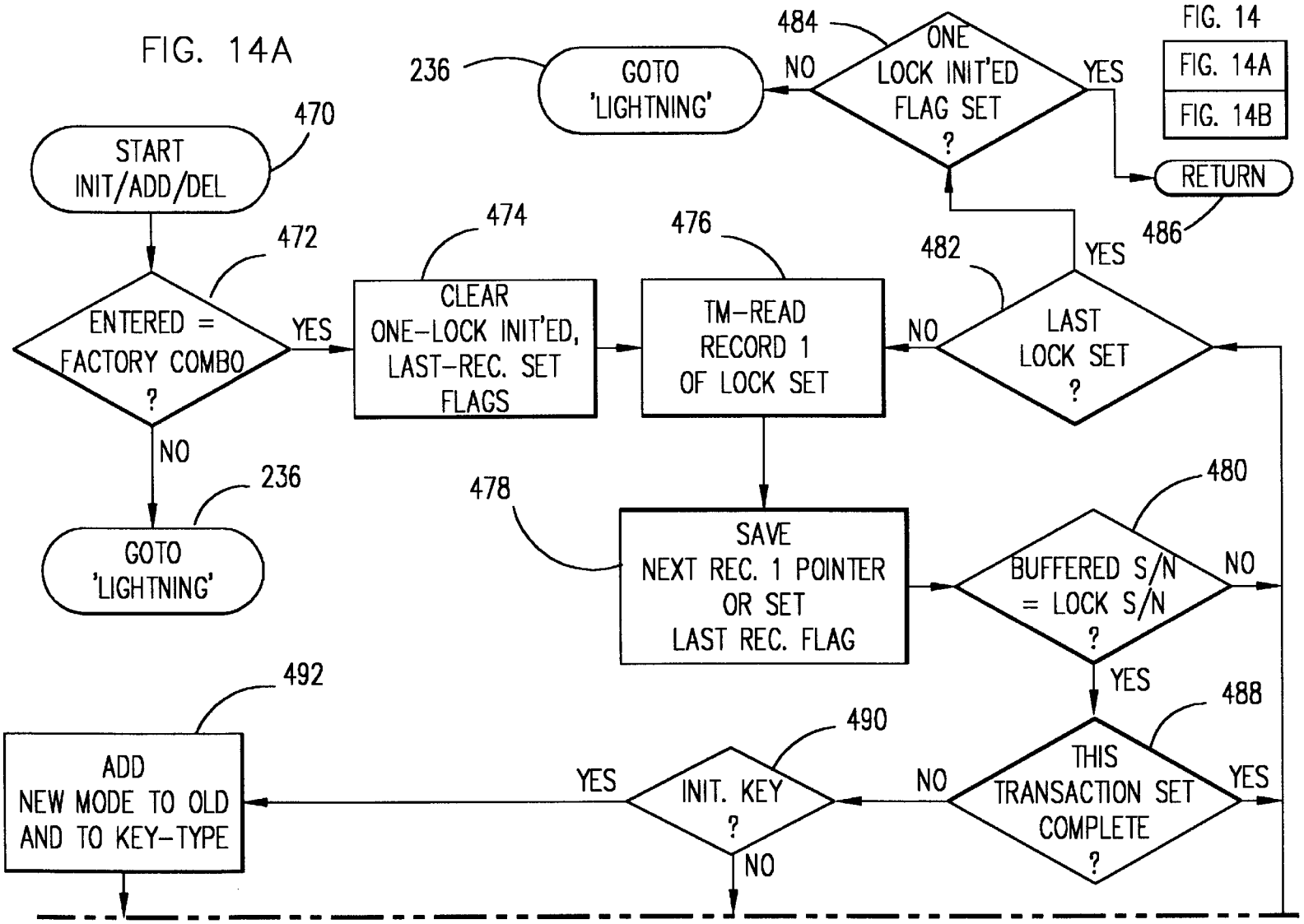
FIGS. 14A and 14B illustrate operation 470 which is a common routine for operations 440, 458 and 464 of FIG. 13B.
Figure 14B:
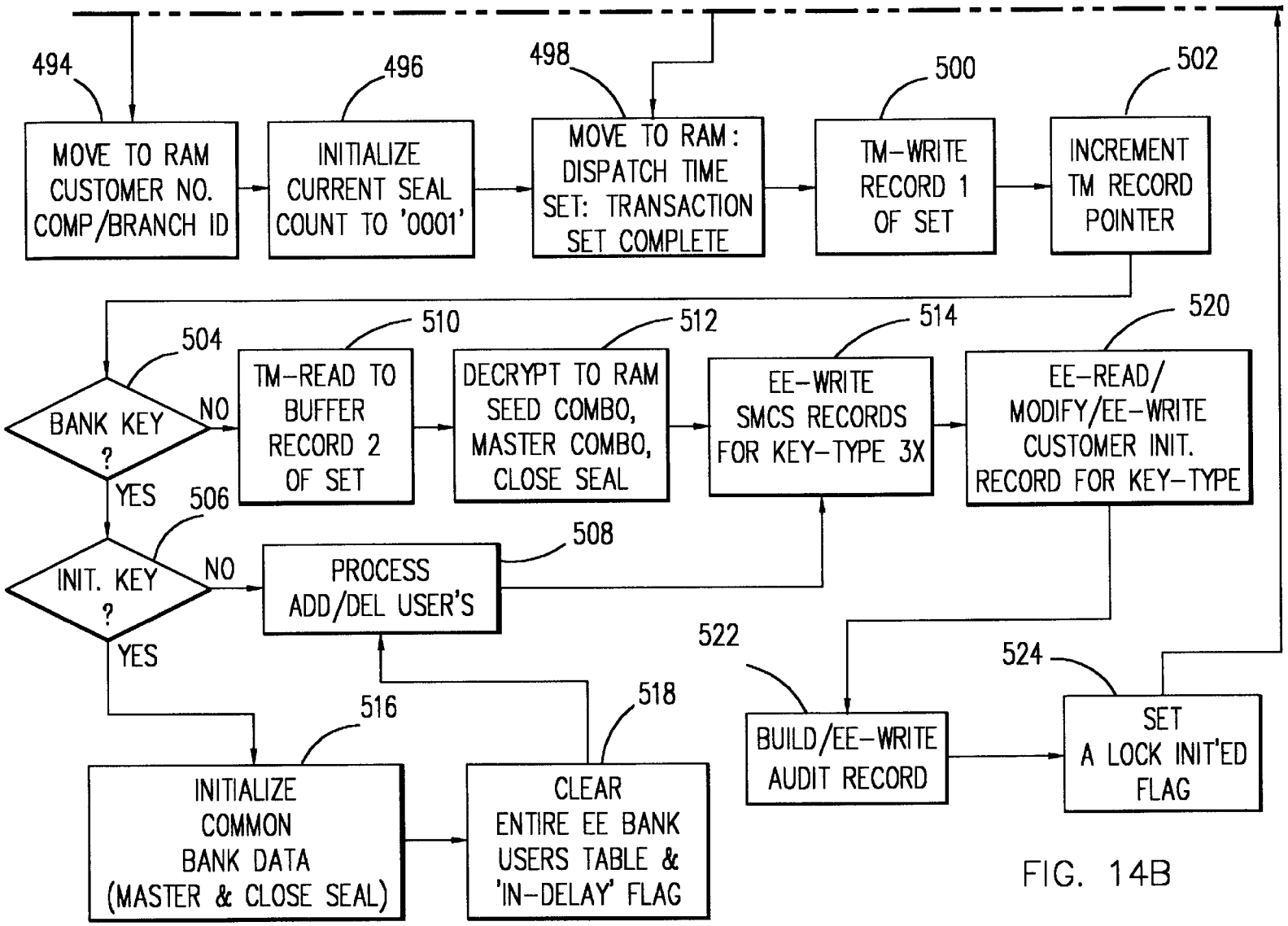

In order to simplify the programming of operations 440, 458, and 464 and because the three processes are substantially identical, a single subroutine illustrated in FIGS. 14A and 14B and entered at operation 470 in FIG. 14A has been devised which will satisfy the needs of each of those processes for performing its own unique function. Because operations 440, 458 and 464 are essentially identical from a logic flow standpoint, and only use different input data, a single logic flow has been devised to operate as the respective routine dependent upon whether the function is to Initialize Modes, Add Bank Users or Delete Bank Users.

Referring now to operation 470, in FIGS. 14A, indicated as "Start: Init/Add/Del" the entry into operation 470 is from operations 440, 458, or 464. Thereafter the flow is to operation 472 wherein the entered combination is tested to determine whether it is the factory combination; and upon a negative determination, the flow diverts to operation 236 which is an error condition and causes the display of the lightning bolt on the LCD 14 to indicate to the operator that an error has occurred. Upon an affirmative determination in operation 472, the flow is to operation 474 where the "One Lock Initialized" and "Last Record Set" flags are cleared. These flags will be used later in connection with the processing of these records. Thereafter, in operation 476 the Touch Memory or the electronic key 16 is read to retrieve record #1 of a lock set. The flow continues downward from operation 476 to operation 478 where the Next Record 1 Pointer is saved or the Last Record Flag is set.

Thereafter the flow continues to operation 480 where the lock 12 serial number from the key 16, buffered in operation 430, is checked against the lock serial number in this data record. In the event that the lock serial number and the buffered lock serial number from the key 16 are not equal, then the flow is to operation 482 where the Last Lock Set flag is checked to determine whether it has been set. If the Last Lock Set flag has not been set, then the negative flow path directs the flow to operation 476 and subsequent operations. If the Last Lock Set flag in fact has been set, a determination is made in operation 484 as to whether the "One Lock Initialized" flag has been set. In the event that the "OLI" flag has not been set, then the flow is through the negative path to operation 236 which causes a lightning bolt to be displayed on the LCD 14.

If the "one lock initialized" flag has been set as determined in operation 484, the affirmative path is followed to cause the return operation 486 and the return to operation 440, 458, or 464, whichever is the appropriate origin of operation.

Refer back to operation 480, a Compare Serial Number Equal operation. The flow is directed through the affirmative path to operation 488 where a determination is made as to whether this transaction set is complete or record set is used. In the event of an affirmative determination, the flow is to operation 482 and subsequent operations as previously described.

If the determination of operation 488 is made in the negative and the transaction set is not complete, then the determination in operation 490 is made to determine whether the key 16 last inserted in the key socket 18 is an initialize Mode key. Should the key 16 be an initialize Mode key, then a new mode of operation from the key 16 is added to the previous modes or old modes of operation and to the key type in operation 492; flow then progresses to operation 494 where the customer number and company/branch ID is moved from the key 16 to the RAM 44 of lock 12. Thereafter in operation 496 the current Seal Count for that mode of operation is initialized to "0001" and stored. In the event of the negative determination that the key 16 is an Initialize Mode key in operation 490 or upon flow coming from operation 496, the dispatch time stored in the key 16 is moved to the lock RAM 44 and the Transaction Set Complete flag is set. All of this occurs in operation 498. Thereafter, in operation 500, the electronic key 16 or Touch Memory is re-written to record the "Processed Transaction Complete Flag" to indicate that this record has been processed and need not be processed again. In operation 502 the Touch Memory Record Pointer is incremented. Then the Key Type is tested to determine whether the key 16 is a bank key in operation 504. If the key type is in fact a bank key, the affirmative path then will be followed to determine whether it is also an initialize mode key, as well, in operation 506. If the key 16 is not an initialize mode key, then the negative path from operation 506 leads to operation 508 where the addition or deletion of the users to the authorized user list is accomplished, and the flow then is directed to operation 514 to be described below.

Referring back to the bank key type determination in operation 504, if a negative determination results, "Record 2 of the set" is read from the electronic key or Touch Memory 16 to the buffer 46 at operation 510 and thereafter, in operation 512, the data from the key is decrypted and stored in the RAM 44 of the lock 12. The decrypted data is the Seed Combination, the Master Combination, and the Close Seal value. Thereafter the flow is directed to operation 514 where the EEPROM 42 is written to record the Seed Combination, the Master Combination, the Closed Seal, and the Seal Count record for that particular key type in three separate memory locations in the lock memory for security and reliability.

In operation 506 if the key 16 is an initialize mode key, then the flow is through the affirmative path to operation 516 where both the common bank data of the master combination and the Close Seal value are initialized for all bank users. Thereafter, the entire Bank Users Table and -the In Delay flag are cleared in operation 518 and the flow is directed to operation 508, previously described.

From operation 508 the flow is to the previously described operation 514, and to operation 520, where the EEPROM 42 is read and then modified to contain the new customer initialization data for this key type such as the customer number and the company or branch ID number for this key type. That data is rewritten into the EEPROM 42. Thereafter in operation 522 an Audit Record reflecting the operations previously performed, i.e., Initialization/Add User/Delete User, is built and written into the audit memory of the lock 12. In operation 524 "A Lock Initialized" flag is set and the flow directed to operation 482 and subsequent operations, as previously described.

Figure 15A:
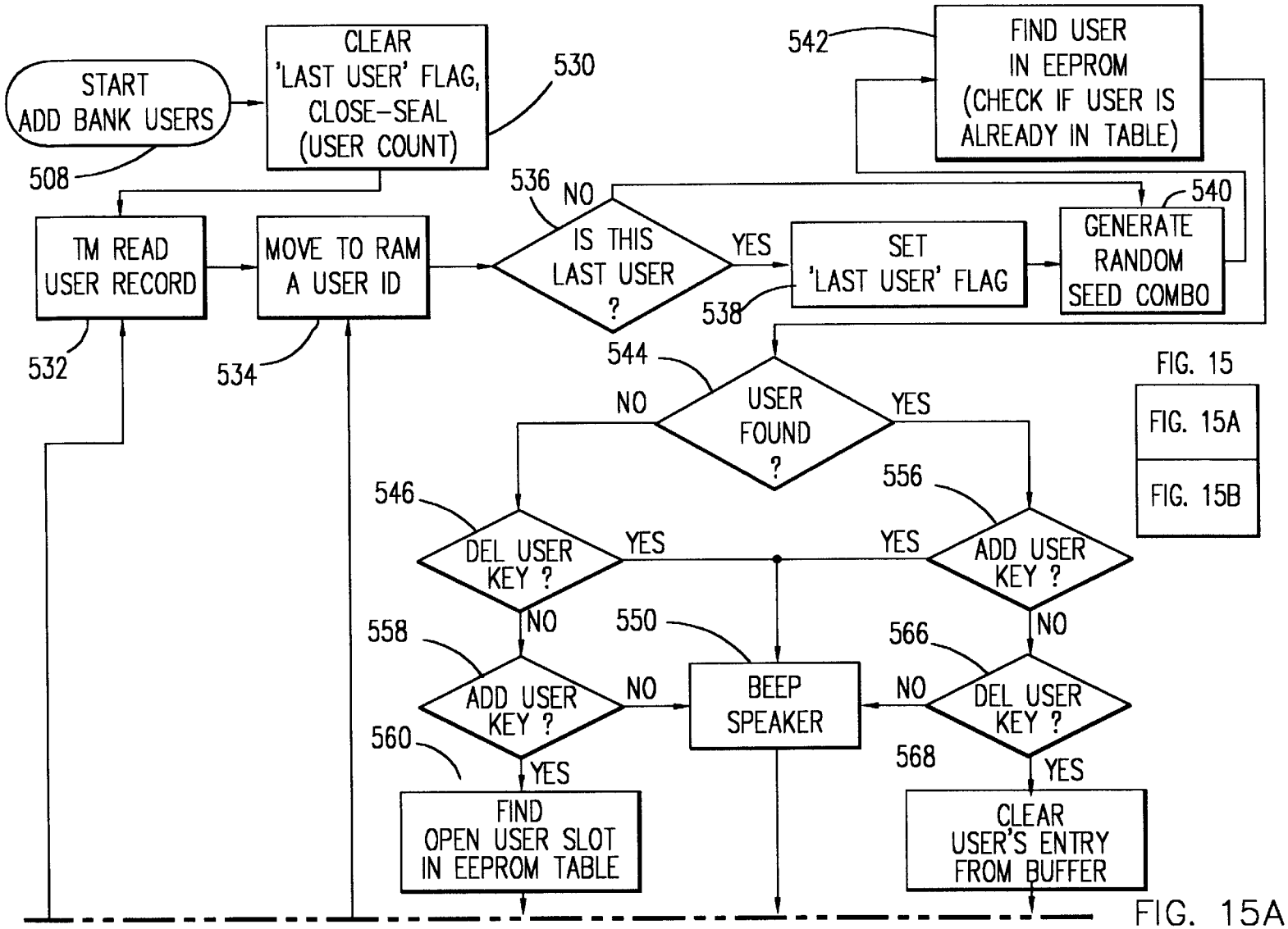
FIGS. 15A and 15B illustrate operation 508 of FIG. 14B.
Figure 15B:
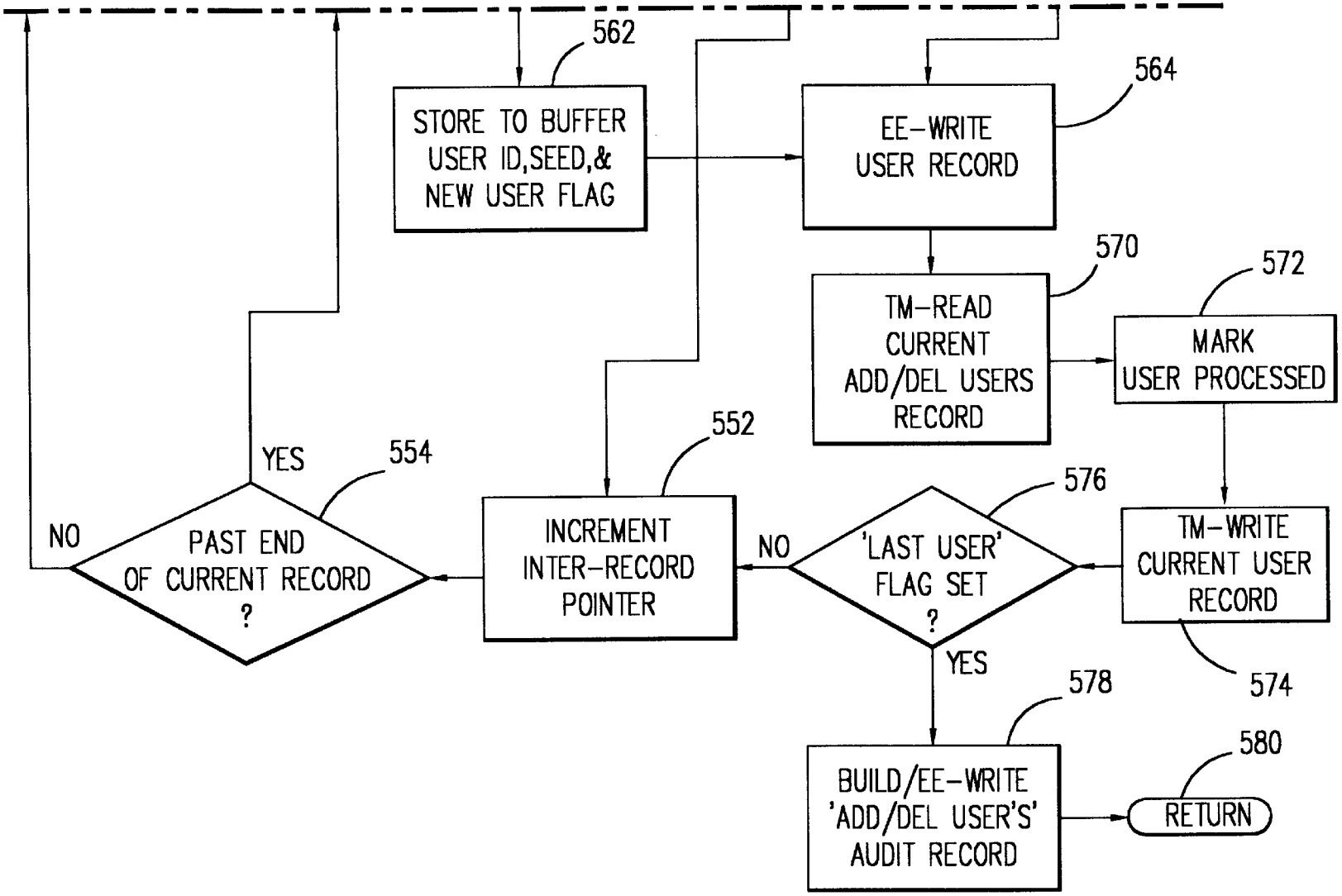

At this point, please refer to FIGS. 15A and 15B which are flow charts expanding operation 508 as shown in FIG. 14B. Upon entry into 508 the Last User Flag is cleared, the Close Seal is cleared in operation 530 and Touch Memory 16 is read to secure the user record in 532. Thereafter the user ID is moved to the RAM storage 44 of the lock 12 in operation 534 and a determination made as to whether this user ID identifies the last user for this lock 12 in operation 536. Upon a positive or affirmative determination in operation 536, the Last User Flag is set in operation 538 and a random Seed Combination for this user is generated in operation 540. In the event that the user ID code does not reflect that this is the last user in operation 536, the negative path will go directly to operation 540 and bypass 538. Thereafter the user's ID is used to search the EEPROM 42 to verify if this user's entry already exists in the users' table in operation 542.

In operation 544 a determination is made as to whether the user has been found. Upon a negative determination of whether the user was found in the user table at operation 544, the negative path flows to operation 546 where the key 16 is checked to determine whether it is a Delete User Key. If the key 16 is a Delete User Key and the user was not previously found, then an error condition exists and the affirmative path is followed to alert the operator by a beep of the speaker at 550; the flow then passes to operation 552 where the "Inter Record Pointer" is incremented and the "Inter Record Pointer" is verified to learn if it has passed the end of the current record in operation 554. If the query of operation 554 is answered in the affirmative, the flow route is directed back to operation 534, the loop in this record; and if the determination in operation 554 is in the negative, then the flow is directed to operation 532 where the loop continues with the next user record.

Returning to operation 546 if the key 16 is not a Delete User Key, the negative path is followed to the decision block of operation 558 to determine if the key 16 is an add user key. In the event that the key 16 is not an Add User Key, the speaker is beeped in operation 550 and the flow continues as previously described.

However, if the key 16 is found to be an Add User Key in operation 558, then the flow is directed to operation 560 where an open user slot in the EEPROM 42 users table is found; the user's ID and new user flag are stored in that open user slot in operation 562. This user record then is immediately written into the EEPROM 42 at operation 564. Should the identified user have been found in operation 544, the flow is to the affirmative path to operation 556 where the key 16 is tested to determine whether it is an Add User Key; and if the determination in operation 556 is in the affirmative, then the speaker is beeped in operation 550 and the flow continues therefrom as previously described. However if the key 16 is not an Add User Key, then the test is made in operation 566 to determine whether the key 16 is a Delete User Key. In the event that the key 16 is not a Delete User Key, then the speaker is beeped in operation 550 with the flow continuing as previously described.

Should the key 16 be a Delete User Key, then the user's entry is cleared from the buffer 46 in operation 568 and the flow is directed to operation 564 as previously described.

Following operation 564 the electronic key or Touch Memory 16 is re-read and the current Add or Delete User Record is retrieved in operation 570. Thereafter in operation 572 the key 16 is marked or flagged to indicate both that this user has been processed and will not be reprocessed and also as feed-back to the dispatch system indicating the user has been accepted into this lock 12 whenever the key 16 is returned to the dispatch system.

In operation 574 the Touch Memory or electronic key 16 has the current user record written thereunto, and then the flow is directed to operation 576 where the Last User Flag is tested to determine whether the flag has been previously set. If the last user flag has not been previously set, the flow then is to operation 552 and subsequent operations as previously described.

However if the Last User Flag in fact has been set, then the affirmative flow path is followed to operation 578 where an Add or Delete Users Audit Record is built and written to the EEPROM 42. Thereafter the flow is to the return operation 580 which returns to operation 508.

Figure 10:
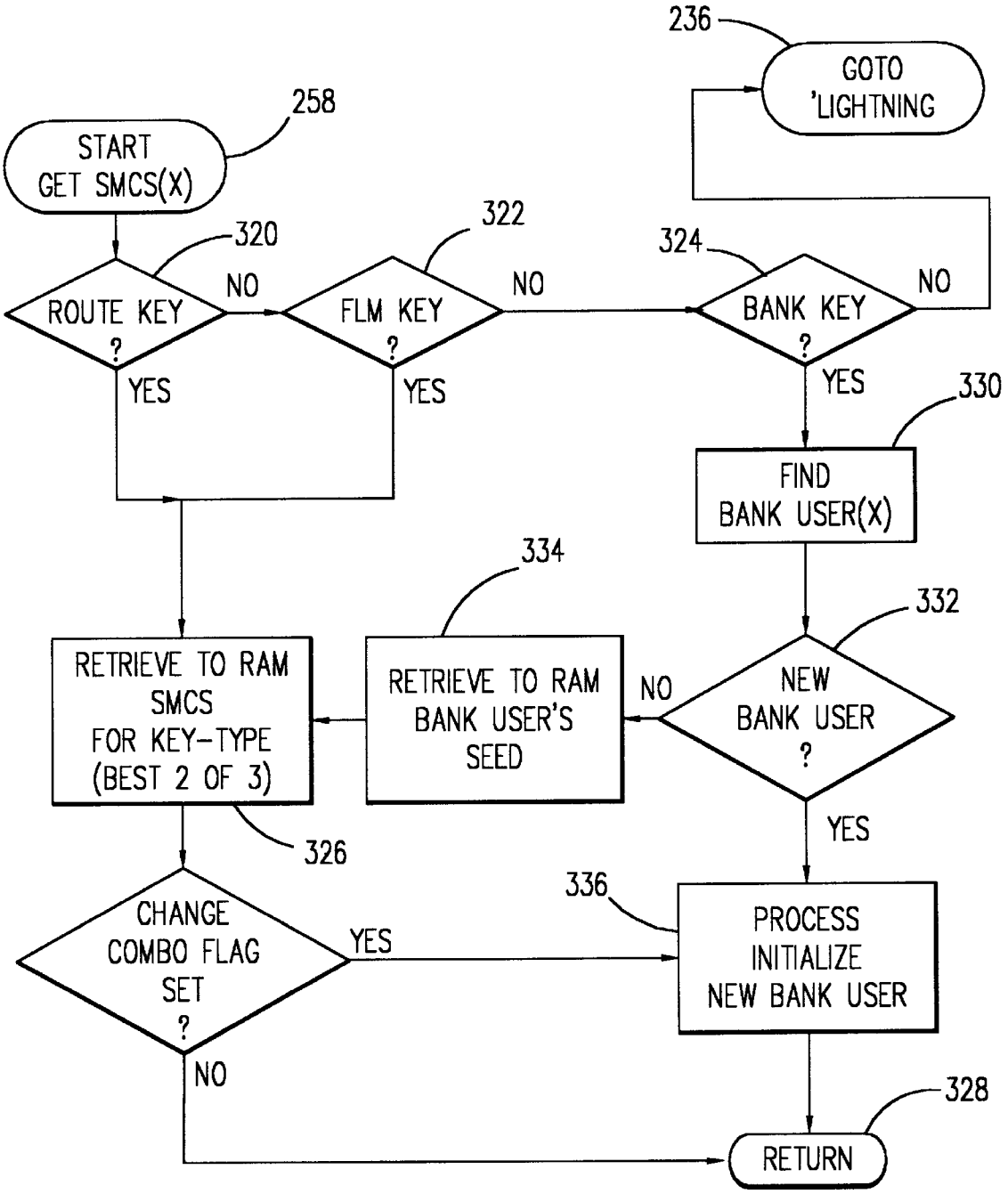

The process of initializing New Bank User operation 336 in FIG. 10 is expanded in the flow diagram of FIG. 16. Operation 336 in FIG. 10 is entered in FIG. 16 at the START operation 336. In operation 590 the Confirmed Flag is tested to determine if it has been previously set in Pass 1. If the Confirmed Flag has not been previously set, the negative path is followed to operation 592 and the determination made as to whether the entered combination is equal to the factory combination. If the entered combination is equal to the factory combination, then a random Seed Combination is generated for this user in operation 594 and the Seed_OK flag is set in operation 596. Thereafter the remainder of the Seed Combination, Master Combination, Close Seal, and Seal Count data is retrieved from the EEPROM 42 and at least two of the three sets of data retrieved from the three different memory locations in which the data was stored are compared; and of those which do compare, at least two out of three are used in subsequent calculations. The retrieval operation is operation 598. In operation 600 the real combination for the lock 12 is generated and the new user's real combination then is flashed or displayed on LCD 14 to the user in operation 602 allowing the user to record or memorize the new combination. The new user's combination continues to be displayed until such time as the Reset Button (the Asterisk Button) is detected as pressed in operation 604.

Prior to the detection of the depressed Reset Button in operation 604, the negative control path directs the logical control to the WDTO function 110 and will continue to do so until either the Reset Button is detected as having been depressed or the WDTO period elapses; in either case, the control of the lock 12 will return to operation 112 in FIG. 4A. Upon detection of the depressed Reset Button, the affirmative flow path is to operation 606 where Confirm Combination or "CC" is displayed; and thereafter the flow goes to return 608 which causes the flow to return to operation 336 and eventually return from thereto the main loop, operation 136 and the loop of operations associated therewith awaiting operator input.

Referring to operation 590, where the Confirmed Flag is tested to determine whether set, an affirmative determination results in flow to operation 610 where the entered combination is compared with the operation 600 generated real combination. Upon Compare Unequal Condition, the negative flow path indicates an error and the flow from operation 610 is diverted to operation 236. Similarly if the determination in operation 592 is in the negative, the flow will be directed to operation 235 indicating an error.

Returning now to operation 610, upon a Compare Equal Condition, the New User and Change Combination Flags are cleared in memory in operation 612. In operation 614 the EEPROM 42 is written to store the new Seed Combination to the user's record. Thereafter in operation 616 the Activate User Audit Record is built, and written into the EEPROM 42. Thereafter in operation 618 the operator is LCD 14 prompted with "EOP" that the procedure is terminated and the flow is returned to the top of the program and re-enter at operation 112.

The Shelve Mode of lock operation is selected to remove one or more modes of operation from the lock 12 after it has been initialized and removed from factory mode. The Shelve Mode permits resetting some of the operational characteristics of the lock 12 or permits returning the lock 12 to a condition equivalent to factory mode for storage in a standard predefined condition and mode of operation awaiting further use.

The Shelve Mode requires the use of a Supervisor Audit key 16 which is coded as a Shelve Mode key and the predetermined factory default combination.

Figures 17, 17A:
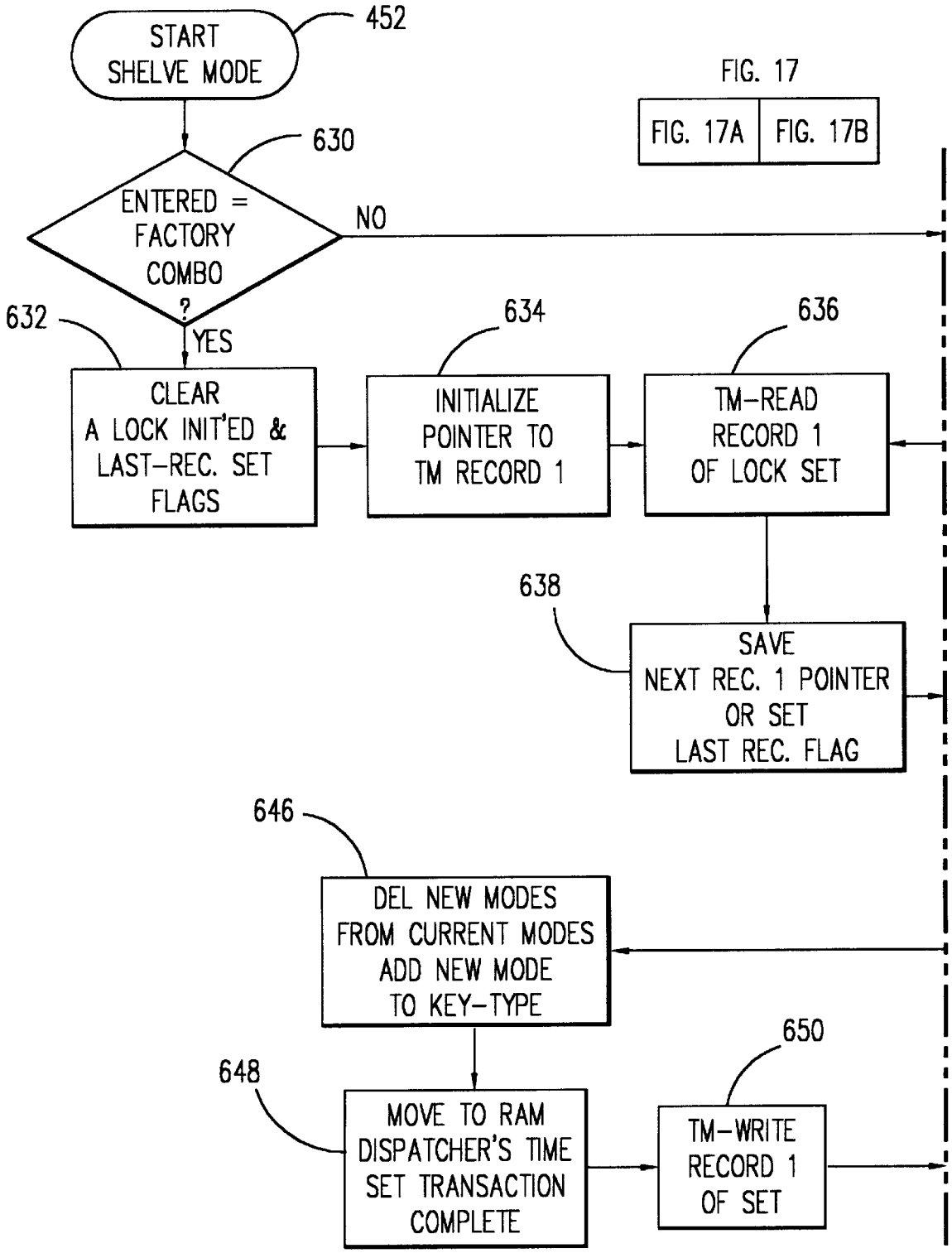
FIG. 17 is a diagram of the relationship of FIGS. 17A and 17B.
FIGS. 17A and 17B illustrate operation 452 of FIG. 13B.
Figure 17B:
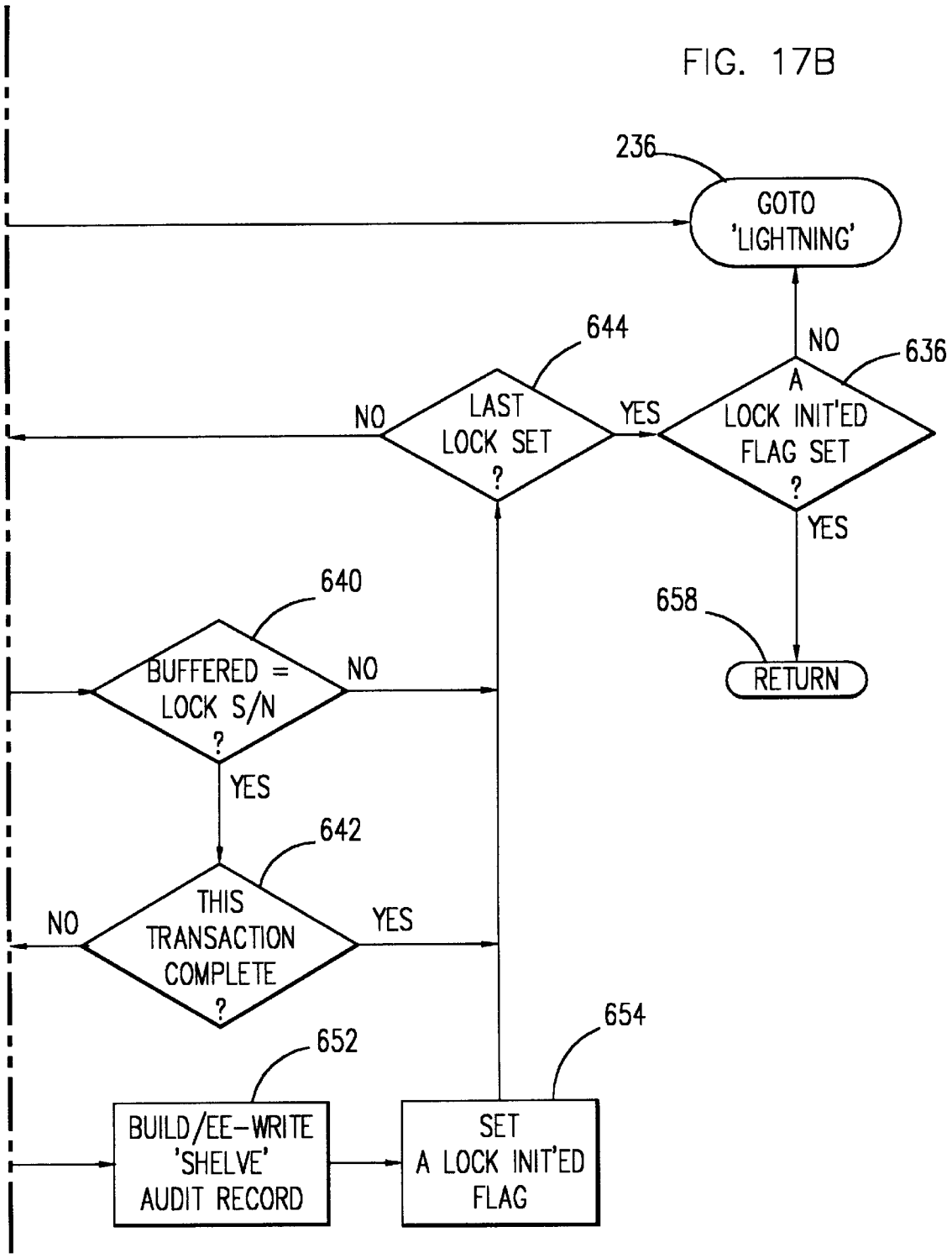

Referring now to FIGS. 17A and 17B, Shelve Mode operation 452 of FIG. 13B is illustrated in expanded form and will be described in additional detail. Upon entry into the subroutine at operation 452, the control flow is to operation 630 where the entered combination is compared with the factory combination; and upon a negative determination of the equality, the flow is to operation 236 to blink the lightning bolt on the LCD display 14. Upon a favorable comparison in operation 630, the "A Lock Initiated" and "Last Record Set" flags are cleared in operation 632 and the pointer to the Touch Memory Record 1 is initialized in operation 634. Thereafter in operation 636 the Touch Memory 16 is read to retrieve the first/next Record 1 of the Lock Set and the next Record 1 pointer is saved in operation 638 or, alternatively, the Last Record Flag is set.

Thereafter the buffered lock serial number from the electronic key or Touch Memory 16 is compared with the lock's serial number to determine equality; and with equality, the affirmative path is followed from operation 640 to operation 642 where the Transaction Complete Flag is tested to determine if this record set has already been processed. In operation 640 if the buffered lock serial number from the electronic key 16 is not equal to the lock serial number, then the flow is to the last Lock Set determination in operation 644. In operation 644 if the Last Lock Flag is not set, then the negative flow path is directed to operation 636 and will continue to loop until it finds a record which belongs to this particular lock 12. With regard to operation 642 if the transaction is determined to be complete, the flow path similarly will take the affirmative path and return to operation 644 and then subsequently continue to loop. In the event that the transaction is found not to be complete in operation 642, the flow is to operation 646 where the new mode is deleted from the current modes and added to the key type for later use.

The flow thereafter is to operation 648 where the dispatcher's time is moved from the key 16 to the lock RAM 44 and the Transaction Complete flag is set. Thereafter the Touch Memory 16 is written with Record 1 of the set in operation 650 and the Shelve Mode Audit Record is built and written into the EEPROM 42 in operation 652. Following the writing of the Shelve Mode Audit Record into the EEPROM 42, the "A Lock Initialized Flag" is set and the flow is directed therefrom to operation 644. If the Last Lock Set flag is determined to be set in operation 644, the affirmative path is followed to operation 646 where A Lock Initiated Flag set is tested; and if the determination is in the negative, an error condition exists and the flow goes to operation 236 to display the lightning bolt on the LCD 14. In the event that the determination in operation 656 is in the affirmative, then the flow is to operation 658 where the control is returned to operation 452 in FIG. 13B.

Figure 18B:
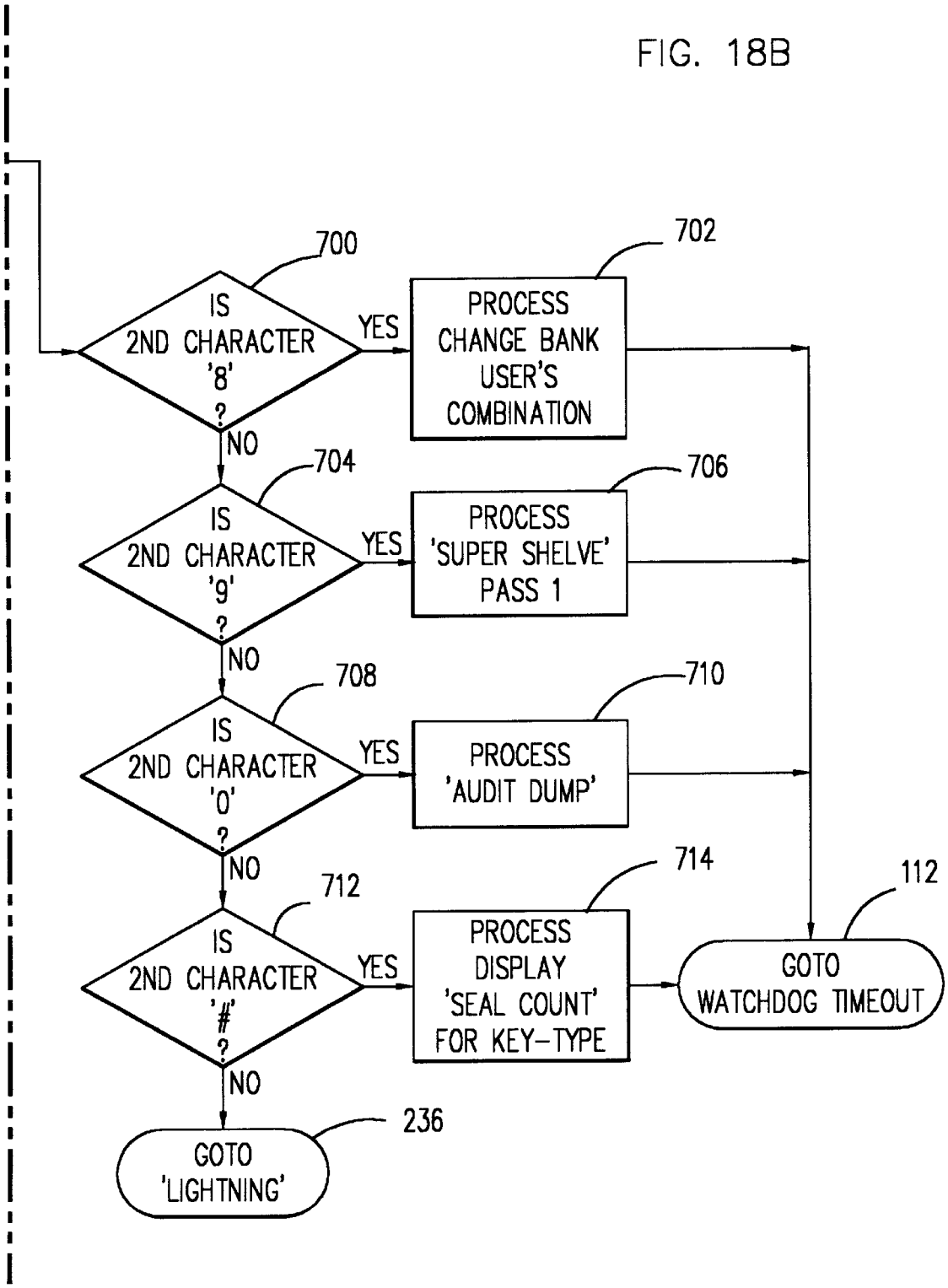

To better understand the function of the Process Special Menu Options step found in operation 174, of FIG. 7, reference is now made to FIG. 18A and 18B. Upon entry into operation 174 the decision is made in operation 680 as to whether the second character of the pair of characters entered into the lock 12 in operation 172 has a second character equal to 1. Upon a negative determination, the flow is directed to operation 682 for testing the second character for the value 2. If in operation 680 the second character is equal to 1, the Display Locks Code and Hardware Levels operation is processed. The lock's codes and hardware levels with headers are displayed sequentially and continue to loop through the display headers and data until such time as the operator cancels the display with the asterisk button on touch pad 10, the WDTO period expires, or the lock 12 powers down. Operation 684, upon completion, then will go to WDTO operation 112 and will cause the return to the START on FIG. 4A operation 112. The determination in operation 682 in the affirmative will cause the continuous display of a header and the lock's serial number, unless or until interrupted by the operator canceling the display operation 684, and then the flow will be to operation 112.

If the determination in operation 682 is in the negative, meaning that the second character of the pair is other than the numeral 2, then the determination in operation 688 is made as to whether the second character is equal to the value 3. In the event of a Compare Equal for the value 3, operation 690 will cause a header and the lock's total seal count to be displayed. Thereafter the flow is directed to operation 112 as described earlier.

If the determination in operation 688 is in the negative, then the second character is compared with the numeral 4 in operation 692; and if the character is a value of 4, then the process in operation 694 will prompt the operator to insert the electronic key 16 and then will display a header and the closed seal count for that key type continuously until interrupted by the operator. Thereafter the flow is to the WDTO in operation 112.

If the second character of the pair being considered is not a value 4 in operation 692, then the second character is tested to determine if it is a value 5 in operation 696. If the determination in operation 696 is one of equality, then the LCD display 14 will show a prompt of "??" indicating that the operator may enter a further pair of codes. In the event that the next pair of codes that is entered is again value 5, then the operation 698 will cause the continuous displaying of a header and the last 15 error codes that were determined in the operation of the lock 12 continuously until interrupted by the operator; then the flow will go to operation 112. In the event that the condition tested in operation 696 is not satisfied, the negative flow path will lead to operation 700 where the second character of the pair is tested for equality to the value 8. Upon an affirmative determination of equality, the Change Bank Users Combination subroutine operates in operation 702 and will be expanded on and explained in more detail below.

If the test for the value 8 in operation 700 is not confirmed, then the second character is subsequently processed and tested in operation 704 for a value of 9. Upon a Compare Equal Condition for the value 9, the Super Shelve Pass One process will be operative in operation 706. The operation of Super Shelve Pass One of operation 706 will be described and expanded upon below.

If the compare operation in operation 704 fails in testing for equality, then the second character of the pair is tested for equality with "0"; and if the compare equal condition is satisfied, then the audit records of the lock are dumped in operation 710. The Audit Dump is accomplished by storing the audit dump information from the lock 12 into the Supervisor Audit Key 16 that is placed in the key socket 18 after prompting by process 710 to be expanded on and explained in more detail below. This key 16 then may be returned to the dispatcher for analysis and report generation.

If the comparison in operation 708 is a Compare Not Equal, then the second character of the pair is tested for equality with the "#"; and in the event that there is no compare equal, an error condition exists and the condition in operation 712 is not satisfied. Thereafter the flow will go to operation 236 indicating the error condition.

If the condition tested in operation 712 is satisfied, then the operator is prompted to insert his electronic key 16. The electronic key is sampled to determine the key type and a header and the seal count for that key type then is continuously displayed until interrupted by the operator in operation 714 on the LCD 14. Upon the completion of each of the processes 702, 706, 710, and 714, the flow from each is to operation 112 to the WDTO operation 110.

The lock 12 has several functions not directly involved in its opening and closing but which contribute to the control of the security of the lock 12 itself and provide information additionally that is advantageous in the monitoring of the lock use of the lock such as the ability to be able to determine directly from the lock the hardware level of the circuit board and the microprocessor code level in the lock 12, to use in diagnosing many problems in its operation. Additionally, the lock's serial number may be accessed, the Total Opening Counter contents for the lock may be displayed, the last Close Seal for a particular key type may be acquired, the last 15 error codes may be displayed for maintenance, and the current seal count for the key type may be displayed and loaded into the key 16. Additionally, the Change of a Bank User Combination or a Lock Super Shelve function may be initiated. These operations are permitted through the entry of a code number in the form of "#X" X being is a numeral or a "#"; and upon entry, the function or operation is selected. These functions and their individual operations are explained in more detail with reference to FIG. 19.

Figure 19:
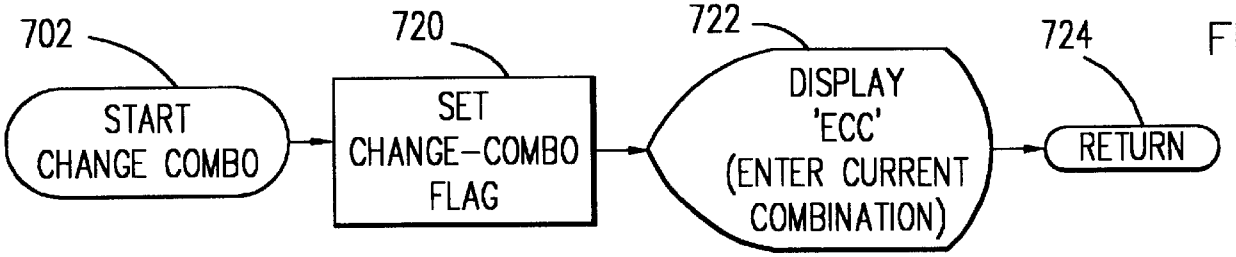
FIG. 19 illustrates operation 702 of FIG. 18B.

Refer now to FIG. 19 which illustrates the expansion of operation 702 found in FIG. 18B; operation 720 sets the Change Combination Flag and thereafter the display 14 shows "ECC" in operation 722 to prompt the operator to enter his/her current combination. Thereafter the flow is to return operation 724 where the return is to operation 702 and eventually back to the main operation as shown in the main loop in FIGS. 4A and 4B. The operation of the control software will continue at that point through the "Pair In" and "Combo In" flow diagrams to allow the user to enter his/her current combination, have the user's new combination displayed via the Initialize New User flow diagram and confirmed via the same flow path a last time.

Figure 20A:
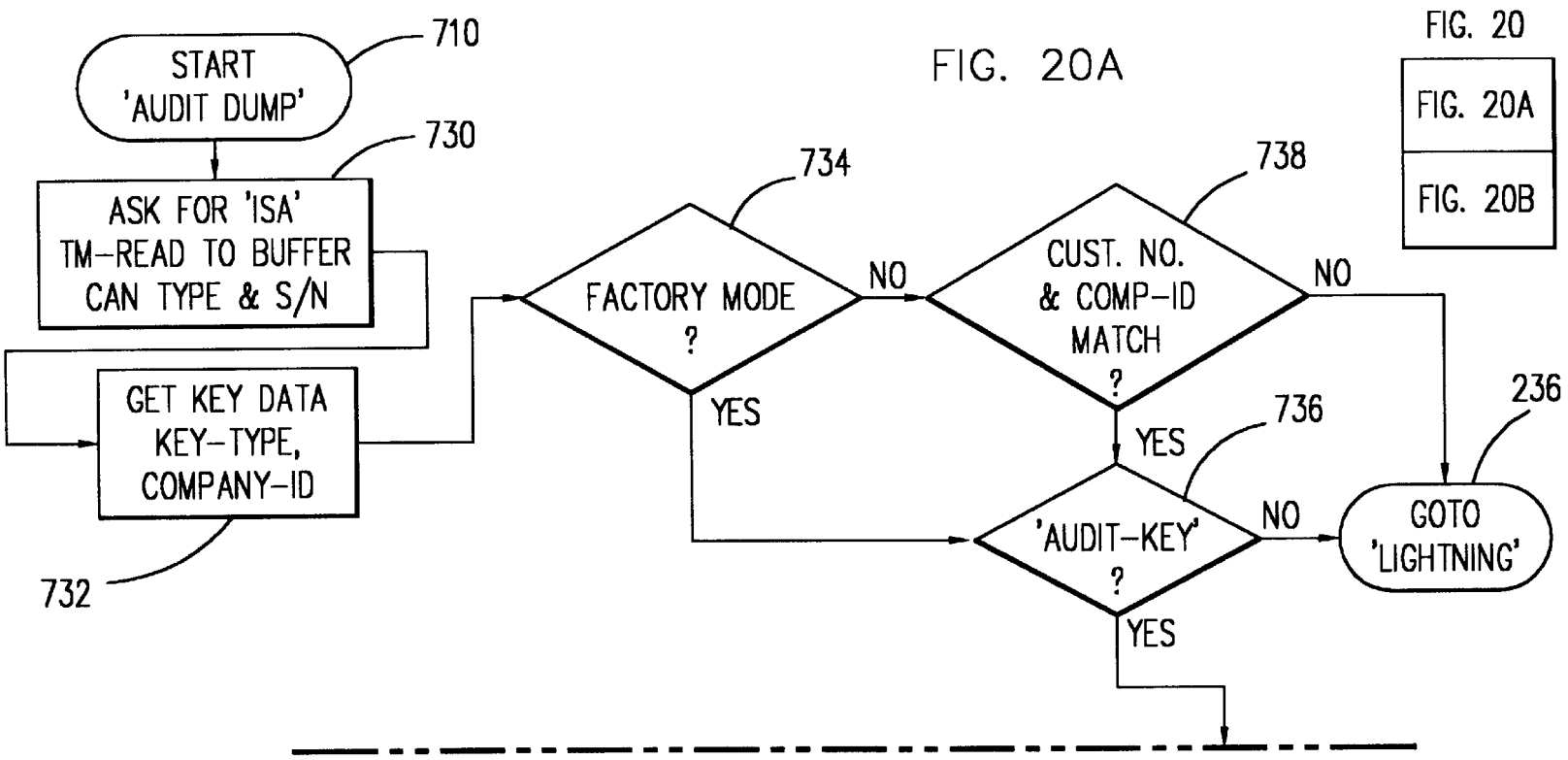
FIGS. 20A and 20B illustrate operation 710 of FIG. 18B.
Figure 20B:
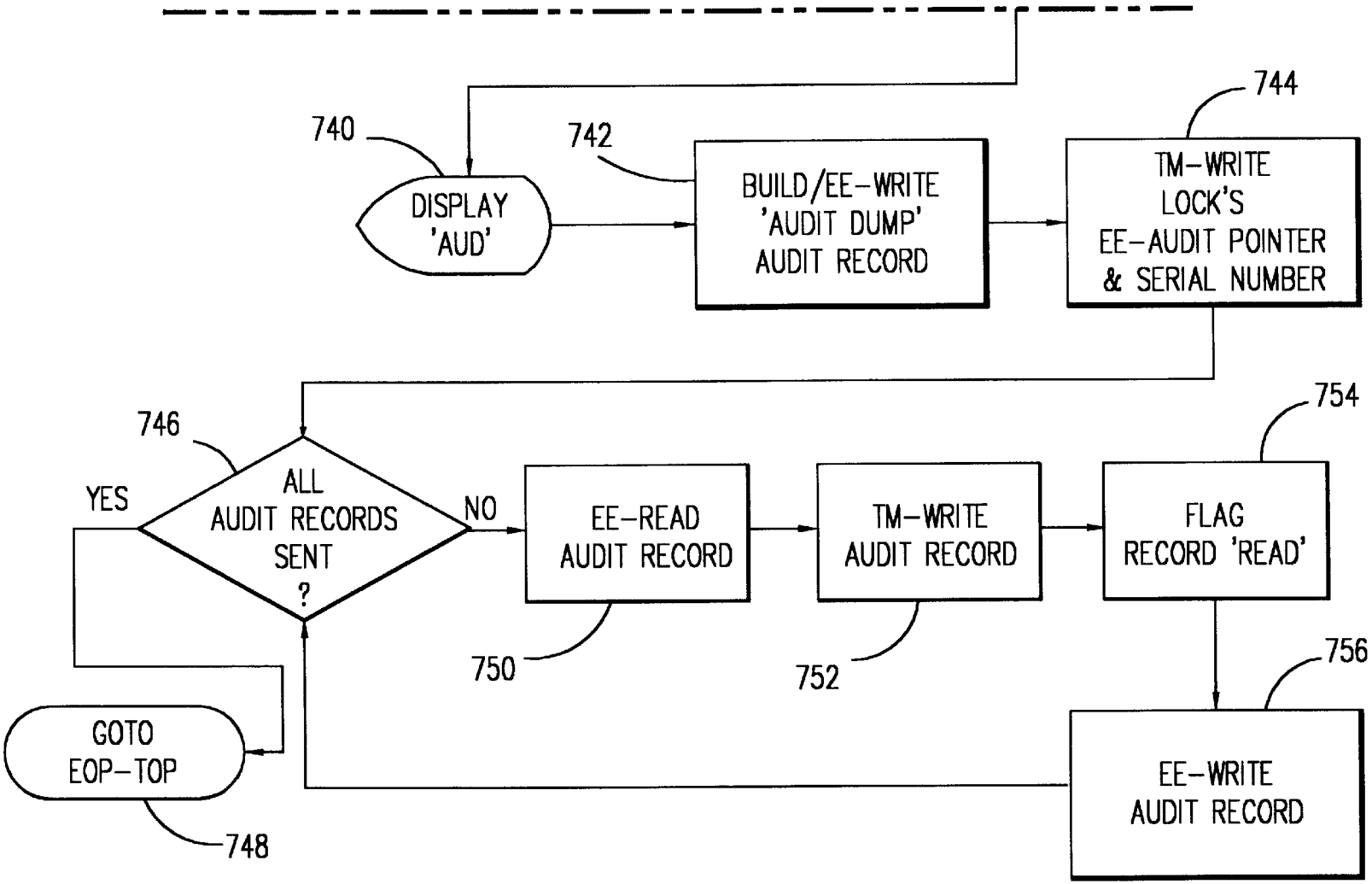

Referring now to operation 710 and FIG. 17B, that subroutine is further expanded in FIGS. 20A and 20B; and upon entry into operation 710, operation 730 will prompt the operator into inserting the Supervisory Audit Key 16, and the key 16 will be read to the buffer 46 of the lock 12 to store the can type and the serial number of the key 16.

Thereafter in operation 732 data from the key 16, namely the key type and the company ID, will be retrieved. At this point a determination is made in operation 734 as to whether the lock 12 is operating in factory mode; and if affirmative, key 16 is tested to determine whether it is an Audit Key in operation 736. In the event that it is not an Audit Key then an error condition exists and the error display will be triggered in operation 236.

In the event that the lock 12 in fact is not operating in the factory mode, then the customer number and the company ID are tested to determine whether they match any similar data in the key 16. In the event that the numbers do not match any of the similar data in the key 16, then an error condition exists and operation 236 is activated to display the lightning bolt on the LCD 14. In the event that a matching customer number and company ID in fact are found, the affirmative path is followed to testing whether the key 16 is an Audit Key in operation 736. The customer number and the company ID match determination is conducted in operation 738.

After the key 16 is tested and determined to be an Audit Key in operation 736 and has been so found, the affirmative path is followed to operation 740 where the display 14 then will show "Aud" to indicate to the operator that an Audit Dump is in process and therefore the operator should not remove the key 16 from the reader or socket 18 until the Audit Dump is complete. At that point, an Audit Dump Audit Record is built and written to the EEPROM 42 in operation 742. Thereafter in operation 744 the lock's EEPROM audit pointer and serial number are written to the Touch Memory or the electronic key 16 for dispatch system use once the key data is retrieved.

Thereafter a determination is made in operation 746 as to whether all of the audit records have been sent to the key 16; and in the event that the determination is YES, then the flow is to operation 748 which will display "EOP" and return control of the microprocessor 30 to operation 112. In the event that all records have not been sent, then the EEPROM 42 of the lock 12 is read to retrieve the next Audit Record in operation 750 and the Audit Record then is written to electronic key or Touch Memory 16 in operation 752. Thereafter the record is marked as "read" for future reference by the dispatch system in operation 754 and the Audit Record is written back to the EEPROM memory in operation 756. Thereafter the determination in operation 746 is repeated and will continue to loop until such time as all records have been sent to the supervisor audit key; at which point the flow is to operation 748.

Figure 21:
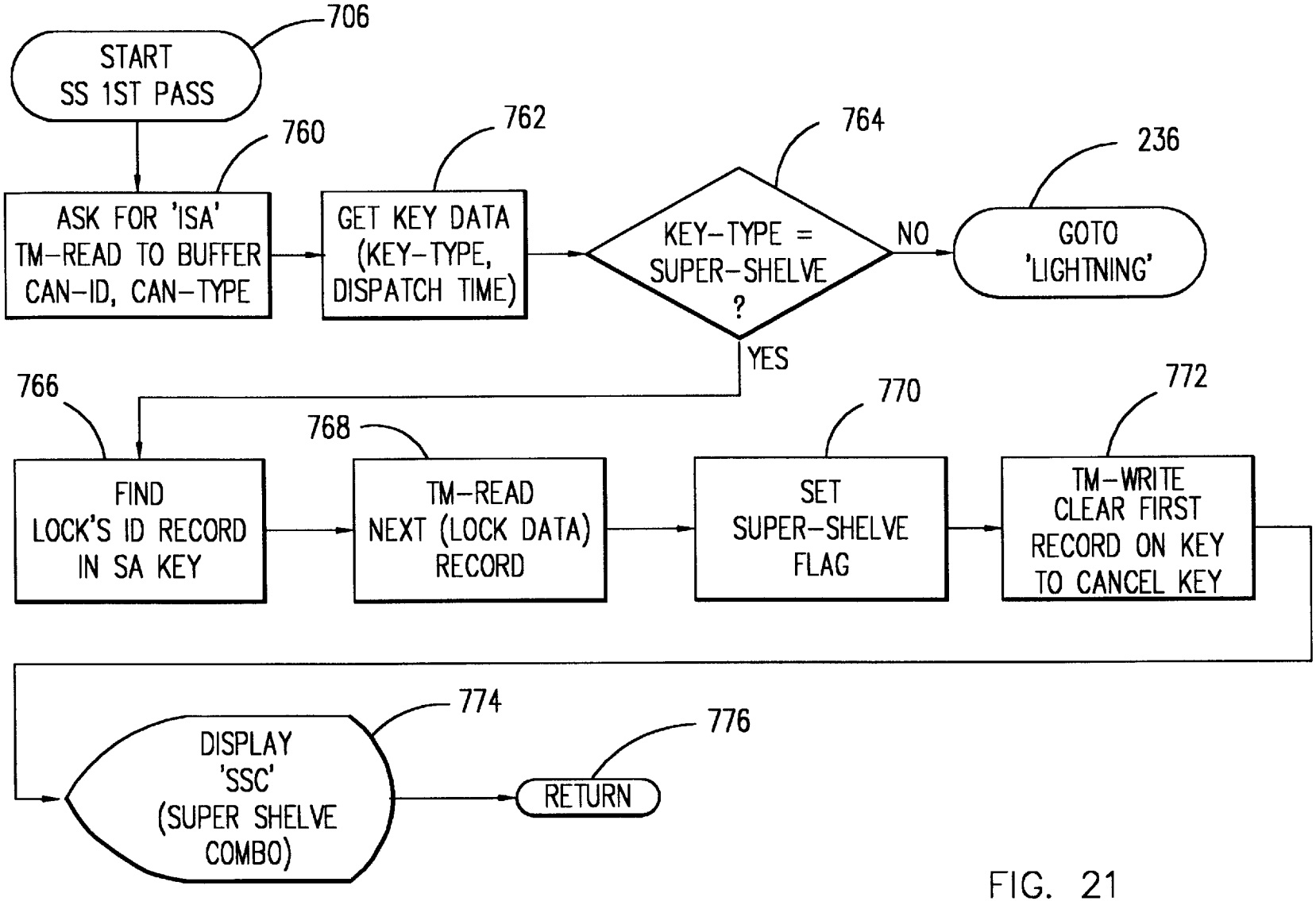
FIG. 21 illustrates operation 706 of FIG. 18B.

Referring now to FIG. 21 operation 706 shown in FIG. 1 will be explained and expanded in detail.

This mode, referred to as Super Shelve, allows the opening of a lock and its return to a shelved condition even when the lock will not operate in response to properly dispatched combinations, a condition that may occur when the dispatching computer and the lock are not in synchronization for any reason.

Upon entry into the Super Shelve First Pass, operation 760 causes the display of "ISA" to prompt the operator to insert a Supervisory Audit Key and then the key 16 is read and data transferred to the buffer 46 to store the key ID and the can type. Thereafter in operation 762 the data stored in the key 16 is retrieved, specifically the key type and the dispatch time.

In operation 764 the key type is tested to determine whether it is equal to a Super Shelve key; and in the event that it is not, the flow goes to operation 236 indicating an error and the displaying of the lightning bolt on the LCD display 14 of the lock 12.

If on the other hand the determination in operation 764 is in the affirmative, then the Locks ID Record is located in the Supervisory Audit key in operation 766 and the key 16 is read in operation 768 to get the next record.

Thereafter in operation 770 the Super Shelve Flag is set and the Touch Memory 16 is written to in order to clear the first Record of the key 16 and thereby prevent the reuse of the key 16 on any lock 12 including this one, in operation 772. In operation 774, the display 14 will show "ESS" to prompt the operator that the Super Shelve Combination is to be entered into the lock 12. Thereafter in flow operation 776, the return is to operation 706 in FIG. 18B. Eventually the flow will revert back to the main program as shown in FIGS. 4A and 4B to permit operator entry of additional data or information into the lock 12 as appropriate.

Referring at this point to FIG. 22, operation 186 found in FIG. 7 will be expanded and explained.

Upon entry into operation 186, a real combination is generated at operation 780 and both the entered combination and the real combination are compared in operation 782. In the event that the two combinations do not compare, an error condition exists and the lightning bolt will be displayed in operation 236.

If the two combinations in fact do compare then, they Compare Equal and operation 784 will remove and save all the modes of the lock 12, reverting to the factory mode and thereby shelving those modes of the lock 12. Thereafter operation 786 will clear the Super Shelve Flag and a Super Shelve Audit Record is built and written to EEPROM 42 in operation 788. The flow from operation 788 is to operation 790 where the End Of Process prompt is displayed on the LCD 14 and there is a return of process control to the Top Of the Program at operation 112.

The Super Shelve operation provides a very valuable operation or function to be performed with the lock 12. Circumstances may occur after the lock 12 is unpacked, installed on a container, and is functioning well into the use and, then for some reason, the lock and dispatch system will become hopelessly unsynchronized. As this occurs, the dispatch system cannot create a lock combination to function in the designated lock 12; the only apparent alternative is to open the safe by physical means such as drilling or other destructive techniques. In many cases the lock 12 is ruined or unusable, which is a relatively expensive entry and therefore is an undesirable approach to solving the inoperability of the lock. The destructive entry also may destroy or severely damage the container, which frequently is considerably more expensive than the lock itself. Only initiated and operated with a combination and a key 16 supplied by the lock manufacturer, the Super Shelve function can permit under very controlled circumstances the shelving of the lock 12 to factory condition whenever the lock 12 otherwise would be totally inoperable. Super Shelve also will serve to re-synchronize the lock 12 and the dispatch system from known data points and will then permit the lock 12 to continued to be used once the Super Shelve program has been operated and the lock re-initialized.

One of skill in the art will appreciate that while certain pieces of data have been specifically identified and described in the identifying of the user, the lock, and other values used in the generation of the combinations, it may be desirable and well within the abilities of a skilled programmer to select and use other values so long as the function performed provides the necessary level or degree of security. Such changes and modifications should not remove the device from the scope of the attached claims which define our invention.

We claim:

1. An electronic combination lock comprising:

a bolt having an extended locking position and a retracted releasing position;

an electronic control for controlling movement of said bolt between said extended locking position and said retracted releasing position;

an electronic relay having a pair of states, a connection to a signal line to an alarm, a connection to a voltage source, and a connection to ground, one of said states connecting said signal line to said ground and said other of said states connecting said signal line to said voltage source;

an electrical connection between said electronic control and said relay for controlling the state of said relay, whereby said relay may be controlled by said electronic control to provide either a voltage from said voltage source on said signal line or an absence of a voltage on said signal line in accord with the control exercised by said electronic control.

2. The electronic combination lock of claim 1 wherein said electronic control controls the changing between said states of said relay when said lock changes between a locked and unlocked condition.

3. The electronic combination lock of claim 1 wherein said electronic control controls the changing of said states of said relay to a condition connecting said voltage source to said connection to a signal line when said lock is conditioned to be in an unlocked state.

4. The electronic combination lock of claim 1 wherein said electronic control controls the changing of said states of said relay to a condition connecting said ground to said connection to a signal line when said lock is conditioned to be in a locked condition.

5. An electronic locking system comprising:

a combination lock:

said lock comprising an electronic control for receiving an operator supplied combination for controlling the operation of said lock;

an override control;

an alarm connection connected to a remote alarm circuit to provide signals to a remote alarm;

said remote alarm circuit comprising:

a detector disposed to detect any opening of an enclosure wherein said electronic lock is housed;

said override control operable by said electronic control to indicate to said remote alarm the opening of said lock, whereby said override control is connected to provide an indication that said alarm should be rendered ineffective upon unlocking of said lock.

6. The electronic locking system of claim 5 wherein said detector comprises a first switch, said first switch having a normally closed condition indicating through the passage of an electrical signal a locked state of said enclosure.

7. The electronic locking system of claim 6 wherein said override control comprises a relay which is normally open when said lock is locked and is switched when said lock is unlocked.

8. The electronic locking system of claim 7 wherein said override control is switched as a result of a signal from said electronic control, said signal emitted upon the opening of said lock.

9. The electronic locking system of claim 6 wherein said override control comprises a second switch actuated by opening the lock.

10. The electronic locking system of claim 6 wherein said alarm system is connected to said alarm connection of said combination lock and said second switch is thereby connected in parallel with said detector.

11. The electronic locking system of claim 6 wherein said electronic control comprises a microprocessor and said override control is electrically controlled by said microprocessor which provides a signal to said electrically controlled override control indicative of an operational status of said lock.

* * * * *